US011800281B2

(12) United States Patent
Ansai et al.

(10) Patent No.: US 11,800,281 B2
(45) **Date of Patent: *Oct. 24, 2023**

(54) PATTERN-FORMING MICROPHONE ARRAY

(71) Applicant: Shure Acquisition Holdings, Inc., Niles, IL (US)

(72) Inventors: Michelle Michiko Ansai, Chicago, IL (US); John Casey Gibbs, Chicago, IL (US); Mathew T. Abraham, Colorado Springs, CO (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/049,900

(22) Filed: Oct. 26, 2022

(65) Prior Publication Data

US 2023/0063105 A1 Mar. 2, 2023

Related U.S. Application Data

(63) Continuation of application No. 16/409,239, filed on May 10, 2019, now Pat. No. 11,523,212.

(Continued)

(51) Int. Cl.

*H04R 3/00* (2006.01)
*H04R 1/40* (2006.01)

(Continued)

(52) U.S. Cl.

CPC ..... *H04R 1/406* (2013.01); *H04R 3/005* (2013.01); *H04R 3/04* (2013.01); *H04R 19/04* (2013.01); *H04R 2201/003* (2013.01)

(58) Field of Classification Search

CPC ..... H04R 3/005; H04R 2201/401; H04R 2201/003; H04R 1/20; H04R 3/14; H04R 5/027

(Continued)

(56) References Cited

U.S. PATENT DOCUMENTS 1,535,408 A 4/1925 Fricke
1,540,788 A 6/1925 McClure (Continued)

FOREIGN PATENT DOCUMENTS

CA 2359771 4/2003
CA 2475283 1/2005

(Continued)

OTHER PUBLICATIONS

Tan, et al., "Pitch Detection Algorithm: Autocorrelation Method and AMDF," Department of Computer Engineering, Prince of Songkhla University, Jan. 2003, 6 pp.

(Continued)

*Primary Examiner* — George C Monikang

(74) *Attorney, Agent, or Firm* — NEAL, GERBER & EISENBERG LLP

(57) ABSTRACT

Embodiments include a planar microphone array comprising a first linear array arranged along a first axis; and a second linear array arranged along a second axis orthogonal to the first axis, a center of the second linear array aligned with a center of the first linear array, wherein each of the first linear array and the second linear array comprises a corresponding first set of microphone elements nested within a corresponding second set of microphone elements, and each set of microphone elements is arranged symmetrically about the center of the corresponding linear array, such that the first linear array and the second linear array are configured to generate a steerable directional polar pattern, the microphone elements of each linear array configured to capture audio signals. Embodiments also include a microphone system comprising the same and a method performed by processor(s) to generate an output signal for the same.

12 Claims, 7 Drawing Sheets

Related U.S. Application Data

(60) Provisional application No. 62/679,452, filed on Jun. 1, 2018.

(51) Int. Cl.
*H04R 3/04* (2006.01)
*H04R 19/04* (2006.01)

(58) Field of Classification Search
USPC ..... 381/92, 122
See application file for complete search history.

(56) References Cited

U.S. PATENT DOCUMENTS 1,965,830 A 7/1934 Hammer
2,075,588 A 3/1937 Meyers
2,113,219 A 4/1938 Olson
2,164,655 A 7/1939 Kleerup
D122,771 S 10/1940 Doner
2,233,412 A 3/1941 Hill
2,268,529 A 12/1941 Stiles
2,343,037 A 2/1944 Adelman
2,377,449 A 6/1945 Prevette
2,481,250 A 9/1949 Schneider
2,521,603 A 9/1950 Prew
2,533,565 A 12/1950 Eichelman
2,539,671 A 1/1951 Olson
2,777,232 A 1/1957 Kulicke
2,828,508 A 4/1958 Labarre
2,840,181 A 6/1958 Wildman
2,882,633 A 4/1959 Howell
2,912,605 A 11/1959 Tibbetts
2,938,113 A 5/1960 Schnell
2,950,556 A 8/1960 Larios
3,019,854 A 2/1962 Obryant
3,132,713 A 5/1964 Seeler
3,143,182 A 8/1964 Sears
3,160,225 A 12/1964 Sechrist
3,161,975 A 12/1964 McMillan
3,205,601 A 9/1965 Gawne
3,239,973 A 3/1966 Hannes
3,240,883 A 3/1966 Seeler
3,310,901 A 3/1967 Sarkisian
3,321,170 A 5/1967 Vye
3,509,290 A 4/1970 Mochida
3,573,399 A 4/1971 Schroeder
3,657,490 A 4/1972 Scheiber
3,696,885 A 10/1972 Grieg
3,755,625 A 8/1973 Maston
3,828,508 A 8/1974 Moeller
3,857,191 A 12/1974 Sadorus
3,895,194 A 7/1975 Fraim
3,906,431 A 9/1975 Clearwaters
D237,103 S 10/1975 Fisher
3,936,606 A 2/1976 Wanke
3,938,617 A 2/1976 Forbes
3,941,638 A 3/1976 Horky
3,992,584 A 11/1976 Dugan
4,007,461 A 2/1977 Luedtke
4,008,408 A 2/1977 Kodama
4,029,170 A 6/1977 Phillips
4,032,725 A 6/1977 McGee
4,070,547 A 1/1978 Dellar
4,072,821 A 2/1978 Bauer
4,096,353 A 6/1978 Bauer
4,127,156 A 11/1978 Brandt
4,131,760 A 12/1978 Christensen
4,169,219 A 9/1979 Beard
4,184,048 A 1/1980 Alcaide
4,198,705 A 4/1980 Massa
D255,234 S 6/1980 Wellward
D256,015 S 7/1980 Doherty
4,212,133 A 7/1980 Lufkin
4,237,339 A 12/1980 Bunting
4,244,096 A 1/1981 Kashichi
4,244,906 A 1/1981 Heinemann
4,254,417 A 3/1981 Speiser
4,275,694 A 6/1981 Nagaishi
4,296,280 A 10/1981 Richie
4,305,141 A 12/1981 Massa
4,308,425 A 12/1981 Momose
4,311,874 A 1/1982 Wallace, Jr.
4,330,691 A 5/1982 Gordon
4,334,740 A 6/1982 Wray
4,365,449 A 12/1982 Liautaud
4,373,191 A 2/1983 Fette
4,393,631 A 7/1983 Krent
4,414,433 A 11/1983 Horie
4,429,850 A 2/1984 Weber
4,436,966 A 3/1984 Botros
4,449,238 A 5/1984 Lee
4,466,117 A 8/1984 Gorike
4,485,484 A 11/1984 Flanagan
4,489,442 A 12/1984 Anderson
4,518,826 A 5/1985 Caudill
4,521,908 A 6/1985 Miyaji
4,566,557 A 1/1986 Lemaitre
4,593,404 A 6/1986 Bolin
4,594,478 A 6/1986 Gumb
D285,067 S 8/1986 Delbuck
4,625,827 A 12/1986 Bartlett
4,653,102 A 3/1987 Hansen
4,658,425 A 4/1987 Julstrom
4,669,108 A 5/1987 Deinzer
4,675,906 A 6/1987 Sessler
4,693,174 A 9/1987 Anderson
4,696,043 A 9/1987 Iwahara
4,712,231 A 12/1987 Julstrom
4,741,038 A 4/1988 Elko
4,752,961 A 6/1988 Kahn
4,805,730 A 2/1989 O'Neill
4,815,132 A 3/1989 Minami
4,860,366 A 8/1989 Fukushi
4,862,507 A 8/1989 Woodard
4,866,868 A 9/1989 Kass
4,881,135 A 11/1989 Heilweil
4,888,807 A 12/1989 Reichel
4,903,247 A 2/1990 Van Gerwen
4,923,032 A 5/1990 Nuernberger
4,928,312 A 5/1990 Hill
4,969,197 A 11/1990 Takaya
5,000,286 A 3/1991 Crawford
5,038,935 A 8/1991 Wenkman
5,058,170 A 10/1991 Kanamori
5,088,574 A 2/1992 Kertesz, III
D324,780 S 3/1992 Sebesta
5,121,426 A 6/1992 Baumhauer
D329,239 S 9/1992 Hahn
5,189,701 A 2/1993 Jain
5,204,907 A 4/1993 Staple
5,214,709 A 5/1993 Ribic
5,224,170 A 6/1993 Waite, Jr.
D340,718 S 10/1993 Leger
5,289,544 A 2/1994 Franklin
D345,346 S 3/1994 Alfonso
D345,379 S 3/1994 Chan
5,297,210 A 3/1994 Julstrom
5,322,979 A 6/1994 Cassity
5,323,459 A 6/1994 Hirano
5,329,593 A 7/1994 Lazzeroni
5,335,011 A 8/1994 Addeo
5,353,279 A 10/1994 Koyama
5,359,374 A 10/1994 Schwartz
5,371,789 A 12/1994 Hirano
5,383,293 A 1/1995 Royal
5,384,843 A 1/1995 Masuda
5,396,554 A 3/1995 Hirano
5,400,413 A 3/1995 Kindel
D363,045 S 10/1995 Phillips
5,473,701 A 12/1995 Cezanne
5,509,634 A 4/1996 Gebka
5,513,265 A 4/1996 Hirano
5,525,765 A 6/1996 Freiheit
5,550,924 A 8/1996 Helf

(56) References Cited

U.S. PATENT DOCUMENTS

| | | | |
|---|---|---|---|
| 5,550,925 | A | 8/1996 | Hori |
| 5,555,447 | A | 9/1996 | Kotzin |
| 5,574,793 | A | 11/1996 | Hirschhorn |
| 5,602,962 | A | 2/1997 | Kellermann |
| 5,633,936 | A | 5/1997 | Oh |
| 5,645,257 | A | 7/1997 | Ward |
| D382,118 | S | 8/1997 | Ferrero |
| 5,657,393 | A | 8/1997 | Crow |
| 5,661,813 | A | 8/1997 | Shimauchi |
| 5,673,327 | A | 9/1997 | Julstrom |
| 5,687,229 | A | 11/1997 | Sih |
| 5,706,344 | A | 1/1998 | Finn |
| 5,715,319 | A | 2/1998 | Chu |
| 5,717,171 | A | 2/1998 | Miller |
| D392,977 | S | 3/1998 | Kim |
| D394,061 | S | 5/1998 | Fink |
| 5,761,318 | A | 6/1998 | Shimauchi |
| 5,766,702 | A | 6/1998 | Lin |
| 5,787,183 | A | 7/1998 | Chu |
| 5,796,819 | A | 8/1998 | Romesburg |
| 5,848,146 | A | 12/1998 | Slattery |
| 5,870,482 | A | 2/1999 | Loeppert |
| 5,878,147 | A | 3/1999 | Killion |
| 5,888,412 | A | 3/1999 | Sooriakumar |
| 5,888,439 | A | 3/1999 | Miller |
| D416,315 | S | 11/1999 | Nanjo |
| 5,978,211 | A | 11/1999 | Hong |
| 5,991,277 | A | 11/1999 | Maeng |
| 6,035,962 | A | 3/2000 | Lin |
| 6,039,457 | A | 3/2000 | O'Neal |
| 6,041,127 | A | 3/2000 | Elko |
| 6,049,607 | A | 4/2000 | Marash |
| D424,538 | S | 5/2000 | Hayashi |
| 6,069,961 | A | 5/2000 | Nakazawa |
| 6,125,179 | A | 9/2000 | Wu |
| D432,518 | S | 10/2000 | Muto |
| 6,128,395 | A | 10/2000 | De Vries |
| 6,137,887 | A | 10/2000 | Anderson |
| 6,144,746 | A | 11/2000 | Azima |
| 6,151,399 | A | 11/2000 | Killion |
| 6,173,059 | B1 | 1/2001 | Huang |
| 6,198,831 | B1 | 3/2001 | Azima |
| 6,205,224 | B1 | 3/2001 | Underbrink |
| 6,215,881 | B1 | 4/2001 | Azima |
| 6,266,427 | B1 | 7/2001 | Mathur |
| 6,285,770 | B1 | 9/2001 | Azima |
| 6,301,357 | B1 | 10/2001 | Romesburg |
| 6,329,908 | B1 | 12/2001 | Frecska |
| 6,332,029 | B1 | 12/2001 | Azima |
| D453,016 | S | 1/2002 | Nevill |
| 6,386,315 | B1 | 5/2002 | Roy |
| 6,393,129 | B1 | 5/2002 | Conrad |
| 6,424,635 | B1 | 7/2002 | Song |
| 6,442,272 | B1 | 8/2002 | Osovets |
| 6,449,593 | B1 | 9/2002 | Valve |
| 6,481,173 | B1 | 11/2002 | Roy |
| 6,488,367 | B1 | 12/2002 | Debesis |
| D469,090 | S | 1/2003 | Tsuji |
| 6,505,057 | B1 | 1/2003 | Finn |
| 6,507,659 | B1 | 1/2003 | Iredale |
| 6,510,919 | B1 | 1/2003 | Roy |
| 6,526,147 | B1 | 2/2003 | Rung |
| 6,556,682 | B1 | 4/2003 | Gilloire |
| 6,592,237 | B1 | 7/2003 | Pledger |
| 6,622,030 | B1 | 9/2003 | Romesburg |
| D480,923 | S | 10/2003 | Neubourg |
| 6,633,647 | B1 | 10/2003 | Markow |
| 6,665,971 | B2 | 12/2003 | Lowry |
| 6,694,028 | B1 | 2/2004 | Matsuo |
| 6,704,422 | B1 | 3/2004 | Jensen |
| D489,707 | S | 5/2004 | Kobayashi |
| 6,731,334 | B1 | 5/2004 | Maeng |
| 6,741,720 | B1 | 5/2004 | Myatt |
| 6,757,393 | B1 | 6/2004 | Spitzer |
| 6,768,795 | B2 | 7/2004 | Feltstroem |
| 6,868,377 | B1 | 3/2005 | Laroche |
| 6,885,750 | B2 | 4/2005 | Egelmeers |
| 6,885,986 | B1 | 4/2005 | Gigi |
| D504,889 | S | 5/2005 | Andre |
| 6,889,183 | B1 | 5/2005 | Gunduzhan |
| 6,895,093 | B1 | 5/2005 | Ali |
| 6,931,123 | B1 | 8/2005 | Hughes |
| 6,944,312 | B2 | 9/2005 | Mason |
| D510,729 | S | 10/2005 | Chen |
| 6,968,064 | B1 | 11/2005 | Ning |
| 6,990,193 | B2 | 1/2006 | Beaucoup |
| 6,993,126 | B1 | 1/2006 | Kyrylenko |
| 6,993,145 | B2 | 1/2006 | Combest |
| 7,003,099 | B1 | 2/2006 | Zhang |
| 7,013,267 | B1 | 3/2006 | Huart |
| 7,031,269 | B2 | 4/2006 | Lee |
| 7,035,398 | B2 | 4/2006 | Matsuo |
| 7,035,415 | B2 | 4/2006 | Belt |
| 7,050,576 | B2 | 5/2006 | Zhang |
| 7,054,451 | B2 | 5/2006 | Janse |
| D526,643 | S | 8/2006 | Ishizaki |
| D527,372 | S | 8/2006 | Allen |
| 7,092,516 | B2 | 8/2006 | Furuta |
| 7,092,882 | B2 | 8/2006 | Arrowood |
| 7,098,865 | B2 | 8/2006 | Christensen |
| 7,106,876 | B2 | 9/2006 | Santiago |
| 7,120,269 | B2 | 10/2006 | Lowell |
| 7,130,309 | B2 | 10/2006 | Planka |
| D533,177 | S | 12/2006 | Andre |
| 7,149,320 | B2 | 12/2006 | Haykin |
| 7,161,534 | B2 | 1/2007 | Tsai |
| 7,187,765 | B2 | 3/2007 | Popovic |
| 7,203,308 | B2 | 4/2007 | Kubota |
| D542,543 | S | 5/2007 | Bruce |
| 7,212,628 | B2 | 5/2007 | Popovic |
| D546,318 | S | 7/2007 | Yoon |
| D546,814 | S | 7/2007 | Takita |
| D547,748 | S | 7/2007 | Tsuge |
| 7,239,714 | B2 | 7/2007 | De Blok |
| D549,673 | S | 8/2007 | Niitsu |
| 7,269,263 | B2 | 9/2007 | Dedieu |
| D552,570 | S | 10/2007 | Niitsu |
| D559,553 | S | 1/2008 | Mischel |
| 7,333,476 | B2 | 2/2008 | LeBlanc |
| D566,685 | S | 4/2008 | Koller |
| 7,359,504 | B1 | 4/2008 | Reuss |
| 7,366,310 | B2 | 4/2008 | Stinson |
| 7,387,151 | B1 | 6/2008 | Payne |
| 7,412,376 | B2 | 8/2008 | Florencio |
| 7,415,117 | B2 | 8/2008 | Tashev |
| D578,509 | S | 10/2008 | Thomas |
| D581,510 | S | 11/2008 | Albano |
| D582,391 | S | 12/2008 | Morimoto |
| D587,709 | S | 3/2009 | Niitsu |
| D589,605 | S | 3/2009 | Reedy |
| 7,503,616 | B2 | 3/2009 | Linhard |
| 7,515,719 | B2 | 4/2009 | Hooley |
| 7,536,769 | B2 | 5/2009 | Pedersen |
| D595,402 | S | 6/2009 | Miyake |
| D595,736 | S | 7/2009 | Son |
| 7,558,381 | B1 | 7/2009 | Ali |
| 7,565,949 | B2 | 7/2009 | Tojo |
| D601,585 | S | 10/2009 | Andre |
| 7,651,390 | B1 | 1/2010 | Profeta |
| 7,660,428 | B2 | 2/2010 | Rodman |
| 7,667,728 | B2 | 2/2010 | Kenoyer |
| 7,672,445 | B1 | 3/2010 | Zhang |
| D613,338 | S | 4/2010 | Marukos |
| 7,701,110 | B2 | 4/2010 | Fukuda |
| 7,702,116 | B2 | 4/2010 | Stone |
| D614,871 | S | 5/2010 | Tang |
| 7,724,891 | B2 | 5/2010 | Beaucoup |
| D617,441 | S | 6/2010 | Koury |
| 7,747,001 | B2 | 6/2010 | Kellermann |
| 7,756,278 | B2 | 7/2010 | Moorer |
| 7,783,063 | B2 | 8/2010 | Pocino |
| 7,787,328 | B2 | 8/2010 | Chu |
| 7,830,862 | B2 | 11/2010 | James |
| 7,831,035 | B2 | 11/2010 | Stokes |

(56) References Cited

U.S. PATENT DOCUMENTS

| | | | |
|---|---|---|---|
| 7,831,036 | B2 | 11/2010 | Beaucoup |
| 7,856,097 | B2 | 12/2010 | Tokuda |
| 7,881,486 | B1 | 2/2011 | Killion |
| 7,894,421 | B2 | 2/2011 | Kwan |
| D636,188 | S | 4/2011 | Kim |
| 7,925,006 | B2 | 4/2011 | Hirai |
| 7,925,007 | B2 | 4/2011 | Stokes |
| 7,936,886 | B2 | 5/2011 | Kim |
| 7,970,123 | B2 | 6/2011 | Beaucoup |
| 7,970,151 | B2 | 6/2011 | Oxford |
| D642,385 | S | 8/2011 | Lee |
| D643,015 | S | 8/2011 | Kim |
| 7,991,167 | B2 | 8/2011 | Oxford |
| 7,995,768 | B2 | 8/2011 | Miki |
| 8,000,481 | B2 | 8/2011 | Nishikawa |
| 8,005,238 | B2 | 8/2011 | Tashev |
| 8,019,091 | B2 | 9/2011 | Burnett |
| 8,041,054 | B2 | 10/2011 | Yeldener |
| 8,059,843 | B2 | 11/2011 | Hung |
| 8,064,629 | B2 | 11/2011 | Jiang |
| 8,085,947 | B2 | 12/2011 | Haulick |
| 8,085,949 | B2 | 12/2011 | Kim |
| 8,095,120 | B1 | 1/2012 | Blair |
| 8,098,842 | B2 | 1/2012 | Florencio |
| 8,098,844 | B2 | 1/2012 | Elko |
| 8,103,030 | B2 | 1/2012 | Barthel |
| 8,109,360 | B2 | 2/2012 | Stewart, Jr. |
| 8,112,272 | B2 | 2/2012 | Nagahama |
| 8,116,500 | B2 | 2/2012 | Oxford |
| 8,121,834 | B2 | 2/2012 | Rosec |
| D655,271 | S | 3/2012 | Park |
| D656,473 | S | 3/2012 | Laube |
| 8,130,969 | B2 | 3/2012 | Buck |
| 8,130,977 | B2 | 3/2012 | Chu |
| 8,135,143 | B2 | 3/2012 | Ishibashi |
| 8,144,886 | B2 | 3/2012 | Ishibashi |
| D658,153 | S | 4/2012 | Woo |
| 8,155,331 | B2 | 4/2012 | Nakadai |
| 8,170,882 | B2 | 5/2012 | Davis |
| 8,175,291 | B2 | 5/2012 | Chan |
| 8,175,871 | B2 | 5/2012 | Wang |
| 8,184,801 | B1 | 5/2012 | Hamalainen |
| 8,189,765 | B2 | 5/2012 | Nishikawa |
| 8,189,810 | B2 | 5/2012 | Wolff |
| 8,194,863 | B2 | 6/2012 | Takumai |
| 8,199,927 | B1 | 6/2012 | Raftery |
| 8,204,198 | B2 | 6/2012 | Adeney |
| 8,204,248 | B2 | 6/2012 | Haulick |
| 8,208,664 | B2 | 6/2012 | Iwasaki |
| 8,213,596 | B2 | 7/2012 | Beaucoup |
| 8,213,634 | B1 | 7/2012 | Daniel |
| 8,219,387 | B2 | 7/2012 | Cutler |
| 8,229,134 | B2 | 7/2012 | Duraiswami |
| 8,233,352 | B2 | 7/2012 | Beaucoup |
| 8,243,951 | B2 | 8/2012 | Ishibashi |
| 8,244,536 | B2 | 8/2012 | Arun |
| 8,249,273 | B2 | 8/2012 | Inoda |
| 8,259,959 | B2 | 9/2012 | Marton |
| 8,275,120 | B2 | 9/2012 | Stokes, III |
| 8,280,728 | B2 | 10/2012 | Chen |
| 8,284,949 | B2 | 10/2012 | Farhang |
| 8,284,952 | B2 | 10/2012 | Reining |
| 8,286,749 | B2 | 10/2012 | Stewart |
| 8,290,142 | B1 | 10/2012 | Lambert |
| 8,291,670 | B2 | 10/2012 | Gard |
| 8,297,402 | B2 | 10/2012 | Stewart |
| 8,315,380 | B2 | 11/2012 | Liu |
| 8,331,582 | B2 | 12/2012 | Steele |
| 8,345,898 | B2 | 1/2013 | Reining |
| 8,355,521 | B2 | 1/2013 | Larson |
| 8,370,140 | B2 | 2/2013 | Vitte |
| 8,379,823 | B2 | 2/2013 | Ratmanski |
| 8,385,557 | B2 | 2/2013 | Tashev |
| D678,329 | S | 3/2013 | Lee |
| 8,395,653 | B2 | 3/2013 | Feng |
| 8,403,107 | B2 | 3/2013 | Stewart |
| 8,406,436 | B2 | 3/2013 | Craven |
| 8,428,661 | B2 | 4/2013 | Chen |
| 8,433,061 | B2 | 4/2013 | Cutler |
| D682,266 | S | 5/2013 | Wu |
| 8,437,490 | B2 | 5/2013 | Marton |
| 8,443,930 | B2 | 5/2013 | Stewart, Jr. |
| 8,447,590 | B2 | 5/2013 | Ishibashi |
| 8,472,639 | B2 | 6/2013 | Reining |
| 8,472,640 | B2 | 6/2013 | Marton |
| D685,346 | S | 7/2013 | Szymanski |
| D686,182 | S | 7/2013 | Ashiwa |
| 8,479,871 | B2 | 7/2013 | Stewart |
| 8,483,398 | B2 | 7/2013 | Fozunbal |
| 8,498,423 | B2 | 7/2013 | Thaden |
| D687,432 | S | 8/2013 | Duan |
| 8,503,653 | B2 | 8/2013 | Ahuja |
| 8,515,089 | B2 | 8/2013 | Nicholson |
| 8,515,109 | B2 | 8/2013 | Dittberner |
| 8,526,633 | B2 | 9/2013 | Ukai |
| 8,553,904 | B2 | 10/2013 | Said |
| 8,559,611 | B2 | 10/2013 | Ratmanski |
| D693,328 | S | 11/2013 | Goetzen |
| 8,583,481 | B2 | 11/2013 | Viveiros |
| 8,599,194 | B2 | 12/2013 | Lewis |
| 8,600,443 | B2 | 12/2013 | Kawaguchi |
| 8,605,890 | B2 | 12/2013 | Zhang |
| 8,620,650 | B2 | 12/2013 | Walters |
| 8,631,897 | B2 | 1/2014 | Stewart |
| 8,634,569 | B2 | 1/2014 | Lu |
| 8,638,951 | B2 | 1/2014 | Zurek |
| D699,712 | S | 2/2014 | Bourne |
| 8,644,477 | B2 | 2/2014 | Gilbert |
| 8,654,955 | B1 | 2/2014 | Lambert |
| 8,654,990 | B2 | 2/2014 | Faller |
| 8,660,274 | B2 | 2/2014 | Wolff |
| 8,660,275 | B2 | 2/2014 | Buck |
| 8,670,581 | B2 | 3/2014 | Harman |
| 8,672,087 | B2 | 3/2014 | Stewart |
| 8,675,890 | B2 | 3/2014 | Schmidt |
| 8,675,899 | B2 | 3/2014 | Jung |
| 8,676,728 | B1 | 3/2014 | Velusamy |
| 8,682,675 | B2 | 3/2014 | Togami |
| 8,724,829 | B2 | 5/2014 | Visser |
| 8,730,156 | B2 | 5/2014 | Weising |
| 8,744,069 | B2 | 6/2014 | Cutler |
| 8,744,101 | B1 | 6/2014 | Burns |
| 8,755,536 | B2 | 6/2014 | Chen |
| 8,787,560 | B2 | 7/2014 | Buck |
| 8,811,601 | B2 | 8/2014 | Mohammad |
| 8,818,002 | B2 | 8/2014 | Tashev |
| 8,824,693 | B2 | 9/2014 | Åhgren |
| 8,842,851 | B2 | 9/2014 | Beaucoup |
| 8,855,326 | B2 | 10/2014 | Derkx |
| 8,855,327 | B2 | 10/2014 | Tanaka |
| 8,861,713 | B2 | 10/2014 | Xu |
| 8,861,756 | B2 | 10/2014 | Zhu |
| 8,873,789 | B2 | 10/2014 | Bigeh |
| D717,272 | S | 11/2014 | Kim |
| 8,886,343 | B2 | 11/2014 | Ishibashi |
| 8,893,849 | B2 | 11/2014 | Hudson |
| 8,898,633 | B2 | 11/2014 | Bryant |
| D718,731 | S | 12/2014 | Lee |
| 8,903,106 | B2 | 12/2014 | Meyer |
| 8,923,529 | B2 | 12/2014 | McCowan |
| 8,929,564 | B2 | 1/2015 | Kikkeri |
| 8,942,382 | B2 | 1/2015 | Elko |
| 8,965,546 | B2 | 2/2015 | Visser |
| D725,059 | S | 3/2015 | Kim |
| D725,631 | S | 3/2015 | McNamara |
| 8,976,977 | B2 | 3/2015 | De Sena et al. |
| 8,983,089 | B1 | 3/2015 | Chu |
| 8,983,834 | B2 | 3/2015 | Davis |
| D726,144 | S | 4/2015 | Kang |
| D727,968 | S | 4/2015 | Onoue |
| 9,002,028 | B2 | 4/2015 | Haulick |
| D729,767 | S | 5/2015 | Lee |
| 9,038,301 | B2 | 5/2015 | Zelbacher |
| 9,088,336 | B2 | 7/2015 | Mani |

(56) References Cited

U.S. PATENT DOCUMENTS

| | | | |
|---|---|---|---|
| 9,094,496 | B2 | 7/2015 | Teutsch |
| D735,717 | S | 8/2015 | Lam |
| D737,245 | S | 8/2015 | Fan |
| 9,099,094 | B2 | 8/2015 | Burnett |
| 9,107,001 | B2 | 8/2015 | Diethorn |
| 9,111,543 | B2 | 8/2015 | Åhgren |
| 9,113,242 | B2 | 8/2015 | Hyun |
| 9,113,247 | B2 | 8/2015 | Chatlani |
| 9,126,827 | B2 | 9/2015 | Hsieh |
| 9,129,223 | B1 | 9/2015 | Velusamy |
| 9,140,054 | B2 | 9/2015 | Oberbroeckling |
| D740,279 | S | 10/2015 | Wu |
| 9,172,345 | B2 | 10/2015 | Kok |
| D743,376 | S | 11/2015 | Kim |
| D743,939 | S | 11/2015 | Seong |
| 9,196,261 | B2 | 11/2015 | Burnett |
| 9,197,974 | B1 | 11/2015 | Clark |
| 9,203,494 | B2 | 12/2015 | Tarighat Mehrabani |
| 9,215,327 | B2 | 12/2015 | Bathurst |
| 9,215,543 | B2 | 12/2015 | Sun |
| 9,226,062 | B2 | 12/2015 | Sun |
| 9,226,070 | B2 | 12/2015 | Hyun |
| 9,226,088 | B2 | 12/2015 | Pandey |
| 9,232,185 | B2 | 1/2016 | Graham |
| 9,237,391 | B2 | 1/2016 | Benesty |
| 9,247,367 | B2 | 1/2016 | Nobile |
| 9,253,567 | B2 | 2/2016 | Morcelli |
| 9,257,132 | B2 | 2/2016 | Gowreesunker |
| 9,264,553 | B2 | 2/2016 | Pandey |
| 9,264,805 | B2 | 2/2016 | Buck |
| 9,280,985 | B2 | 3/2016 | Tawada |
| 9,286,908 | B2 | 3/2016 | Zhang |
| 9,294,839 | B2 | 3/2016 | Lambert |
| 9,301,049 | B2 | 3/2016 | Elko |
| D754,103 | S | 4/2016 | Fischer |
| 9,307,326 | B2 | 4/2016 | Elko |
| 9,319,532 | B2 | 4/2016 | Bao |
| 9,319,799 | B2 | 4/2016 | Salmon |
| 9,326,060 | B2 | 4/2016 | Nicholson |
| D756,502 | S | 5/2016 | Lee |
| 9,330,673 | B2 | 5/2016 | Cho |
| 9,338,301 | B2 | 5/2016 | Pocino |
| 9,338,549 | B2 | 5/2016 | Haulick |
| 9,354,310 | B2 | 5/2016 | Visser |
| 9,357,080 | B2 | 5/2016 | Beaucoup |
| 9,403,670 | B2 | 8/2016 | Schelling |
| 9,426,598 | B2 | 8/2016 | Walsh |
| D767,748 | S | 9/2016 | Nakai |
| 9,451,078 | B2 | 9/2016 | Yang |
| D769,239 | S | 10/2016 | Li |
| 9,462,378 | B2 | 10/2016 | Kuech |
| 9,473,868 | B2 | 10/2016 | Huang |
| 9,479,627 | B1 | 10/2016 | Rung |
| 9,479,885 | B1 | 10/2016 | Ivanov |
| 9,489,948 | B1 | 11/2016 | Chu |
| 9,510,090 | B2 | 11/2016 | Lissek |
| 9,514,723 | B2 | 12/2016 | Silfvast |
| 9,516,412 | B2 | 12/2016 | Shigenaga |
| 9,521,057 | B2 | 12/2016 | Klingbeil |
| 9,549,245 | B2 | 1/2017 | Frater |
| 9,560,446 | B1 | 1/2017 | Chang |
| 9,560,451 | B2 | 1/2017 | Eichfeld |
| 9,565,493 | B2 | 2/2017 | Abraham |
| 9,578,413 | B2 | 2/2017 | Sawa |
| 9,578,440 | B2 | 2/2017 | Otto |
| 9,589,556 | B2 | 3/2017 | Gao |
| 9,591,123 | B2 | 3/2017 | Sorensen |
| 9,591,404 | B1 | 3/2017 | Chhetri |
| D784,299 | S | 4/2017 | Cho |
| 9,615,173 | B2 | 4/2017 | Sako |
| 9,628,596 | B1 | 4/2017 | Bullough |
| 9,635,186 | B2 | 4/2017 | Pandey |
| 9,635,474 | B2 | 4/2017 | Kuster |
| D787,481 | S | 5/2017 | Tyss |
| D788,073 | S | 5/2017 | Silvera |
| 9,640,187 | B2 | 5/2017 | Niemisto |
| 9,641,688 | B2 | 5/2017 | Pandey |
| 9,641,929 | B2 | 5/2017 | Li |
| 9,641,935 | B1 | 5/2017 | Ivanov |
| 9,653,091 | B2 | 5/2017 | Matsuo |
| 9,653,092 | B2 | 5/2017 | Sun |
| 9,655,001 | B2 | 5/2017 | Metzger |
| 9,659,576 | B1 | 5/2017 | Kotvis |
| D789,323 | S | 6/2017 | Mackiewicz |
| 9,674,604 | B2 | 6/2017 | Deroo |
| 9,692,882 | B2 | 6/2017 | Mani |
| 9,706,057 | B2 | 7/2017 | Mani |
| 9,716,944 | B2 | 7/2017 | Yliaho |
| 9,721,582 | B1 | 8/2017 | Huang |
| 9,734,835 | B2 | 8/2017 | Fujieda |
| 9,754,572 | B2 | 9/2017 | Salazar |
| 9,761,243 | B2 | 9/2017 | Taenzer |
| D801,285 | S | 10/2017 | Timmins |
| 9,788,119 | B2 | 10/2017 | Vilermo |
| 9,813,806 | B2 | 11/2017 | Graham |
| 9,818,426 | B2 | 11/2017 | Kotera |
| 9,826,211 | B2 | 11/2017 | Sawa |
| 9,854,101 | B2 | 12/2017 | Pandey |
| 9,854,363 | B2 | 12/2017 | Sladeczek |
| 9,860,439 | B2 | 1/2018 | Sawa |
| 9,866,952 | B2 | 1/2018 | Pandey |
| D811,393 | S | 2/2018 | Ahn |
| 9,894,434 | B2 | 2/2018 | Rollow, IV |
| 9,930,448 | B1 | 3/2018 | Chen |
| 9,936,290 | B2 | 4/2018 | Mohammad |
| 9,966,059 | B1 | 5/2018 | Ayrapetian |
| 9,973,848 | B2 | 5/2018 | Chhetri |
| 9,980,042 | B1 | 5/2018 | Benattar |
| D819,607 | S | 6/2018 | Chui |
| D819,631 | S | 6/2018 | Matsumiya |
| 10,015,589 | B1 | 7/2018 | Ebenezer |
| 10,021,506 | B2 | 7/2018 | Johnson |
| 10,021,515 | B1 | 7/2018 | Mallya |
| 10,034,116 | B2 | 7/2018 | Kadri |
| 10,054,320 | B2 | 8/2018 | Choi |
| 10,061,009 | B1 | 8/2018 | Family |
| 10,062,379 | B2 | 8/2018 | Katuri |
| 10,153,744 | B1 | 12/2018 | Every |
| 10,165,386 | B2 | 12/2018 | Lehtiniemi |
| D841,589 | S | 2/2019 | Böhmer |
| 10,206,030 | B2 | 2/2019 | Matsumoto |
| 10,210,882 | B1 | 2/2019 | McCowan |
| 10,231,062 | B2 | 3/2019 | Pedersen |
| 10,244,121 | B2 | 3/2019 | Mani |
| 10,244,219 | B2 | 3/2019 | Sawa |
| 10,269,343 | B2 | 4/2019 | Wingate |
| 10,366,702 | B2 | 7/2019 | Morton |
| 10,367,948 | B2 | 7/2019 | Wells-Rutherford |
| D857,873 | S | 8/2019 | Shimada |
| 10,389,861 | B2 | 8/2019 | Mani |
| 10,389,885 | B2 | 8/2019 | Sun |
| D860,319 | S | 9/2019 | Beruto |
| D860,997 | S | 9/2019 | Jhun |
| D864,136 | S | 10/2019 | Kim |
| 10,440,469 | B2 | 10/2019 | Barnett |
| D865,723 | S | 11/2019 | Cho |
| 10,566,008 | B2 | 2/2020 | Thorpe |
| 10,602,267 | B2 | 3/2020 | Grosche |
| D883,952 | S | 5/2020 | Lucas |
| 10,650,797 | B2 | 5/2020 | Kumar |
| D888,020 | S | 6/2020 | Lyu |
| 10,728,653 | B2 | 7/2020 | Graham |
| D900,070 | S | 10/2020 | Lantz |
| D900,071 | S | 10/2020 | Lantz |
| D900,072 | S | 10/2020 | Lantz |
| D900,073 | S | 10/2020 | Lantz |
| D900,074 | S | 10/2020 | Lantz |
| 10,827,263 | B2 | 11/2020 | Christoph |
| 10,863,270 | B1 | 12/2020 | O'Neill |
| 10,930,297 | B2 | 2/2021 | Christoph |
| 10,959,018 | B1 | 3/2021 | Shi |
| 10,979,805 | B2 | 4/2021 | Chowdhary |
| D924,189 | S | 7/2021 | Park |
| 11,109,133 | B2 | 8/2021 | Lantz |

(56) References Cited

U.S. PATENT DOCUMENTS

| | | | |
|---|---|---|---|
| D940,116 | S | 1/2022 | Cho |
| 11,218,802 | B1 | 1/2022 | Kandadai |
| 2001/0031058 | A1 | 10/2001 | Anderson |
| 2002/0015500 | A1 | 2/2002 | Belt |
| 2002/0041679 | A1 | 4/2002 | Beaucoup |
| 2002/0048377 | A1 | 4/2002 | Vaudrey |
| 2002/0064158 | A1 | 5/2002 | Yokoyama |
| 2002/0064287 | A1 | 5/2002 | Kawamura |
| 2002/0069054 | A1 | 6/2002 | Arrowood |
| 2002/0110255 | A1 | 8/2002 | Killion |
| 2002/0126861 | A1 | 9/2002 | Colby |
| 2002/0131580 | A1 | 9/2002 | Smith |
| 2002/0140633 | A1 | 10/2002 | Rafii |
| 2002/0146282 | A1 | 10/2002 | Wilkes |
| 2002/0149070 | A1 | 10/2002 | Sheplak |
| 2002/0159603 | A1 | 10/2002 | Hirai |
| 2003/0026437 | A1 | 2/2003 | Janse |
| 2003/0053639 | A1 | 3/2003 | Beaucoup |
| 2003/0059061 | A1 | 3/2003 | Tsuji |
| 2003/0063762 | A1 | 4/2003 | Tajima |
| 2003/0063768 | A1 | 4/2003 | Cornelius |
| 2003/0072461 | A1 | 4/2003 | Moorer |
| 2003/0107478 | A1 | 6/2003 | Hendricks |
| 2003/0118200 | A1 | 6/2003 | Beaucoup |
| 2003/0122777 | A1 | 7/2003 | Grover |
| 2003/0138119 | A1 | 7/2003 | Pocino |
| 2003/0156725 | A1 | 8/2003 | Boone |
| 2003/0161485 | A1 | 8/2003 | Smith |
| 2003/0163326 | A1 | 8/2003 | Maase |
| 2003/0169888 | A1 | 9/2003 | Subotic |
| 2003/0185404 | A1 | 10/2003 | Milsap |
| 2003/0198339 | A1 | 10/2003 | Roy |
| 2003/0198359 | A1 | 10/2003 | Killion |
| 2003/0202107 | A1 | 10/2003 | Slattery |
| 2004/0013038 | A1 | 1/2004 | Kajala |
| 2004/0013252 | A1 | 1/2004 | Craner |
| 2004/0076305 | A1 | 4/2004 | Santiago |
| 2004/0105557 | A1 | 6/2004 | Matsuo |
| 2004/0125942 | A1 | 7/2004 | Beaucoup |
| 2004/0175006 | A1 | 9/2004 | Kim |
| 2004/0202345 | A1 | 10/2004 | Stenberg |
| 2004/0240664 | A1 | 12/2004 | Freed |
| 2005/0005494 | A1 | 1/2005 | Way |
| 2005/0041530 | A1 | 2/2005 | Goudie |
| 2005/0069156 | A1 | 3/2005 | Haapapuro |
| 2005/0094580 | A1 | 5/2005 | Kumar |
| 2005/0094795 | A1 | 5/2005 | Rambo |
| 2005/0149320 | A1 | 7/2005 | Kajala |
| 2005/0157897 | A1 | 7/2005 | Saltykov |
| 2005/0175189 | A1 | 8/2005 | Lee |
| 2005/0175190 | A1 | 8/2005 | Tashev |
| 2005/0213747 | A1 | 9/2005 | Popovich |
| 2005/0221867 | A1 | 10/2005 | Zurek |
| 2005/0238196 | A1 | 10/2005 | Furuno |
| 2005/0270906 | A1 | 12/2005 | Ramenzoni |
| 2005/0271221 | A1 | 12/2005 | Cerwin |
| 2005/0286698 | A1 | 12/2005 | Bathurst |
| 2005/0286729 | A1 | 12/2005 | Harwood |
| 2006/0083390 | A1 | 4/2006 | Kaderavek |
| 2006/0088173 | A1 | 4/2006 | Rodman |
| 2006/0093128 | A1 | 5/2006 | Oxford |
| 2006/0098403 | A1 | 5/2006 | Smith |
| 2006/0104458 | A1 | 5/2006 | Kenoyer |
| 2006/0109983 | A1 | 5/2006 | Young |
| 2006/0151256 | A1 | 7/2006 | Lee |
| 2006/0159293 | A1 | 7/2006 | Azima |
| 2006/0161430 | A1 | 7/2006 | Schweng |
| 2006/0165242 | A1 | 7/2006 | Miki |
| 2006/0192976 | A1 | 8/2006 | Hall |
| 2006/0198541 | A1 | 9/2006 | Henry |
| 2006/0204022 | A1 | 9/2006 | Hooley |
| 2006/0215866 | A1 | 9/2006 | Francisco |
| 2006/0222187 | A1 | 10/2006 | Jarrett |
| 2006/0233353 | A1 | 10/2006 | Beaucoup |
| 2006/0239471 | A1 | 10/2006 | Mao |
| 2006/0262942 | A1 | 11/2006 | Oxford |
| 2006/0269080 | A1 | 11/2006 | Oxford |
| 2006/0269086 | A1 | 11/2006 | Page |
| 2007/0006474 | A1 | 1/2007 | Taniguchi |
| 2007/0009116 | A1 | 1/2007 | Reining |
| 2007/0019828 | A1 | 1/2007 | Hughes |
| 2007/0053524 | A1 | 3/2007 | Haulick |
| 2007/0093714 | A1 | 4/2007 | Beaucoup |
| 2007/0116255 | A1 | 5/2007 | Derkx |
| 2007/0120029 | A1 | 5/2007 | Keung |
| 2007/0165871 | A1 | 7/2007 | Roovers |
| 2007/0230712 | A1 | 10/2007 | Belt |
| 2007/0253561 | A1 | 11/2007 | Williams |
| 2007/0269066 | A1 | 11/2007 | Derleth |
| 2008/0008339 | A1 | 1/2008 | Ryan |
| 2008/0033723 | A1 | 2/2008 | Jang |
| 2008/0046235 | A1 | 2/2008 | Chen |
| 2008/0056517 | A1 | 3/2008 | Algazi |
| 2008/0101622 | A1 | 5/2008 | Sugiyama |
| 2008/0130907 | A1 | 6/2008 | Sudo |
| 2008/0144848 | A1 | 6/2008 | Buck |
| 2008/0168283 | A1 | 7/2008 | Penning |
| 2008/0188965 | A1 | 8/2008 | Bruey |
| 2008/0212805 | A1 | 9/2008 | Fincham |
| 2008/0232607 | A1 | 9/2008 | Tashev |
| 2008/0247567 | A1 | 10/2008 | Kjolerbakken |
| 2008/0253553 | A1 | 10/2008 | Li |
| 2008/0253589 | A1 | 10/2008 | Trahms |
| 2008/0259731 | A1 | 10/2008 | Happonen |
| 2008/0260175 | A1 | 10/2008 | Elko |
| 2008/0279400 | A1 | 11/2008 | Knoll |
| 2008/0285772 | A1 | 11/2008 | Haulick |
| 2009/0003586 | A1 | 1/2009 | Lai |
| 2009/0030536 | A1 | 1/2009 | Gur |
| 2009/0052684 | A1 | 2/2009 | Ishibashi |
| 2009/0086998 | A1 | 4/2009 | Jeong |
| 2009/0087000 | A1 | 4/2009 | Ko |
| 2009/0087001 | A1 | 4/2009 | Jiang |
| 2009/0094817 | A1 | 4/2009 | Killion |
| 2009/0129609 | A1 | 5/2009 | Oh |
| 2009/0147967 | A1 | 6/2009 | Ishibashi |
| 2009/0150149 | A1 | 6/2009 | Cutter |
| 2009/0161880 | A1 | 6/2009 | Hooley |
| 2009/0169027 | A1 | 7/2009 | Ura |
| 2009/0173030 | A1 | 7/2009 | Gulbrandsen |
| 2009/0173570 | A1 | 7/2009 | Levit |
| 2009/0226004 | A1 | 9/2009 | Soerensen |
| 2009/0233545 | A1 | 9/2009 | Sutskover |
| 2009/0237561 | A1 | 9/2009 | Kobayashi |
| 2009/0254340 | A1 | 10/2009 | Sun |
| 2009/0274318 | A1 | 11/2009 | Ishibashi |
| 2009/0310794 | A1 | 12/2009 | Ishibashi |
| 2010/0011644 | A1 | 1/2010 | Kramer |
| 2010/0034397 | A1 | 2/2010 | Nakadai |
| 2010/0074433 | A1 | 3/2010 | Zhang |
| 2010/0111323 | A1 | 5/2010 | Marton |
| 2010/0111324 | A1 | 5/2010 | Yeldener |
| 2010/0119097 | A1 | 5/2010 | Ohtsuka |
| 2010/0123785 | A1 | 5/2010 | Chen |
| 2010/0128892 | A1 | 5/2010 | Chen |
| 2010/0128901 | A1 | 5/2010 | Herman |
| 2010/0131749 | A1 | 5/2010 | Kim |
| 2010/0142721 | A1 | 6/2010 | Wada |
| 2010/0150364 | A1 | 6/2010 | Buck |
| 2010/0158268 | A1 | 6/2010 | Marton |
| 2010/0165071 | A1 | 7/2010 | Ishibashi |
| 2010/0166219 | A1 | 7/2010 | Marton |
| 2010/0189275 | A1 | 7/2010 | Christoph |
| 2010/0189299 | A1 | 7/2010 | Grant |
| 2010/0202628 | A1 | 8/2010 | Meyer |
| 2010/0208605 | A1 | 8/2010 | Wang |
| 2010/0215184 | A1 | 8/2010 | Buck |
| 2010/0215189 | A1 | 8/2010 | Marton |
| 2010/0217590 | A1 | 8/2010 | Nemer |
| 2010/0245624 | A1 | 9/2010 | Beaucoup |
| 2010/0246873 | A1 | 9/2010 | Chen |
| 2010/0284185 | A1 | 11/2010 | Ngai |
| 2010/0305728 | A1 | 12/2010 | Aiso |
| 2010/0314513 | A1 | 12/2010 | Evans |

(56) References Cited

U.S. PATENT DOCUMENTS

| | | | |
|---|---|---|---|
| 2011/0002469 | A1 | 1/2011 | Ojala |
| 2011/0007921 | A1 | 1/2011 | Stewart |
| 2011/0033063 | A1 | 2/2011 | McGrath |
| 2011/0038229 | A1 | 2/2011 | Beaucoup |
| 2011/0096136 | A1 | 4/2011 | Liu |
| 2011/0096631 | A1 | 4/2011 | Kondo |
| 2011/0096915 | A1 | 4/2011 | Nemer |
| 2011/0164761 | A1 | 7/2011 | McCowan |
| 2011/0194719 | A1 | 8/2011 | Frater |
| 2011/0211706 | A1 | 9/2011 | Tanaka |
| 2011/0235821 | A1 | 9/2011 | Okita |
| 2011/0268287 | A1 | 11/2011 | Ishibashi |
| 2011/0311064 | A1 | 12/2011 | Teutsch |
| 2011/0311085 | A1 | 12/2011 | Stewart |
| 2011/0317862 | A1 | 12/2011 | Hosoe |
| 2012/0002835 | A1 | 1/2012 | Stewart |
| 2012/0014049 | A1 | 1/2012 | Ogle |
| 2012/0027227 | A1 | 2/2012 | Kok |
| 2012/0070015 | A1 | 3/2012 | Oh |
| 2012/0076316 | A1 | 3/2012 | Zhu |
| 2012/0080260 | A1 | 4/2012 | Stewart |
| 2012/0093344 | A1 | 4/2012 | Sun |
| 2012/0117474 | A1 | 5/2012 | Miki |
| 2012/0128160 | A1 | 5/2012 | Kim |
| 2012/0128175 | A1 | 5/2012 | Visser |
| 2012/0155688 | A1 | 6/2012 | Wilson |
| 2012/0155703 | A1 | 6/2012 | Hernandez-Abrego |
| 2012/0163625 | A1 | 6/2012 | Siotis |
| 2012/0169826 | A1 | 7/2012 | Jeong |
| 2012/0177219 | A1 | 7/2012 | Mullen |
| 2012/0182429 | A1 | 7/2012 | Forutanpour |
| 2012/0207335 | A1 | 8/2012 | Spaanderman |
| 2012/0224709 | A1 | 9/2012 | Keddem |
| 2012/0243698 | A1 | 9/2012 | Elko |
| 2012/0262536 | A1 | 10/2012 | Chen |
| 2012/0288079 | A1 | 11/2012 | Burnett |
| 2012/0288114 | A1 | 11/2012 | Duraiswami |
| 2012/0294472 | A1 | 11/2012 | Hudson |
| 2012/0327115 | A1 | 12/2012 | Chhetri |
| 2012/0328142 | A1 | 12/2012 | Horibe |
| 2013/0002797 | A1 | 1/2013 | Thapa |
| 2013/0004013 | A1 | 1/2013 | Stewart |
| 2013/0015014 | A1 | 1/2013 | Stewart |
| 2013/0016847 | A1 | 1/2013 | Steiner |
| 2013/0028451 | A1 | 1/2013 | De Roo |
| 2013/0029684 | A1 | 1/2013 | Kawaguchi |
| 2013/0034241 | A1 | 2/2013 | Pandey |
| 2013/0039504 | A1 | 2/2013 | Pandey |
| 2013/0083911 | A1 | 4/2013 | Bathurst |
| 2013/0094689 | A1 | 4/2013 | Tanaka |
| 2013/0101141 | A1 | 4/2013 | McElveen |
| 2013/0136274 | A1 | 5/2013 | Aehgren |
| 2013/0142343 | A1 | 6/2013 | Matsui |
| 2013/0147835 | A1 | 6/2013 | Lee |
| 2013/0156198 | A1 | 6/2013 | Kim |
| 2013/0182190 | A1 | 7/2013 | McCartney |
| 2013/0206501 | A1 | 8/2013 | Yu |
| 2013/0216066 | A1 | 8/2013 | Yerrace |
| 2013/0226593 | A1 | 8/2013 | Magnusson |
| 2013/0251181 | A1 | 9/2013 | Stewart |
| 2013/0264144 | A1 | 10/2013 | Hudson |
| 2013/0271559 | A1 | 10/2013 | Feng |
| 2013/0294616 | A1 | 11/2013 | Mulder |
| 2013/0297302 | A1 | 11/2013 | Pan |
| 2013/0304476 | A1 | 11/2013 | Kim |
| 2013/0304479 | A1 | 11/2013 | Teller |
| 2013/0329908 | A1 | 12/2013 | McLeod |
| 2013/0332156 | A1 | 12/2013 | Tackin |
| 2013/0336516 | A1 | 12/2013 | Stewart |
| 2013/0343549 | A1 | 12/2013 | Vemireddy |
| 2014/0003635 | A1 | 1/2014 | Mohammad |
| 2014/0010383 | A1 | 1/2014 | Mackey |
| 2014/0016794 | A1 | 1/2014 | Lu |
| 2014/0029761 | A1 | 1/2014 | Maenpaa |
| 2014/0037097 | A1 | 2/2014 | Labosco |
| 2014/0050332 | A1 | 2/2014 | Nielsen |
| 2014/0072151 | A1 | 3/2014 | Ochs |
| 2014/0098233 | A1 | 4/2014 | Martin |
| 2014/0098964 | A1 | 4/2014 | Rosca |
| 2014/0122060 | A1 | 5/2014 | Kaszczuk |
| 2014/0177857 | A1 | 6/2014 | Kuster |
| 2014/0233777 | A1 | 8/2014 | Tseng |
| 2014/0233778 | A1 | 8/2014 | Hardiman |
| 2014/0264654 | A1 | 9/2014 | Salmon |
| 2014/0265774 | A1 | 9/2014 | Stewart |
| 2014/0270271 | A1 | 9/2014 | Dehe |
| 2014/0286518 | A1 | 9/2014 | Stewart |
| 2014/0295768 | A1 | 10/2014 | Wu |
| 2014/0301586 | A1 | 10/2014 | Stewart |
| 2014/0307882 | A1 | 10/2014 | Leblanc |
| 2014/0314251 | A1 | 10/2014 | Rosca |
| 2014/0341392 | A1 | 11/2014 | Lambert |
| 2014/0357177 | A1 | 12/2014 | Stewart |
| 2014/0363008 | A1 | 12/2014 | Chen |
| 2015/0003638 | A1 | 1/2015 | Kasai |
| 2015/0025878 | A1 | 1/2015 | Gowreesunker |
| 2015/0030172 | A1 | 1/2015 | Gaensler |
| 2015/0033042 | A1 | 1/2015 | Iwamoto |
| 2015/0050967 | A1 | 2/2015 | Bao |
| 2015/0055796 | A1* | 2/2015 | Nugent ..... H04M 3/5125 381/92 |
| 2015/0055797 | A1 | 2/2015 | Nguyen |
| 2015/0063579 | A1 | 3/2015 | Bao |
| 2015/0070188 | A1 | 3/2015 | Aramburu |
| 2015/0078581 | A1 | 3/2015 | Etter |
| 2015/0078582 | A1 | 3/2015 | Graham |
| 2015/0097719 | A1 | 4/2015 | Balachandreswaran |
| 2015/0104023 | A1 | 4/2015 | Bilobrov |
| 2015/0117672 | A1 | 4/2015 | Christoph |
| 2015/0118960 | A1 | 4/2015 | Petit |
| 2015/0126255 | A1 | 5/2015 | Yang |
| 2015/0156578 | A1 | 6/2015 | Alexandridis |
| 2015/0163577 | A1 | 6/2015 | Benesty |
| 2015/0185825 | A1 | 7/2015 | Mullins |
| 2015/0189423 | A1 | 7/2015 | Giannuzzi |
| 2015/0208171 | A1 | 7/2015 | Funakoshi |
| 2015/0237424 | A1 | 8/2015 | Wilker |
| 2015/0281832 | A1 | 10/2015 | Kishimoto |
| 2015/0281833 | A1 | 10/2015 | Shigenaga |
| 2015/0281834 | A1 | 10/2015 | Takano |
| 2015/0312662 | A1 | 10/2015 | Kishimoto |
| 2015/0312691 | A1 | 10/2015 | Virolainen |
| 2015/0326968 | A1 | 11/2015 | Shigenaga |
| 2015/0341734 | A1 | 11/2015 | Sherman |
| 2015/0350621 | A1 | 12/2015 | Sawa |
| 2015/0358734 | A1 | 12/2015 | Butler |
| 2016/0011851 | A1 | 1/2016 | Zhang |
| 2016/0021478 | A1 | 1/2016 | Katagiri |
| 2016/0029120 | A1 | 1/2016 | Nesta |
| 2016/0031700 | A1 | 2/2016 | Sparks |
| 2016/0037277 | A1 | 2/2016 | Matsumoto |
| 2016/0055859 | A1 | 2/2016 | Finlow-Bates |
| 2016/0080867 | A1 | 3/2016 | Nugent |
| 2016/0088392 | A1 | 3/2016 | Huttunen |
| 2016/0100092 | A1 | 4/2016 | Bohac |
| 2016/0105473 | A1 | 4/2016 | Klingbeil |
| 2016/0111109 | A1 | 4/2016 | Tsujikawa |
| 2016/0127527 | A1 | 5/2016 | Mani |
| 2016/0134928 | A1 | 5/2016 | Ogle |
| 2016/0142548 | A1 | 5/2016 | Pandey |
| 2016/0142814 | A1 | 5/2016 | Deroo |
| 2016/0142815 | A1 | 5/2016 | Norris |
| 2016/0148057 | A1 | 5/2016 | Oh |
| 2016/0150315 | A1 | 5/2016 | Tzirkel-Hancock |
| 2016/0150316 | A1 | 5/2016 | Kubota |
| 2016/0155455 | A1 | 6/2016 | Ojanperä |
| 2016/0165340 | A1 | 6/2016 | Benattar |
| 2016/0173976 | A1 | 6/2016 | Podhradsky |
| 2016/0173978 | A1 | 6/2016 | Li |
| 2016/0189727 | A1 | 6/2016 | Wu |
| 2016/0192068 | A1 | 6/2016 | Ng |
| 2016/0196836 | A1 | 7/2016 | Yu |
| 2016/0234593 | A1 | 8/2016 | Matsumoto |
| 2016/0249132 | A1 | 8/2016 | Oliaei |

(56) References Cited

U.S. PATENT DOCUMENTS

| | | | |
|---|---|---|---|
| 2016/0275961 | A1 | 9/2016 | Yu |
| 2016/0295279 | A1 | 10/2016 | Srinivasan |
| 2016/0300584 | A1 | 10/2016 | Pandey |
| 2016/0302002 | A1 | 10/2016 | Lambert |
| 2016/0302006 | A1 | 10/2016 | Pandey |
| 2016/0323667 | A1 | 11/2016 | Shumard |
| 2016/0323668 | A1 | 11/2016 | Abraham |
| 2016/0330545 | A1 | 11/2016 | McElveen |
| 2016/0337523 | A1 | 11/2016 | Pandey |
| 2016/0353200 | A1 | 12/2016 | Bigeh |
| 2016/0357508 | A1 | 12/2016 | Moore |
| 2017/0019744 | A1 | 1/2017 | Matsumoto |
| 2017/0064451 | A1 | 3/2017 | Park |
| 2017/0105066 | A1 | 4/2017 | McLaughlin |
| 2017/0134849 | A1 | 5/2017 | Pandey |
| 2017/0134850 | A1 | 5/2017 | Graham |
| 2017/0164101 | A1 | 6/2017 | Rollow, IV |
| 2017/0180861 | A1 | 6/2017 | Chen |
| 2017/0206064 | A1 | 7/2017 | Breazeal |
| 2017/0230748 | A1 | 8/2017 | Shumard |
| 2017/0264999 | A1 | 9/2017 | Fukuda |
| 2017/0303887 | A1 | 10/2017 | Richmond |
| 2017/0308352 | A1 | 10/2017 | Kessler |
| 2017/0374454 | A1 | 12/2017 | Bernardini |
| 2018/0083848 | A1 | 3/2018 | Siddiqi |
| 2018/0102136 | A1 | 4/2018 | Ebenezer |
| 2018/0109873 | A1 | 4/2018 | Xiang |
| 2018/0115799 | A1 | 4/2018 | Thiele |
| 2018/0160224 | A1 | 6/2018 | Graham |
| 2018/0196585 | A1 | 7/2018 | Densham |
| 2018/0219922 | A1 | 8/2018 | Bryans |
| 2018/0227666 | A1 | 8/2018 | Barnett |
| 2018/0292079 | A1 | 10/2018 | Branham |
| 2018/0310096 | A1 | 10/2018 | Shumard |
| 2018/0313558 | A1 | 11/2018 | Byers |
| 2018/0338205 | A1 | 11/2018 | Abraham |
| 2018/0359565 | A1 | 12/2018 | Kim |
| 2019/0042187 | A1 | 2/2019 | Truong |
| 2019/0166424 | A1 | 5/2019 | Harney |
| 2019/0182607 | A1 | 6/2019 | Pedersen |
| 2019/0215540 | A1 | 7/2019 | Nicol |
| 2019/0230436 | A1 | 7/2019 | Tsingos |
| 2019/0259408 | A1 | 8/2019 | Freeman |
| 2019/0268683 | A1 | 8/2019 | Miyahara |
| 2019/0295540 | A1 | 9/2019 | Grima |
| 2019/0295569 | A1 | 9/2019 | Wang |
| 2019/0297422 | A1* | 9/2019 | Anderson ..... H04R 5/027 |
| 2019/0319677 | A1 | 10/2019 | Hansen |
| 2019/0371354 | A1 | 12/2019 | Lester |
| 2019/0373362 | A1 | 12/2019 | Ansai |
| 2019/0385629 | A1 | 12/2019 | Moravy |
| 2019/0387311 | A1 | 12/2019 | Schultz |
| 2020/0015021 | A1 | 1/2020 | Leppanen |
| 2020/0021910 | A1 | 1/2020 | Rollow, IV |
| 2020/0027472 | A1 | 1/2020 | Huang |
| 2020/0037068 | A1 | 1/2020 | Barnett |
| 2020/0068297 | A1 | 2/2020 | Rollow, IV |
| 2020/0100009 | A1 | 3/2020 | Lantz |
| 2020/0100025 | A1 | 3/2020 | Shumard |
| 2020/0107137 | A1 | 4/2020 | Koutrouli |
| 2020/0137485 | A1 | 4/2020 | Yamakawa |
| 2020/0145753 | A1 | 5/2020 | Rollow, IV |
| 2020/0152218 | A1 | 5/2020 | Kikuhara |
| 2020/0162618 | A1 | 5/2020 | Enteshari |
| 2020/0228663 | A1 | 7/2020 | Wells-Rutherford |
| 2020/0251119 | A1 | 8/2020 | Yang |
| 2020/0275204 | A1 | 8/2020 | Labosco |
| 2020/0278043 | A1 | 9/2020 | Cao |
| 2020/0288237 | A1 | 9/2020 | Abraham |
| 2021/0012789 | A1 | 1/2021 | Husain |
| 2021/0021940 | A1 | 1/2021 | Petersen |
| 2021/0044881 | A1 | 2/2021 | Lantz |
| 2021/0051397 | A1 | 2/2021 | Veselinovic |
| 2021/0098014 | A1 | 4/2021 | Tanaka |
| 2021/0098015 | A1 | 4/2021 | Pandey |
| 2021/0120335 | A1 | 4/2021 | Veselinovic |
| 2021/0200504 | A1 | 7/2021 | Park |
| 2021/0375298 | A1 | 12/2021 | Zhang |

FOREIGN PATENT DOCUMENTS

| | | | |
|---|---|---|---|
| CA | 2505496 | | 10/2006 |
| CA | 2838856 | | 12/2012 |
| CA | 2846323 | | 9/2014 |
| CN | 1780495 | | 5/2006 |
| CN | 101217830 | | 7/2008 |
| CN | 101833954 | | 9/2010 |
| CN | 101860776 | | 10/2010 |
| CN | 101894558 | | 11/2010 |
| CN | 102646418 | | 8/2012 |
| CN | 102821336 | | 12/2012 |
| CN | 102833664 | | 12/2012 |
| CN | 102860039 | | 1/2013 |
| CN | 104036784 | | 9/2014 |
| CN | 104053088 | | 9/2014 |
| CN | 104080289 | A1 | 10/2014 |
| CN | 104347076 | | 2/2015 |
| CN | 104581463 | | 4/2015 |
| CN | 105355210 | | 2/2016 |
| CN | 105548998 | | 5/2016 |
| CN | 106162427 | | 11/2016 |
| CN | 106251857 | | 12/2016 |
| CN | 106851036 | | 6/2017 |
| CN | 107221336 | | 9/2017 |
| CN | 107534725 | | 1/2018 |
| CN | 108172235 | | 6/2018 |
| CN | 109087664 | | 12/2018 |
| CN | 208190895 | | 12/2018 |
| CN | 109727604 | | 5/2019 |
| CN | 110010147 | | 7/2019 |
| CN | 306391029 | | 3/2021 |
| DE | 2941485 | | 4/1981 |
| EM | 0077546430001 | | 3/2020 |
| EP | 0381498 | | 8/1990 |
| EP | 0594098 | | 4/1994 |
| EP | 0869697 | | 10/1998 |
| EP | 1180914 | | 2/2002 |
| EP | 1184676 | | 3/2002 |
| EP | 0944228 | | 6/2003 |
| EP | 1439526 | | 7/2004 |
| EP | 1651001 | | 4/2006 |
| EP | 1727344 | | 11/2006 |
| EP | 1906707 | | 4/2008 |
| EP | 1952393 | | 8/2008 |
| EP | 1962547 | | 8/2008 |
| EP | 2133867 | | 12/2009 |
| EP | 2159789 | | 3/2010 |
| EP | 2197219 | | 6/2010 |
| EP | 2360940 | | 8/2011 |
| EP | 2710788 | | 3/2014 |
| EP | 2721837 | | 4/2014 |
| EP | 2772910 | | 9/2014 |
| EP | 2778310 | | 9/2014 |
| EP | 2942975 | | 11/2015 |
| EP | 2988527 | | 2/2016 |
| EP | 3035556 | | 6/2016 |
| EP | 3131311 | | 2/2017 |
| GB | 2393601 | | 3/2004 |
| GB | 2446620 | | 8/2008 |
| JP | S63144699 | | 6/1988 |
| JP | H101260967 | | 10/1989 |
| JP | H10241099 | | 2/1990 |
| JP | H105260589 | | 10/1993 |
| JP | H107336790 | | 12/1995 |
| JP | 2518823 | | 7/1996 |
| JP | 3175622 | | 6/2001 |
| JP | 2003060530 | | 2/2003 |
| JP | 2003087890 | | 3/2003 |
| JP | 2004349806 | | 12/2004 |
| JP | 2004537232 | | 12/2004 |
| JP | 2005323084 | | 11/2005 |
| JP | 2006094389 | | 4/2006 |
| JP | 2006101499 | | 4/2006 |
| JP | 4120646 | | 8/2006 |

(56) References Cited

FOREIGN PATENT DOCUMENTS

| | | |
|---|---|---|
| JP | 4258472 | 8/2006 |
| JP | 4196956 | 9/2006 |
| JP | 2006340151 | 12/2006 |
| JP | 4760160 | 1/2007 |
| JP | 4752403 | 3/2007 |
| JP | 2007089058 | 4/2007 |
| JP | 4867579 | 6/2007 |
| JP | 2007208503 | 8/2007 |
| JP | 2007228069 | 9/2007 |
| JP | 2007228070 | 9/2007 |
| JP | 2007274131 | 10/2007 |
| JP | 2007274463 | 10/2007 |
| JP | 2007288679 | 11/2007 |
| JP | 2008005347 | 1/2008 |
| JP | 2008042754 | 2/2008 |
| JP | 2008154056 | 7/2008 |
| JP | 2008259022 | 10/2008 |
| JP | 2008263336 | 10/2008 |
| JP | 2008312002 | 12/2008 |
| JP | 2009206671 | 9/2009 |
| JP | 2010028653 | 2/2010 |
| JP | 2010114554 | 5/2010 |
| JP | 2010268129 | 11/2010 |
| JP | 2011015018 | 1/2011 |
| JP | 4779748 | 9/2011 |
| JP | 2012165189 | 8/2012 |
| JP | 5028944 | 9/2012 |
| JP | 5139111 | 2/2013 |
| JP | 5306565 | 10/2013 |
| JP | 5685173 | 3/2015 |
| JP | 2016051038 | 4/2016 |
| KR | 100298300 | 5/2001 |
| KR | 100901464 | 6/2009 |
| KR | 100960781 | 6/2010 |
| KR | 1020130033723 | 4/2013 |
| KR | 300856915 | 5/2016 |
| TW | 201331932 | 8/2013 |
| TW | I484478 | 5/2015 |
| WO | 1997008896 | 3/1997 |
| WO | 1998047291 | 10/1998 |
| WO | 2000030402 | 5/2000 |
| WO | 2003073786 | 9/2003 |
| WO | 2003088429 | 10/2003 |
| WO | 2004027754 | 4/2004 |
| WO | 2004090865 | 10/2004 |
| WO | 2006049260 | 5/2006 |
| WO | 2006071119 | 7/2006 |
| WO | 2006114015 | 11/2006 |
| WO | 2006121896 | 11/2006 |
| WO | 2007045971 | 4/2007 |
| WO | 2008074249 | 6/2008 |
| WO | 2008125523 | 10/2008 |
| WO | 2009039783 | 4/2009 |
| WO | 2009109069 | 9/2009 |
| WO | 2010001508 | 1/2010 |
| WO | 2010091999 | 8/2010 |
| WO | 2010140084 | 12/2010 |
| WO | 2010144148 | 12/2010 |
| WO | 2011104501 | 9/2011 |
| WO | 2012122132 | 9/2012 |
| WO | 2012140435 | 10/2012 |
| WO | 2012160459 | 11/2012 |
| WO | 2012174159 | 12/2012 |
| WO | 2013016986 | 2/2013 |
| WO | 2013182118 | 12/2013 |
| WO | 2014156292 | 10/2014 |
| WO | 2016176429 | 11/2016 |
| WO | 2016179211 | 11/2016 |
| WO | 2017208022 | 12/2017 |
| WO | 2018140444 | 8/2018 |
| WO | 2018140618 | 8/2018 |
| WO | 2018211806 | 11/2018 |
| WO | 2019231630 | 12/2019 |
| WO | 2020168873 | 8/2020 |
| WO | 2020191354 | 9/2020 |
| WO | 211843001 | 11/2020 |

OTHER PUBLICATIONS

Tandon, et al., "An Efficient, Low-Complexity, Normalized LMS Algorithm for Echo Cancellation," 2nd Annual IEEE Northeast Workshop on Circuits and Systems, Jun. 2004, pp. 161-164.

Tetelbaum et al., Design and Implementation of a Conference Phone Based on Microphone Array Technology, Proc. Global Signal Processing Conference and Expo (GSPx), Sep. 2004, 6 pgs.

Tiete et al., SoundCompass: A Distributed MEMS Microphone Array-Based Sensor for Sound Source Localization, Sensors, Jan. 23, 2014, pp. 1918-1949.

TOA Corp., Ceiling Mount Microphone AN-9001 Operating Instructions, http://www.toaelectronics.com/media/an9001_mt1e.pdf, 1 pg.

Togami, et al., "Subband Beamformer Combined with Time-Frequency ICA for Extraction of Target Source Under Reverberant Environments," 17th European Signal Processing Conference, Aug. 2009, 5 pp.

U.S. Appl. No. 16/598,918, filed Oct. 10, 2019, 50 pp.

Van Compernolle, Switching Adaptive Filters for Enhancing Noisy and Reverberant Speech from Microphone Array Recordings, Proc. IEEE Int. Conf. on Acoustics, Speech, and Signal Processing, Apr. 1990, pp. 833-836.

Van Trees, Optimum Array Processing: Part IV of Detection, Estimation, and Modulation Theory, 2002, 54 pgs., pp. i-xxv, 90-95, 201-230.

Van Veen et al., Beamforming: A Versatile Approach to Spatial Filtering, IEEE ASSP Magazine, vol. 5, issue 2, Apr. 1988, pp. 4-24.

Vicente, "Adaptive Array Signal Processing Using the Concentric Ring Array and the Spherical Array," Ph.D. Dissertation, University of Missouri, May 2009, 226 pp.

Wang et al., Combining Superdirective Beamforming and Frequency-Domain Blind Source Separation for Highly Reverberant Signals, EURASIP Journal on Audio, Speech, and Music Processing, vol. 2010, pp. 1-13.

Warsitz, et al., "Blind Acoustic Beamforming Based on Generalized Eigenvalue Decomposition," IEEE Transactions on Audio, Speech and Language Processing, vol. 15, No. 5, 2007, 11 pp.

Weinstein, et al., "LOUD: A 1020-Node Microphone Array and Acoustic Beamformer," 14th International Congress on Sound & Vibration, Jul. 2007, 8 pgs.

Weinstein, et al., "LOUD: A 1020-Node Modular Microphone Array and Beamformer for Intelligent Computing Spaces," MIT Computer Science and Artifical Intelligence Laboratory, 2004, 18 pp.

Wung, "A System Approach to Multi-Channel Acoustic Echo Cancellation and Residual Echo Suppression for Robust Hands-Free Teleconferencing," Georgia Institute of Technology, May 2015, 167 pp.

XAP Audio Conferencing Brochure, ClearOne Communications, Inc., 2002.

Yamaha Corp., MRX7-D Signal Processor Product Specifications, 2016, 12 pgs.

Yamaha Corp., PJP-100H IP Audio Conference System Owner's Manual, Sep. 2006, 59 pgs.

Yamaha Corp., PJP-EC200 Conference Echo Canceller Brochure, Oct. 2009, 2 pgs.

Yan et al., Convex Optimization Based Time-Domain Broadband Beamforming with Sidelobe Control, Journal of the Acoustical Society of America, vol. 121, No. 1, Jan. 2007, pp. 46-49.

Yensen et al., Synthetic Stereo Acoustic Echo Cancellation Structure with Microphone Array Beamforming for VOIP Conferences, 2000 IEEE International Conference on Acoustics, Speech, and Signal Processing, Jun. 2000, pp. 817-820.

Yermeche, et al., "Real-Time DSP Implementation of a Subband Beamforming Algorithm for Dual Microphone Speech Enhancement," 2007 IEEE International Symposium on Circuits and Systems, 4 pp.

(56) References Cited

OTHER PUBLICATIONS

Zavarehei, et al., "Interpolation of Lost Speech Segments Using LP-HNM Model with Codebook Post-Processing," IEEE Transactions on Multimedia, vol. 10, No. 3, Apr. 2008, 10 pp.
Zhang, et al., "F-T-LSTM based Complex Network for Joint Acoustic Echo Cancellation and Speech Enhancement," Audio, Speech and Language Processing Group, Jun. 2021, 5 pp.
Zhang, et al., "Multichannel Acoustic Echo Cancelation in Multiparty Spatial Audio Conferencing with Constrained Kalman Filtering," 11th International Workshop on Acoustic Echo and Noise Control, Sep. 14, 2008, 4 pp.
Zhang, et al., "Selective Frequency Invariant Uniform Circular Broadband Beamformer," EURASIP Journal on Advances in Signal Processing, vol. 2010, pp. 1-11.
Zheng, et al., "Experimental Evaluation of a Nested Microphone Array With Adaptive Noise Cancellers," IEEE Transactions on Instrumentation and Measurement, vol. 53, No. 3, Jun. 2004, 10 pp.
Double Condenser Microphone SM 69, Datasheet, Georg Neumann GmbH, available at <https://ende.neumann.com/product_files/7453/download>, 8 pp.
Eargle, "The Microphone Handbook," Elar Publ. Co., 1st ed., 1981, 4 pp.
Enright, Notes From Logan, June edition of Scanlines, Jun. 2009, 9 pp.
Fan, et al., "Localization Estimation of Sound Source by Microphones Array," Procedia Engineering 7, 2010, pp. 312-317.
Firoozabadi, et al., "Combination of Nested Microphone Array and Subband Processing for Multiple Simultaneous Speaker Localization," 6th International Symposium on Telecommunications, Nov. 2012, pp. 907-912.
Flanagan et al., Autodirective Microphone Systems, Acustica, vol. 73, 1991, pp. 58-71.
Flanagan, et al., "Computer-Steered Microphone Arrays for Sound Transduction in Large Rooms," J. Acoust. Soc. Am. 78 (5), Nov. 1985, pp. 1508-1518.
Fohhn Audio New Generation of Beam Steering Systems Available Now, audioXpress Staff, May 10, 2017, 8 pp.
Fox, et al., "A Subband Hybrid Beamforming for In-Car Speech Enhancement," 20th European Signal rocessing Conference, Aug. 2012, 5 pp.
Frost, III, An Algorithm for Linearly Constrained Adaptive Array Processing, Proc. IEEE, vol. 60, No. 8, Aug. 1972, pp. 926-935.
Gannot et al., Signal Enhancement using Beamforming and Nonstationarity with Applications to Speech, IEEE Trans. On Signal Processing, vol. 49, No. 8, Aug. 2001, pp. 1614-1626.
Gansler et al., A Double-Talk Detector Based on Coherence, IEEE Transactions on Communications, vol. 44, No. 11, Nov. 1996, pp. 1421-1427.
Gazor et al., Robust Adaptive Beamforming via Target Tracking, IEEE Transactions on Signal Processing, vol. 44, No. 6, Jun. 1996, pp. 1589-1593.
Gazor et al., Wideband Multi-Source Beamforming with Adaptive Array Location Calibration and Direction Finding, 1995 International Conference on Acoustics, Speech, and Signal Processing, May 1995, pp. 1904-1907.
Gentner Communications Corp., AP400 Audio Perfect 400 Audioconferencing System Installation & Operation Manual, Nov. 1998, 80 pgs.
Gentner Communications Corp., XAP 800 Audio Conferencing System Installation & Operation Manual, Oct. 2001, 152 pgs.
Gil-Cacho et al., Multi-Microphone Acoustic Echo Cancellation Using Multi-Channel Warped Linear Prediction of Common Acoustical Poles, 18th European Signal Processing Conference, Aug. 2010, pp. 2121-2125.
Giuliani, et al., "Use of Different Microphone Array Configurations for Hands-Free Speech Recognition in Noisy and Reverberant Environment," IRST—Istituto per la Ricerca Scientifica e Tecnologica, Sep. 22, 1997, 4 pp.
Gritton et al., Echo Cancellation Algorithms, IEEE ASSP Magazine, vol. 1, issue 2, Apr. 1984, pp. 30-38.
Hald, et al., "A class of optimal broadband phased array geometries designed for easy construction," 2002 Int'l Congress & Expo. on Noise Control Engineering, Aug. 2002, 6 pp.
Hamalainen, et al., "Acoustic Echo Cancellation for Dynamically Steered Microphone Array Systems," 2007 IEEE Workshop on Applications of Signal Processing to Audio and Acoustics, Oct. 2007, pp. 58-61.
Hayo, Virtual Controls for Real Life, Web page downloaded from https://hayo.io/ on Sep. 18, 2019, 19 pp.
Herbordt et al., A Real-time Acoustic Human-Machine Front-End for Multimedia Applications Integrating Robust Adaptive Beamforming and Stereophonic Acoustic Echo Cancellation, 7th International Conference on Spoken Language Processing, Sep. 2002, 4 pgs.
Herbordt et al., GSAEC—Acoustic Echo Cancellation embedded into the Generalized Sidelobe Canceller, 10th European Signal Processing Conference, Sep. 2000, 5 pgs.
Herbordt et al., Multichannel Bin-Wise Robust Frequency-Domain Adaptive Filtering and Its Application to Adaptive Beamforming, IEEE Transactions on Audio, Speech, and Language Processing, vol. 15, No. 4, May 2007, pp. 1340-1351.
Herbordt, "Combination of Robust Adaptive Beamforming with Acoustic Echo Cancellation for Acoustic Human/Machine Interfaces," Friedrich-Alexander University, 2003, 293 pgs.
Herbordt, et al., Joint Optimization of LCMV Beamforming and Acoustic Echo Cancellation for Automatic Speech Recognition, IEEE International Conference on Acoustics, Speech, and Signal Processing, Mar. 2005, pp. III-77-III-80.
Holm, "Optimizing Microphone Arrays for use in Conference Halls," Norwegian University of Science and Technology, Jun. 2009, 101 pp.
Huang et al., Immersive Audio Schemes: The Evolution of Multiparty Teleconferencing, IEEE Signal Processing Magazine, Jan. 2011, pp. 20-32.
ICONYX Gen5, Product Overview; Renkus-Heinz, Dec. 24, 2018, 2 pp.
International Search Report and Written Opinion for PCT/US2016/022773 dated Jun. 10, 2016.
International Search Report and Written Opinion for PCT/US2016/029751 dated Nov. 28, 2016, 21 pp.
International Search Report and Written Opinion for PCT/US2018/013155 dated Jun. 8, 2018.
International Search Report and Written Opinion for PCT/US2018/015269 dated Mar. 26, 2018, 12 pp.
International Search Report and Written Opinion for PCT/US2019/031833 dated Jul. 24, 2019, 16 pp.
International Search Report and Written Opinion for PCT/US2019/033470 dated Jul. 31, 2019, 12 pp.
International Search Report and Written Opinion for PCT/US2019/034692 dated Sep. 10, 2019, 11 pp.
International Search Report and Written Opinion for PCT/US2019/051491 dated Dec. 10, 2019, 13 pp.
International Search Report and Written Opinion for PCT/US2019/051989 dated Jan. 10, 2020, 15 pp.
International Search Report and Written Opinion for PCT/US2020/024063 dated Aug. 31, 2020, 18 pp.
International Search Report and Written Opinion for PCT/US2020/035185 dated Sep. 15, 2020, 11 pp.
International Search Report and Written Opinion for PCT/US2020/058385 dated Mar. 31, 2021, 20 pp.
International Search Report and Written Opinion for PCT/US2021/070625 dated Sep. 17, 2021, 17 pp.
International Search Report and Written Opinion for PCT/US2022/014061 dated May 10, 2022, 14 pp.
International Search Report for PCT/US2020/024005 dated Jun. 12, 2020, 12 pp.
InvenSense, "Microphone Array Beamforming," Application Note AN-1140, Dec. 31, 2013, 12 pp.
Invensense, Recommendations for Mounting and Connecting InvenSense MEMS Microphones, Application Note AN-1003, 2013, 11 pp.
Ishii et al., Investigation on Sound Localization using Multiple Microphone Arrays, Reflection and Spatial Information, Japanese

(56) References Cited

OTHER PUBLICATIONS

Society for Artificial Intelligence, JSAI Technical Report, SIG-Challenge-B202-11, 2012, pp. 64-69.
Ito et al., Aerodynamic/Aeroacoustic Testing in Anechoic Closed Test Sections of Low-speed Wind Tunnels, 16th AIAA/CEAS Aeroacoustics Conference, 2010, 11 pgs.
Johansson et al., Robust Acoustic Direction of Arrival Estimation using Root-SRP-PHAT, a Realtime Implementation, IEEE International Conference on Acoustics, Speech, and Signal Processing, Mar. 2005, 4 pgs.
Johansson, et al., Speaker Localisation using the Far-Field SRP-PHAT in Conference Telephony, 2002 International Symposium on Intelligent Signal Processing and Communication Systems, 5 pgs.
Johnson, et al., "Array Signal Processing: Concepts and Techniques," p. 59, Prentice Hall, 1993, 3 pp.
Julstrom et al., Direction-Sensitive Gating: A New Approach to Automatic Mixing, J. Audio Eng. Soc., vol. 32, No. 7/8, Jul./Aug. 1984, pp. 490-506.
Kahrs, Ed., The Past, Present, and Future of Audio Signal Processing, IEEE Signal Processing Magazine, Sep. 1997, pp. 30-57.
Kallinger et al., Multi-Microphone Residual Echo Estimation, 2003 IEEE International Conference on Acoustics, Speech, and Signal Processing, Apr. 2003, 4 pgs.
Kammeyer, et al., New Aspects of Combining Echo Cancellers with Beamformers, IEEE International Conference on Acoustics, Speech, and Signal Processing, Mar. 2005, pp. III-137-III-140.
Kellermann, A Self-Steering Digital Microphone Array, 1991 International Conference on Acoustics, Speech, and Signal Processing, Apr. 1991, pp. 3581-3584.
Kellermann, Acoustic Echo Cancellation for Beamforming Microphone Arrays, in Brandstein, ed., Microphone Arrays: Techniques and Applications, 2001, Springer-Verlag Berlin Heidelberg, pp. 281-306.
Kellermann, Integrating Acoustic Echo Cancellation with Adaptive Beamforming Microphone Arrays, Forum Acusticum, Berlin, Mar. 1999, pp. 1-4.
Kellermann, Strategies for Combining Acoustic Echo Cancellation and Adaptive Beamforming Microphone Arrays, 1997 IEEE International Conference on Acoustics, Speech, and Signal Processing, Apr. 1997, 4 pgs.
Klegon, "Achieve Invisible Audio with the MXA910 Ceiling Array Microphone," Jun. 27, 2016, 10 pp.
Knapp, et al., The Generalized Correlation Method for Estimation of Time Delay, IEEE Transactions on Acoustics, Speech, and Signal Processing, vol. ASSP-24, No. 4, Aug. 1976, pp. 320-327.
Kobayashi et al., A Hands-Free Unit with Noise Reduction by Using Adaptive Beamformer, IEEE Transactions on Consumer Electronics, vol. 54, No. 1, Feb. 2008, pp. 116-122.
Kobayashi et al., A Microphone Array System with Echo Canceller, Electronics and Communications in Japan, Part 3, vol. 89, No. 10, Feb. 2, 2006, pp. 23-32.
Kolundžija, et al., "Baffled circular loudspeaker array with broadband high directivity," 2010 IEEE International Conference on Acoustics, Speech and Signal Processing, Dallas, TX, 2010, pp. 73-76.
Lai, et al., "Design of Robust Steerable Broadband Beamformers with Spiral Arrays and the Farrow Filter Structure," Proc. Intl. Workshop Acoustic Echo Noise Control, 2010, 4 pp.
Lebret, et al., Antenna Array Pattern Synthesis via Convex Cptimization, IEEE Trans. on Signal Processing, vol. 45, No. 3, Mar. 1997, pp. 526-532.
LecNet2 Sound System Design Guide, Lectrosonics, Jun. 2, 2006. 28 pages.
Lectrosonics, LecNet2 Sound System Design Guide, Jun. 2006, 28 pgs.
Lee et al., Multichannel Teleconferencing System with Multispatial Region Acoustic Echo Cancellation, International Workshop on Acoustic Echo and Noise Control (IWAENC2003), Sep. 2003, pp. 51-54.
Li, "Broadband Beamforming and Direction Finding Using Concentric Ring Array," Ph.D. Dissertation, University of Missouri-Columbia, Jul. 2005, 163 pp.
Lindstrom et al., An Improvement of the Two-Path Algorithm Transfer Logic for Acoustic Echo Cancellation, IEEE Transactions on Audio, Speech, and Language Processing, vol. 15, No. 4, May 2007, pp. 1320-1326.
Liu et al., Adaptive Beamforming with Sidelobe Control: A Second-Order Cone Programming Approach, IEEE Signal Proc. Letters, vol. 10, No. 11, Nov. 2003, pp. 331-334.
Liu, et al., "Frequency Invariant Beamforming in Subbands," IEEE Conference on Signals, Systems and Computers, 2004, 5 pp.
Liu, et al., "Wideband Beamforming," Wiley Series on Wireless Communications and Mobile Computing, pp. 143-198, 2010, 297 pp.
Lobo, et al., Applications of Second-Order Cone Programming, Linear Algebra and its Applications 284, 1998, pp. 193-228.
Luo et al., Wideband Beamforming with Broad Nulls of Nested Array, Third Int'l Conf. on Info. Science and Tech., Mar. 23-25, 2013, pp. 1645-1648.
Marquardt et al., A Natural Acoustic Front-End for Interactive TV in the EU-Project DICIT, IEEE Pacific Rim Conference on Communications, Computers and Signal Processing, Aug. 2009, pp. 894-899.
Martin, Small Microphone Arrays with Postfilters for Noise and Acoustic Echo Reduction, in Brandstein, ed., Microphone Arrays: Techniques and Applications, 2001, Springer-Verlag Berlin Heidelberg, pp. 255-279.
Maruo et al., On the Optimal Solutions of Beamformer Assisted Acoustic Echo Cancellers, IEEE Statistical Signal Processing Workshop, 2011, pp. 641-644.
McCowan, Microphone Arrays: A Tutorial, Apr. 2001, 36 pgs.
MFLCRFG Datasheet, Metal_Fab Inc., Sep. 7, 2007, 1 p.
Microphone Array Primer, Shure Question and Answer Page, <https://service.shure.com/s/article/microphone-array-primer?language=en_US>, Jan. 2019, 5 pp.
Milanovic, et al., "Design and Realization of FPGA Platform for Real Time Acoustic Signal Acquisition and Data Processing" 22nd Telecommunications Forum TELFOR, 2014, 6 pp.
Mohammed, A New Adaptive Beamformer for Optimal Acoustic Echo and Noise Cancellation with Less Computational Load, Canadian Conference on Electrical and Computer Engineering, May 2008, pp. 000123-000128.
Mohammed, A New Robust Adaptive Beamformer for Enhancing Speech Corrupted with Colored Noise, AICCSA, Apr. 2008, pp. 508-515.
Mohammed, Real-time Implementation of an efficient RLS Algorithm based on IIR Filter for Acoustic Echo Cancellation, AICCSA, Apr. 2008, pp. 489-494.
Mohan, et al., "Localization of multiple acoustic sources with small arrays using a coherence test," Journal Acoustic Soc Am., 123(4), Apr. 2008, 12 pp.
Moulines, et al., "Pitch-Synchronous Waveform Processing Techniques for Text-to-Speech Synthesis Using Diphones," Speech Communication 9, 1990, 15 pp.
Multichannel Acoustic Echo Cancellation, Obtained from website http://www.buchner-net.com/mcaec.html, Jun. 2011.
Myllyla et al., Adaptive Beamforming Methods for Dynamically Steered Microphone Array Systems, 2008 IEEE International Conference on Acoustics, Speech and Signal Processing, Mar.-Apr. 2008, pp. 305-308.
New Shure Microflex Advance MXA910 Microphone With Intellimix Audio Processing Provides Greater Simplicity, Flexibility, Clarity, Press Release, Jun. 12, 2019, 4 pp.
Nguyen-Ky, et al., "An Improved Error Estimation Algorithm for Stereophonic Acoustic Echo Cancellation Systems," 1st International Conference on Signal Processing and Communication Systems, Dec. 17-19, 2007, 5 pp.
Office Action for Taiwan Patent Application No. 105109900 dated May 5, 2017.
Office Action issued for Japanese Patent Application No. 2015-023781 dated Jun. 20, 2016, 4 pp.

(56) References Cited

OTHER PUBLICATIONS

Oh, et al., "Hands-Free Voice Communication in an Automobile With a Microphone Array," 1992 IEEE International Conference on Acoustics, Speech, and Signal Processing, Mar. 1992, pp. I-281-I-284.
Olszewski, et al., "Steerable Highly Directional Audio Beam Loudspeaker," Interspeech 2005, 4 pp.
Omologo, Multi-Microphone Signal Processing for Distant-Speech Interaction, Human Activity and Vision Summer School (HAVSS), INRIA Sophia Antipolis, Oct. 3, 2012, 79 pgs.
Order, Conduct of the Proceeding, *Clearone, Inc.* v. *Shure Acquisition Holdings, Inc.*, Nov. 2, 2020, 10 pp.
Pados et al., An Iterative Algorithm for the Computation of the MVDR Filter, IEEE Trans. On Signal Processing, vol. 49, No. 2, Feb. 2001, pp. 290-300.
Palladino, "This App Lets You Control Your Smarthome Lights via Augmented Reality," Next Reality Mobile AR News, Jul. 2, 2018, 5 pp.
Parikh, et al., "Methods for Mitigating IP Network Packet Loss in Real Time Audio Streaming Applications," GatesAir, 2014, 6 pp.
Pasha, et al., "Clustered Multi-channel Dereverberation for Ad-hoc Microphone Arrays," Proceedings of APSIPA Annual Summit and Conference, Dec. 2015, pp. 274-278.
Petitioner's Motion for Sanctions, *Clearone, Inc.* v. *Shure Acquisition Holdings, Inc.*, Aug. 24, 2020, 20 pp.
Pettersen, "Broadcast Applications for Voice-Activated Microphones," db, Jul./Aug. 1985, 6 pgs.
Pfeifenberger, et al., "Nonlinear Residual Echo Suppression using a Recurrent Neural Network," Interspeech 2020, 5 pp.
Phoenix Audio Technologies, "Beamforming and Microphone Arrays—Common Myths", Apr. 2016, http://info.phnxaudio.com/blog/microphone-arrays-beamforming-myths-1, 19 pp.
Plascore, PCGA-XR1 3003 Aluminum Honeycomb Data Sheet, 2008, 2 pgs.
Polycom Inc., Vortex EF2211/EF2210 Reference Manual, 2003, 66 pgs.
Polycom, Inc., Polycom SoundStructure C16, C12, C8, and SR12 Design Guide, Nov. 2013, 743 pgs.
Polycom, Inc., Setting Up the Polycom HDX Ceiling Microphone Array Series, https://support.polycom.com/content/dam/polycom-support/products/Telepresence-and-Video/HDX%20Series/setup-maintenance/en/hdx_ceiling_microphone_array_setting_up.pdf, 2010, 16 pgs.
Polycom, Inc., Vortex EF2241 Reference Manual, 2002, 68 pgs.
Polycom, Inc., Vortex EF2280 Reference Manual, 2001, 60 pp.
Pomona, Model 3306, Datasheet, Jun. 9, 1999, 1 p.
Powers, et al., "Proving Adaptive Directional Technology Works: A Review of Studies," The Hearing Review, Apr. 6, 2004, 5 pp.
Prime, et al., "Beamforming Array Optimisation Averaged Sound Source Mapping on a Model Wind Turbine," ResearchGate, Nov. 2014, 10 pp.
Rabinkin et al., Estimation of Wavefront Arrival Delay Using the Cross-Power Spectrum Phase Technique, 132nd Meeting of the Acoustical Society of America, Dec. 1996, pp. 1-10.
Rane Corp., Halogen Acoustic Echo Cancellation Guide, AEC Guide Version 2, Nov. 2013, 16 pgs.
Rao, et al., "Fast LMS/Newton Algorithms for Stereophonic Acoustic Echo Cancelation," IEEE Transactions on Signal Processing, vol. 57, No. 8, Aug. 2009. 12 pages.
Reuven et al., Joint Acoustic Echo Cancellation and Transfer Function GSC in the Frequency Domain, 23rd IEEE Convention of Electrical and Electronics Engineers in Israel, Sep. 2004, pp. 412-415.
Reuven et al., Joint Noise Reduction and Acoustic Echo Cancellation Using the Transfer-Function Generalized Sidelobe Canceller, Speech Communication, vol. 49, 2007, pp. 623-635.
Reuven, et al., "Multichannel Acoustic Echo Cancellation and Noise Reduction in Reverberant Environments Using the Transfer-Function GSC," 2007 IEEE International Conference on Acoustics, Speech and Signal Processing, Apr. 2007, 4 pp.
Ristimaki, Distributed Microphone Array System for Two-Way Audio Communication, Helsinki Univ. of Technology, Master's Thesis, Jun. 15, 2009, 73 pgs.
Rombouts et al., An Integrated Approach to Acoustic Noise and Echo Cancellation, Signal Processing 85, 2005, pp. 849-871.
Sällberg, "Faster Subband Signal Processing," IEEE Signal Processing Magazine, vol. 30, No. 5, Sep. 2013, 6 pp.
Sasaki et al., A Predefined Command Recognition System Using a Ceiling Microphone Array in Noisy Housing Environments, 2008 IEEE/RSJ International Conference on Intelligent Robots and Systems, Sep. 2008, pp. 2178-2184.
Sennheiser, New microphone solutions for ceiling and desk installation, https://en-us.sennheiser.com/news-new-microphone-solutions-for-ceiling-and-desk-installation, Feb. 2011, 2 pgs.
Sennheiser, TeamConnect Ceiling, https://en-us.sennheiser.com/conference-meeting-rooms-teamconnect-ceiling, 2017, 7 pgs.
SerDes, Wikipedia article, last edited on Jun. 25, 2018; retrieved on Jun. 27, 2018, 3 pp., https://en.wikipedia.org/wiki/SerDes.
Sessler, et al., "Directional Transducers," IEEE Transactions on Audio and Electroacoustics, vol. AU-19, No. 1, Mar. 1971, pp. 19-23.
Sessler, et al., "Toroidal Microphones," Journal of Acoustical Society of America, vol. 46, No. 1, 1969, 10 pp.
Shure AMS Update, vol. 1, No. 1, 1983, 2 pgs.
Shure AMS Update, vol. 4, No. 4, 1997, 8 pgs.
Shure Debuts Microflex Advance Ceiling and Table Array Microphones, Press Release, Feb. 9, 2016, 4 pp.
Shure Inc., A910-HCM Hard Ceiling Mount, retrieved from website <http://www.shure.com/en-US/products/accessories/a910hcm> on Jan. 16, 2020, 3 pp.
Shure Inc., Microflex Advance, http://www.shure.com/americas/microflex-advance, 12 pgs.
Shure Inc., MX395 Low Profile Boundary Microphones, 2007, 2 pgs.
Shure Inc., MXA910 Ceiling Array Microphone, http://www.shure.com/americas/products/microphones/microflex-advance/mxa910-ceiling-array-microphone, 7 pp. 2009-2017.
Shure, MXA910 With IntelliMix, Ceiling Array Microphone, available at <https://www.shure.com/en-US/products/microphones/mxa910>, as early as 2020, 12 pp.
Shure, New MXA910 Variant Now Available, Press Release, Dec. 13, 2019, 5 pp.
Shure, Q&A in Response to Recent US Court Ruling on Shure MXA910, Available at <https://www.shure.com/en-US/meta/legal/q-and-a-inresponse-to-recent-us-court-ruling-on-shure-mxa910-response>, As early as 2020, 5 pp.
Shure, RK244G Replacement Screen and Grille, Datasheet, 2013, 1 p.
Shure, The Microflex Advance MXA310 Table Array Microphone, Available at <https://www.shure.com/en-US/products/microphones/mxa310>, As early as 2020, 12 pp.
Signal Processor MRX7-D Product Specifications, Yamaha Corporation, 2016. 12 pages.
Silverman et al., Performance of Real-Time Source-Location Estimators for a Large-Aperture Microphone Array, IEEE Transactions on Speech and Audio Processing, vol. 13, No. 4, Jul. 2005, pp. 593-606.
Sinha, Ch. 9: Noise and Echo Cancellation, in Speech Processing in Embedded Systems, Springer, 2010, pp. 127-142.
SM 69 Stereo Microphone, Datasheet, Georg Neumann GmbH, Available at <https://ende.neumann.com/product_files/6552/download>, 1 p.
Soda et al., Introducing Multiple Microphone Arrays for Enhancing Smart Home Voice Control, The Institute of Electronics, Information and Communication Engineers, Technical Report of IEICE, Jan. 2013, 6 pgs.
Soundweb London Application Guides, BSS Audio, 2010.
Symetrix, Inc., SymNet Network Audio Solutions Brochure, 2008, 32 pgs.
Buck, et al., "Self-Calibrating Microphone Arrays for Speech Signal Acquisition: A Systematic Approach," Signal Processing, vol. 86, 2006, pp. 1230-1238.

(56) References Cited

OTHER PUBLICATIONS

Burton, et al., "A New Structure for Combining Echo Cancellation and Beamforming in Changing Acoustical Environments," IEEE International Conference on Acoustics, Speech and Signal Processing, 2007, pp. 1-77-1-80.
BZ-3a Installation Instructions, XEDIT Corporation, Available at <chrome extension://efaidnbmnnnibpcajpcglclefindmkaj/viewer.html?pdfurl=https%3A%2F%2Fwww.servoreelers.com%2Fmt-content%2Fuploads%2F2017%2F05%2Fbz-a-3universal-2017c.pdf&clen=189067&chunk=true>, 1 p.
Cabral, et al., Glottal Spectral Separation for Speech Synthesis, IEEE Journal of Selected Topics in Signal Processing, 2013, 15 pp.
Campbell, "Adaptive Beamforming Using a Microphone Array for Hands-Free Telephony," Virginia Polytechnic Institute and State University, Feb. 1999, 154 pgs.
Canetto, et al., "Speech Enhancement Systems Based on Microphone Arrays," VI Conference of the Italian Society for Applied and Industrial Mathematics, May 27, 2002, 9 pp.
Cao, "Survey on Acoustic Vector Sensor and its Applications in Signal Processing" Proceedings of the 33rd Chinese Control Conference, Jul. 2014, 17 pp.
Cech, et al., "Active-Speaker Detection and Localization with Microphones and Cameras Embedded into a Robotic dead," IEEE-RAS International Conference on Humanoid Robots, Oct. 2013, pp. 203-210.
Chan, et al., "Uniform Concentric Circular Arrays with Frequency-Invariant Characteristics-Theory, Design, Adaptive Beamforming and DOA Estimation," IEEE Transactions on Signal Processing, vol. 55, No. 1, Jan. 2007, pp. 165-177.
Chau, et al., "A Subband Beamformer on an Ultra Low-Power Miniature DSP Platform," 2002 IEEE International Conference on Acoustics, Speech, and Signal Processing, 4 pp.
Chen, et al., "A General Approach to the Design and Implementation of Linear Differential Microphone Arrays," Signal and Information Processing Association Annual Summit and Conference, 2013 Asia-Pacific, IEEE, 7 pp.
Chen, et al., "Design and Implementation of Small Microphone Arrays," PowerPoint Presentation, Northwestern Polytechnical University and Institut national de la recherche scientifique, Jan. 1, 2014, 56 pp.
Chen, et al., "Design of Robust Broadband Beamformers with Passband Shaping Characteristics using Tikhonov Regularization," IEEE Transactions on Audio, Speech, and Language Processing, vol. 17, No. 4, May 2009, pp. 565-681.
Chou, "Frequency-Independent Beamformer with Low Response Error," 1995 International Conference on Acoustics, Speech, and Signal Processing, pp. 2995-2998, May 9, 1995, 4 pp.
Chu, "Desktop Mic Array for Teleconferencing," 1995 International Conference on Acoustics, Speech, and Signal Processing, May 1995, pp. 2999-3002.
Circuit Specialists webpage for an aluminum enclosure, available at <https://www.circuitspecialists.com/metal-instrument-enclosure-la7.html?otaid=gpl&gclid=EAIaIQobChMI2JTw-Ynm6AIVgbbICh3F4QKuEAkYBiABEgJZMPD_BWE>, 3 pp, 2019.
ClearOne Introduces Ceiling Microphone Array With Built-In Dante Interface, Press Release; GlobeNewswire, Jan. 8, 2019, 2 pp.
ClearOne Launches Second Generation of its Groundbreaking Beamforming Microphone Array, Press Release, Acquire Media, Jun. 1, 2016, 2 pp.
ClearOne to Unveil Beamforming Microphone Array with Adaptive Steering and Next Generation Acoustic Echo Cancellation Technology, Press Release, InfoComm, Jun. 4, 2012, 1 p.
Clearone, Clearly Speaking Blog, "Advanced Beamforming Microphone Array Technology for Corporate Conferencing Systems," Nov. 11, 2013, 5 pp., http://www.clearone.com/blog/advanced-beamforming-microphone-array-technology-for-corporate-conferencing-systems/.
Clearone, Beamforming Microphone Array, Mar. 2012, 6 pgs.
Clearone, Ceiling Microphone Array Installation Manual, Jan. 9, 2012, 20 pgs.
Clearone, Converge/Converge Pro, Manual, 2008, 51 pp.
Clearone, Professional Conferencing Microphones, Brochure, Mar. 2015, 3 pp.
Coleman, "Loudspeaker Array Processing for Personal Sound Zone Reproduction," Centre for Vision, Speech and Signal Processing, 2014, 239 pp.
Cook, et al., An Altemative Approach to Interpolated Array Processing for Uniform Circular Arrays, Asia-Pacific Conference on Circuits and Systems, 2002, pp. 411-414.
Cox, et al., "Robust Adaptive Beamforming," IEEE Trans. Acoust., Speech, and Signal Processing, vol. ASSP-35, No. 10, Oct. 1987, pp. 1365-1376.
CTG Audio, Ceiling Microphone CTG CM-01, Jun. 5, 2008, 2 pgs.
CTG Audio, CM-01 & CM-02 Ceiling Microphones Specifications, 2 pgs.
CTG Audio, CM-01 & CM-02 Ceiling Microphones, 2017, 4 pgs.
CTG Audio, CTG FS-400 and RS-800 with "Beamforming" Technology, Datasheet, As early as 2009, 2 pp.
CTG Audio, CTG User Manual for the FS-400/800 Beamforming Mixers, Nov. 2008, 26 pp.
CTG Audio, Expand Your IP Teleconferencing to Full Room Audio, Obtained from website htt. )://www ct audio com/exand-, our-i -teleconforencino-to-ful-room-audio-while-conquennc.1-echo-cancelation-issues Mull, 2014.
CTG Audio, Frequently Asked Questions, As early as 2009, 2 pp.
CTG Audio, Installation Manual and User Guidelines for the Soundman SM 02 System, May 2001, 29 pp.
CTG Audio, Installation Manual, Nov. 21, 2008, 25 pgs.
CTG Audio, Introducing the CTG FS-400 and FS-800 with Beamforming Technology, As early as 2008, 2 pp.
CTG Audio, Meeting the Demand for Ceiling Mics in the Enterprise 5 Best Practices, Brochure, 2012, 9 pp.
CTG Audio, White on White—Introducing the CM-02 Ceiling Microphone, https://ctgaudio.com/white-on-white-introducing-the-cm-02-ceiling-microphone/, Feb. 20, 2014, 3 pgs.
Dahl et al., Acoustic Echo Cancelling with Microphone Arrays, Research Report Mar. 1995, Univ. of Karlskrona/Ronneby, Apr. 1995, 64 pgs.
Decawave, Application Note: APR001, UWB Regulations, A Summary of Worldwide Telecommunications Regulations governing the use of Ultra-Wideband radio, Version 1.2, 2015, 63 pp.
Desiraju, et al., "Efficient Multi-Channel Acoustic Echo Cancellation Using Constrained Sparse Filter Updates in the Subband Domain," Acoustic Speech Enhancement Research, Sep. 2014, 4 pp.
DiBiase. et al., Robust Localization in Reverberent Rooms, in Brandstein, ed., Microphone Arrays: Techniques and Applications, 2001, Springer-Verlag Berlin Heidelberg, pp. 157-180.
Diethorn, "Audio Signal Processing For Next-Generation Multimedia Communication Systems," Chapter 4, 2004, 9 pp.
Digikey webpage for Converta box (last visited Apr. 22, 2020) <https://www.digikey.com/product-detail/en/bud-industries/CU-452-A/377-1969-ND/439257?utm_adgroup=Boxes&utm_source=google&utm_medium=cpc&utm_campaign=Shopping_Boxes%2C%20Enclosures%2C%20Racks_NEW&utm_term=&utm_content=Boxes&gclid=EAIaIQobChMI2JTw-Ynm6AIVgbbICh3F4QKuEAkYCSABEgKybPD_BwE>, 3 pp.
Digikey webpage for Pomona Box (last visited Apr. 22, 2020) available at <https://www.digikey.com/product-detail/en/pomonaelectronics/3306/501-2054-ND/736489>, 2 pp.
Digital Wireless Conference System, MCW-D 50, Beyerdynamic Inc., 2009, 18 pp.
Do et al., A Real-Time SRP-PHAT Source Location Implementation using Stochastic Region Contraction (SRC) on a Large-Aperture Microphone Array, 2007 IEEE International Conference on Acoustics, Speech and Signal Processing—ICASSP '07, , Apr. 2007, pp. I-121-I-124.
Dominguez, et al., "Towards an Environmental Measurement Cloud: Delivering Pollution Awareness to the Public," International Journal of Distributed Sensor Networks, vol. 10, Issue 3, Mar. 31, 2014, 17 pp.
Dormehl, "HoloLens concept lets you control your smart home via augmented reality," digitaltrends, Jul. 26, 2016, 12 pp.

(56) References Cited

OTHER PUBLICATIONS

"Philips Hue Bulbs and Wireless Connected Lighting System," Web page https://www.philips-hue.com/en-in, 8 pp, Sep. 23, 2020, retrieved from Internet Archive Wayback Machine, <https://web.archive.org/web/20200923171037/https://www.philips-hue.com/en-in> on Sep. 27, 2021. 8 pages.
"Vsa 2050 II Digitally Steerable Column Speaker," Web page https://www.rcf.it/en_US/products/product-detail/vsa-2050-ii/972389, 15 pages, Dec. 24, 2018.
Advanced Network Devices, IPSCM Ceiling Tile IP Speaker, Feb. 2011, 2 pgs.
Advanced Network Devices, IPSCM Standard 2' by 2' Ceiling Tile Speaker, 2 pgs.
Affes, et al., "A Signal Subspace Tracking Algorithm for Microphone Array Processing of Speech," IEEE Trans. On Speech and Audio Processing, vol. 5, No. 5, Sep. 1997, pp. 425-437.
Affes, et al., "A Source Subspace Tracking Array of Microphones for Double Talk Situations," 1996 IEEE International Conference on Acoustics, Speech, and Signal Processing Conference Proceedings, May 1996, pp. 909-912.
Affes, et al., "An Algorithm for Multisource Beamforming and Multitarget Tracking," IEEE Trans. On Signal Processing, vol. 44, No. 6, Jun. 1996, pp. 1512-1522.
Affes, et al., "Robust Adaptive Beamforming via LMS-Like Target Tracking," Proceedings of IEEE International Conference on Acoustics, Speech and Signal Processing, Apr. 1994, pp. IV-269-IV-272.
Ahonen, et al., "Directional Analysis of Sound Field with Linear Microphone Array and Applications in Sound Reproduction," Audio Engineering Socity, Convention Paper 7329, May 2008, 11 pp.
Alarifi, et al., "Ultra Wideband Indoor Positioning Technologies: Analysis and Recent Advances," Sensors 2016, vol. 16, No. 707, 36 pp.
Amazon webpage for Metalfab MFLCRFG (last visited Apr. 22, 2020) available at <https://www.amazon.com/RETURN-FILTERGRILLE-Drop-Ceiling/dp/B0064Q9A7l/ref=sr 12?dchild=1&keywords=drop+ceiling+return+air+grille&qid=1585862723&s=hi&sr=1-2>, 11 pp.
Armstrong "Walls" Catalog available at <https://www.armstrongceilings.com/content/dam/armstrongceilings/commercial/north-america/catalogs/armstrong-ceilings-wallsspecifiers-reference.pdf>, 2019, 30 pp.
Armstrong Tectum Ceiling & Wall Panels Catalog available at <https://www.armstrongceilings.com/content/dam/armstrongceilings/commercial/north-america/brochures/tectum-brochure.pdf>, 2019, 16 pp.
Armstrong Woodworks Concealed Catalog available at <https://sweets.construction.com/swts_content_files/3824/442581.pdf>, 2014, 6 pp.
Armstrong Woodworks Walls Catalog available at https://www.armstrongceilings.com/pdbupimagesclg/220600.pdf/download/datasheet-woodworks-walls.pdf>, 2019, 2 pp.
Armstrong World Industries, Inc., I-Ceilings Sound Systems Speaker Panels, 2002, 4 pgs.
Armstrong, Acoustical Design: Exposed Structure, available at <https://www.armstrongceilings.com/pdbupimagesclg/217142.pdf/download/acoustical-design-exposed-structurespaces-brochure.pdf>, 2018, 19 pp.
Armstrong, Ceiling Systems, Brochure page for Armstrong Softlook, 1995, 2 pp.
Armstrong, Excerpts from Armstrong 2011-2012 Ceiling Wall Systems Catalog, available at <https://web.archive.org/web/20121116034120/http://www.armstrong.com/commceilingsna/en_us/pdf/ceilings_catalog_screen-2011.pdf>, as early as 2012, 162 pp.
Armstrong, i-Ceilings, Brochure, 2009, 12 pp.
Arnold, et al., "A Directional Acoustic Array Using Silicon Micromachined Piezoresistive Microphones," Journal of the Acoustical Society of America, 113(1), Jan. 2003, 10 pp.
Atlas Sound, I128SYSM IP Compliant Loudspeaker System with Microphone Data Sheet, 2009, 2 pgs.
Atlas Sound, 1'×2' IP Speaker with Micophone for Suspended Ceiling Systems, https://www.atlasied.com/i128sysm, retrieved Oct. 25, 2017, 5 pgs.
Audio Technica, ES945 Omnidirectional Condenser Boundary Microphones, https://eu.audio-technica.com/resources/ES945%20Specifications.pdf, 2007, 1 pg.
Audix Microphones, Audix Introduces Innovative Ceiling Mics, http://audixusa.com/docs_12/latest_news/EFpIFKAAKIOtSdolke.shtml, Jun. 2011, 6 pgs.
Audix Microphones, M70 Flush Mount Ceiling Mic, May 2016, 2 pgs.
Automixer Gated, Information Sheet, MIT, Nov. 2019, 9 pp.
AVNetwork, "Top Five Conference Room Mic Myths," Feb. 25, 2015, 14 pp.
Beh, et al., "Combining Acoustic Echo Cancellation and Adaptive Beamforming for Achieving Robust Speech Interface in Mobile Robot," 2008 IEEE/RSJ International Conference on Intelligent Robots and Systems, Sep. 2008, pp. 1693-1698.
Benesty, et al., "A New Class of Doubletalk Detectors Based on Cross-Correlation," IEEE Transactions on Speech and Audio Processing, vol. 8, No. 2, Mar. 2000, pp. 168-172.
Benesty, et al., "Adaptive Algorithms for Mimo Acoustic Echo Cancellation," AI2 Allen Institute for Artifical Intelligence, 2003.
Benesty, et al., "Differential Beamforming," Fundamentals of Signal Enhancement and Array Signal Processing, First Edition, 2017, 39 pp.
Benesty, et al., "Frequency-Domain Adaptive Filtering Revisited, Generalization to the Multi-Channel Case, and Application to Acoustic Echo Cancellation," 2000 IEEE International Conference on Acoustics, Speech, and Signal Processing Proceedings, Jun. 2000, pp. 789-792.
Benesty, et al., "Microphone Array Signal Processing," Springer, 2010, 20 pp.
Berkun, et al., "Combined Beamformers for Robust Broadband Regularized Superdirective Beamforming," IEEE/ACM Transactions on Audio, Speech, and Language Processing, vol. 23, No. 5, May 2015, 10 pp.
Beyer Dynamic, Classis BM 32-33-34 DE-EN-FR 2016, 1 pg.
Beyer Dynamic, Classis-BM-33-PZ A1, 2013, 1 pg.
BNO055, Intelligent 9-axis absolute orientation sensor, Data sheet, Bosch, Nov. 2020, 118 pp.
Boyd, et al., Convex Optimization, Mar. 15, 1999, 216 pgs.
Brandstein, et al., "Microphone Arrays: Signal Processing Techniques and Applications," Digital Signal Processing, Springer-Verlag Berlin Heidelberg, 2001, 401 pgs.
Brooks, et al., "A Quantitative Assessment of Group Delay Methods for Identifying Glottal Closures in Voiced Speech," IEEE Transaction on Audio, Speech, and Language Processing, vol. 14, No. 2, Mar. 2006, 11 pp.
Bruel & Kjaer, by J.J. Christensen and J. Hald, Technical Review: Beamforming, No. 1, 2004, 54 pgs.
BSS Audio, Soundweb London Application Guides, 2010, 120 pgs.
Buchner, et al., "An Acoustic Human-Machine Interface with Multi-Channel Sound Reproduction," IEEE Fourth Workshop on Multimedia Signal Processing, Oct. 2001, pp. 359-364.
Buchner, et al., "An Efficient Combination of Multi-Channel Acoustic Echo Cancellation with a Beamforming Microphone Array," International Workshop on Hands-Free Speech Communication (HSC2001), Apr. 2001, pp. 55-58.
Buchner, et al., "Full-Duplex Communication Systems Using Loudspeaker Arrays and Microphone Arrays," IEEE International Conference on Multimedia and Expo, Aug. 2002, pp. 509-512.
Buchner, et al., "Generalized Multichannel Frequency-Domain Adaptive Filtering: Efficient Realization and Application to Hands-Free Speech Communication," Signal Processing 85, 2005, pp. 549-570.
Buchner, et al., "Multichannel Frequency-Domain Adaptive Filtering with Application to Multichannel Acoustic Echo Cancellation," Adaptive Signal Processing, 2003, pp. 95-128.
Buck, "Aspects of First-Order Differential Microphone Arrays in the Presence of Sensor Imperfections," Transactions on Emerging Telecommunications Technologies, 13.2, 2002, 8 pp.

(56) References Cited

OTHER PUBLICATIONS

Buck, et al., "First Order Differential Microphone Arrays for Automotive Applications," 7th International Workshop on Acoustic Echo and Noise Control, Darmstadt University of Technology, Sep. 10-13, 2001, 4 pp.

* cited by examiner

PATTERN-FORMING MICROPHONE ARRAY

CROSS-REFERENCE TO RELATED APPLICATIONS

This application is a continuation of U.S. patent application Ser. No. 16/409,239, filed on May 10, 2019, which claims priority from U.S. Provisional Application No. 62/679,452, filed on Jun. 1, 2018, the contents of each being incorporated herein by reference in their entirety.

TECHNICAL FIELD

This application generally relates to microphone arrays. In particular, this application relates to a microphone array configurable to form one or more desired polar patterns.

BACKGROUND

In general, microphones are available in a variety of sizes, form factors, mounting options, and wiring options to suit the needs of a given application. There are several different types of microphones and related transducers, such as, for example, dynamic, crystal, condenser/capacitor (externally biased and electret), Micro-Electrical-Mechanical-System ("MEMS"), etc., each having its advantages and disadvantages depending on the application. The different microphones can be designed to produce different polar response patterns, including, for example, omnidirectional, cardioid, subcardioid, supercardioid, hypercardioid, and bidirectional. The polar pattern chosen for a particular microphone (or microphone cartridge included therein) may depend on, for example, where the audio source is located, the desire to exclude unwanted noises, and/or other considerations.

In conferencing environments, such as boardrooms, video conferencing settings, and the like, one or more microphones are used to capture sound from multiple audio sources. The audio sources may include in-room human speakers, and in some cases, loudspeakers for playing audio received from human speakers that are not in the room, for example. The captured sound may be disseminated to an audience through loudspeakers in the environment, a telecast, a webcast, telephony, etc. The types of microphones and their placement in a particular conferencing environment may depend on the locations of the audio sources, the loudspeakers, physical space requirements, aesthetics, room layout, and/or other considerations. For example, in some environments, the microphones may be placed on a table or lectern near the audio sources. In other environments, the microphones may be mounted overhead to capture the sound from the entire room, for example.

Some existing conferencing systems employ boundary microphones and button microphones that can be positioned on or in a surface (e.g., a table). Such microphones typically include multiple cartridges so that the microphones can have multiple independent polar patterns to capture sound from multiple audio sources (e.g., human speakers seated at different sides of a table). Other such microphones may include multiple cartridges so that various polar patterns can be formed by appropriately processing the audio signals from each cartridge, thus eliminating the need to physically swap cartridges to obtain a different polar pattern. For these types of microphones, while it would be ideal to co-locate the multiple cartridges within the microphone, so that each cartridge detects sounds in the environment at the same instant, it is not, however, physically possible to do so. As such, these types of microphones may not uniformly form the desired polar patterns and may not ideally capture sound due to frequency response irregularities, as well as interference and reflections within and between the cartridges.

In most conferencing environments, it is desirable for a microphone to have a toroidal polar pattern that is omnidirectional in the plane of the microphone with a null in the axis perpendicular to that plane. For example, a toroidal microphone that is positioned on a conference table may be configured to detect sound in all directions along the plane of the table, but minimize the detection of sound above the microphone, e.g., in the direction pointing towards the ceiling and/or away from the table. However, existing microphones with toroidal polar patterns may be physically large, have a high self-noise, require complex processing, and/or have inconsistent polar patterns over a full frequency range, e.g., 100 Hz to 10 kHz.

Micro-Electrical-Mechanical-System ("MEMS") microphones, or microphones that have a MEMS element as the core transducer, have become increasingly popular due to their small package size (e.g., allowing for an overall lower profile device) and high performance characteristics (e.g., high signal-to-noise ratio ("SNR"), low power consumption, good sensitivity, etc.). In addition, MEMS microphones are generally easier to assemble and available at a lower cost than, for example, electret or condenser microphone cartridges found in many existing boundary microphones. However, due to the physical constraints of the MEMS microphone packaging, the polar pattern of a conventional MEMS microphone is inherently omnidirectional, which means the microphone is equally sensitive to sounds coming from any and all directions, regardless of the microphone's orientation. This can be less than ideal for conferencing environments, in particular.

One existing solution for obtaining directionality using MEMS microphones includes placing multiple microphones in an array configuration and applying appropriate beamforming techniques (e.g., signal processing) to produce a desired directional response, or a beam pattern that is more sensitive to sound coming from one or more specific directions than sound coming from other directions. Such microphone arrays may have different configurations and frequency responses depending on the placement of the microphones relative to each other and the direction of arrival for sound waves. For example, a broadside microphone array includes a line of microphones arranged perpendicular to the preferred direction of sound arrival. The output for such arrays is obtained by simply summing the resulting microphone signals together, thus producing a flat and on-axis response.

As another example, an endfire array includes multiple microphones arranged in-line with the desired direction of sound propagation. In a differential endfire array, the signal captured by the front microphone in the array (i.e. the first microphone reached by sound propagating on-axis) is summed with an inverted and delayed version of the signal captured by the rear microphone in the array (i.e. positioned opposite the front microphone) to produce cardioid, hypercardioid, or supercardioid pickup patterns, for example. In such cases, the sound from the rear of the array is greatly or completely attenuated, while the sound from the front of the array has little or no attenuation. The frequency response of a differential endfire array is not flat, so an equalization filter is typically applied to the output of the differential beamforming algorithm to flatten the response. While MEMS microphone endfire arrays are currently in use, specifically in the handset and hearing health industries, the existing products do not provide the high performance characteristics required for conferencing platforms (e.g., maximum signal-to-noise ratio (SNR), planar directional pickup, wideband audio coverage, etc.).

Accordingly, there is still a need for a low profile, high performing microphone array capable of forming one or more directional polar patterns that can be isolated from unwanted ambient sounds, so as to provide full, natural-sounding speech pickup suitable for conferencing applications.

SUMMARY

The invention is intended to solve the above-noted and other problems by providing a microphone array that is designed to, among other things, provide (1) at least one linear microphone array comprising one or more sets of microphone elements nested within one or more other sets, each set including at least two microphones separated by a distance selected to cover a desired operating band; (2) a beamformer configured to generate a combined output signal for the linear array having a desired directional polar pattern (e.g., toroidal, cardioid, etc.); and (3) high performance characteristics suitable for conferencing environments, such as, e.g., a highly directional polar pattern, high signal-to-noise ratio (SNR), wideband audio coverage, etc.

For example, one embodiment includes a microphone array with a plurality of microphone elements comprising: a first set of elements arranged along a first axis and comprising at least two microphone elements spaced apart from each other by a first distance, and a second set of elements arranged along the first axis and comprising at least two microphone elements spaced apart from each other by a second distance greater than the first distance, such that the first set is nested within the second set, wherein the first distance is selected for optimal microphone operation in a first frequency band, and the second distance is selected for optimal microphone operation in a second frequency band that is lower than the first frequency band.

Another example embodiment includes a method of assembling a microphone array, the method comprising: forming a first set of microphone elements along a first axis, the first set including at least two microphone elements spaced apart from each other by a first distance; forming a second set of microphone elements along the first axis, the second set including at least two microphone elements spaced apart from each other by a second distance greater than the first distance, such that the first set is nested within the second set; and electrically coupling each microphone element to at least one processor for processing audio signals captured by the microphone elements, wherein the first distance is selected for optimal microphone operation in a first frequency band, and the second distance is selected for optimal microphone operation in a second frequency band that is lower than the first frequency band.

Exemplary embodiments also include a microphone system comprising: a microphone array including a plurality of microphone elements coupled to a support, the plurality of microphone elements comprising first and second sets of elements arranged along a first axis of the support, the first set being nested within the second set, wherein the first set includes at least two microphone elements spaced apart from each other by a first distance selected to configure the first set for optimal microphone operation in a first frequency band, and the second set includes at least two microphone elements spaced apart from each other by a second distance that is greater than the first distance, the second distance being selected to configure the second set for optimal microphone operation in a second frequency band that is lower than the first frequency band; a memory configured to store program code for processing audio signals captured by the plurality of microphone elements and generating an output signal based thereon; and at least one processor in communication with the memory and the microphone array, the at least one processor configured to execute the program code in response to receiving audio signals from the microphone array, wherein the program code is configured to: receive audio signals from each microphone element of the microphone array; for each set of elements along the first axis, combine the audio signals for the microphones in the set to generate a combined output signal with a directional polar pattern; and combine the combined output signals for the first and second sets to generate a final output signal for all of the microphone elements on the first axis.

Yet another exemplary embodiment includes a method performed by one or more processors to generate an output signal for a microphone array comprising a plurality of microphone elements coupled to a support. The method comprises: receiving audio signals from the plurality of microphone elements, the plurality of microphone elements comprising first and second sets of elements arranged along a first axis of the support, the first set being nested within the second set, wherein the first set includes at least two microphone elements spaced apart from each other by a first distance selected to configure the first set for optimal microphone operation in a first frequency band, and the second set includes at least two microphone elements spaced apart from each other by a second distance that is greater than the first distance, the second distance being selected to configure the second set for optimal microphone operation in a second frequency band that is lower than the first frequency band; for each set of elements along the first axis, combining the audio signals for the microphone elements in the set to generate a combined output signal with a directional polar pattern; and combining the combined output signals for the first and second sets to generate a final output signal for all microphone elements on the first axis.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
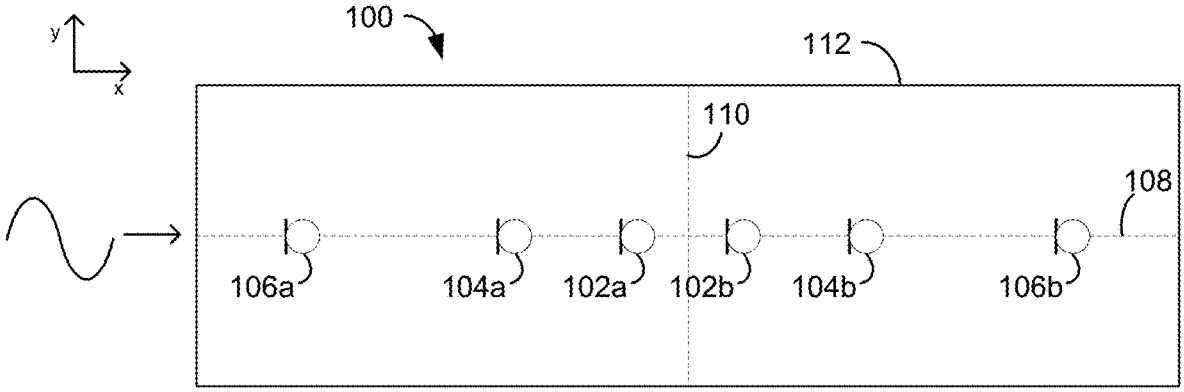
FIG. 1 is a schematic diagram illustrating an exemplary microphone array in accordance with one or more embodiments.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

Systems and methods are provided herein for a high performing microphone comprising at least one linear array with multiple pairs (or sets) of microphone elements spaced apart by specified distances and arranged in a nested configuration to achieve coverage of desired operating bands, a high signal-to-noise ratio (SNR), and a directional polar pattern. Exemplary embodiments also include a microphone with at least two orthogonal linear arrays having a shared center and symmetrical placement of microphone elements on each axis to create a planar directional pickup pattern. Embodiments further include linear arrays in which at least one of the microphone pairs (or sets) comprise spaced apart clusters of two or more microphone elements to create a higher sensitivity microphone with an improved SNR. In preferred embodiments, the microphone elements are MEMS transducers or other omnidirectional microphones. These and other array forming features are described in more detail herein, particularly with respect to FIGS. 1 to 4.

Embodiments also include one or more beamformers for combining the polar patterns for each set of microphone elements on a given axis and then summing the combined outputs for the various sets to obtain a final output with a directional polar pattern (such as, e.g., cardioid, etc.). In the case of orthogonal linear arrays, the beamformers can combine the final outputs for each axis to achieve planar directional pickup (such as, e.g., toroidal, etc.). In some embodiments, the one or more beamformers use crossover filtering to isolate each set of microphone elements to its optimal frequency band (or range) and then sum or stitch together the outputs of each set to obtain a desired frequency response that covers all or most of the audible bandwidth (e.g., 20 Hz to 20 kHz) and has a higher SNR than, for example, that of the individual microphone elements. These and other beamforming techniques are described in more detail herein, particularly with respect to FIGS. 5 to 8.

FIG. 1 illustrates an exemplary microphone 100 comprising a microphone array that can detect sounds from one or more audio sources at various frequencies, in accordance with embodiments. The microphone 100 may be utilized in a conferencing environment, such as, for example, a conference room, a boardroom, or other meeting room where the audio source includes one or more human speakers. Other sounds may be present in the environment which may be undesirable, such as noise from ventilation, other persons, audio/visual equipment, electronic devices, etc. In a typical situation, the audio sources may be seated in chairs at a table, although other configurations and placements of the audio sources are contemplated and possible, including, for example, audio sources that move about the room. The microphone 100 can be placed on a table, lectern, desktop, etc. in order to detect and capture sound from the audio sources, such as speech spoken by human speakers.

The microphone array of microphone 100 is comprised of multiple microphone elements 102*a,b*, 104*a,b*, 106*a,b* that can form multiple pickup patterns for optimally detecting and capturing the sound from said audio sources. In FIG. 1, the microphone elements 102*a,b*, 104*a,b*, 106*a,b* are generally arranged in a linear fashion along a length of the microphone 100. In embodiments, the microphone elements 102*a,b*, 104*a,b*, 106*a,b* may be disposed along a common axis of the microphone 100, such as, e.g., a first axis 108. In the illustrated embodiment, the first axis 108 coincides with an x-axis of the microphone 100, which passes through, or intersects with, a y-axis (e.g., second axis 110) of the microphone 100 at a common central point (or midpoint). In other cases, the first axis 108 may be parallel to the x-axis and vertically offset from the central point of the microphone 100 (e.g., above or below the center). In still other cases, the first axis 108 may be angled relative to both the x-axis and the y-axis so as to form a diagonal line there between (see, e.g., FIG. 3). In some cases, the microphone array includes microphone elements arranged along a y-axis (e.g., second axis 110) of the microphone 100 (not shown), instead of the first axis 108.

Figure 3:
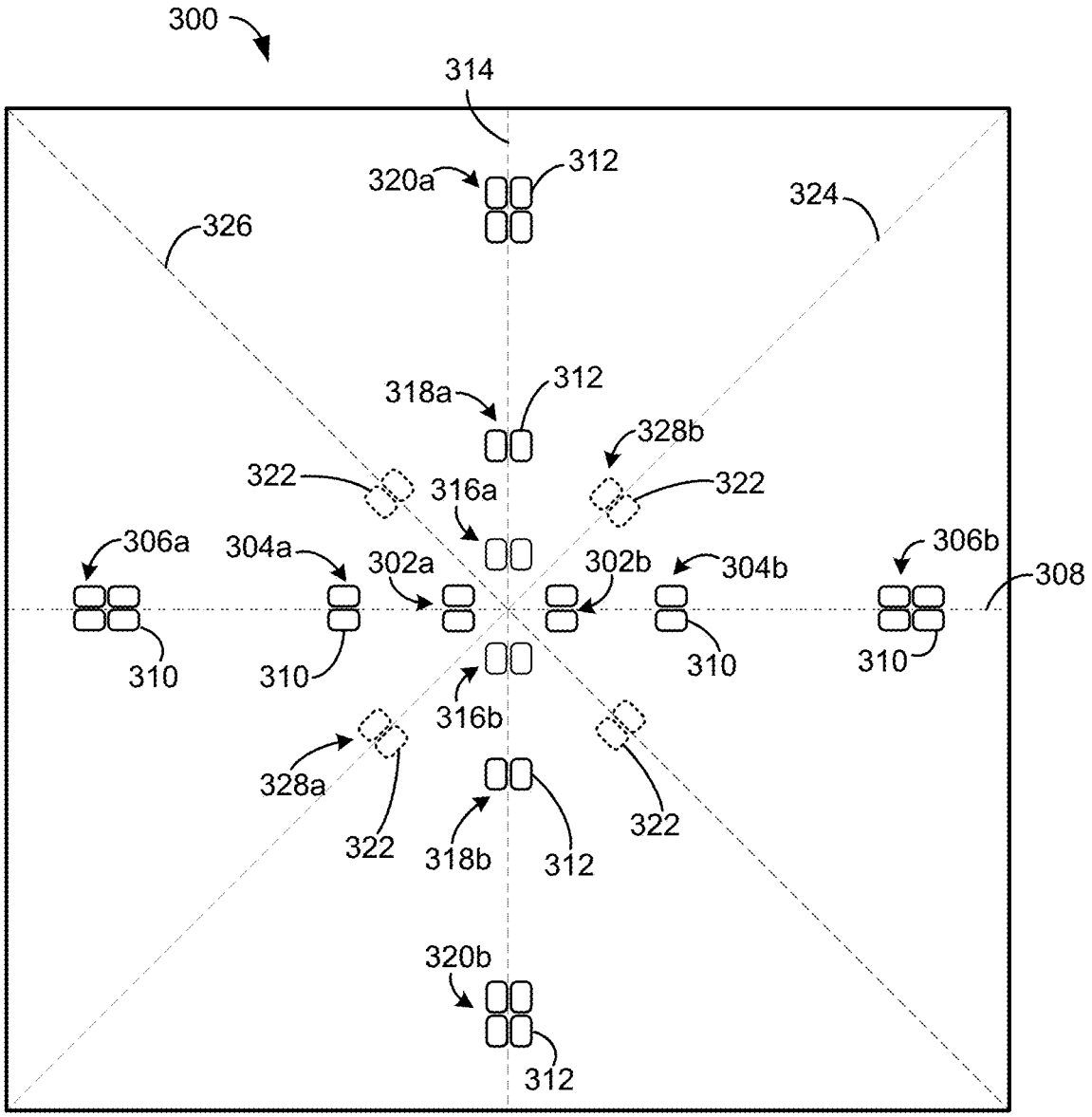
FIG. 3 is a schematic diagram illustrating another exemplary microphone array in accordance with one or more embodiments.
Figure 4:
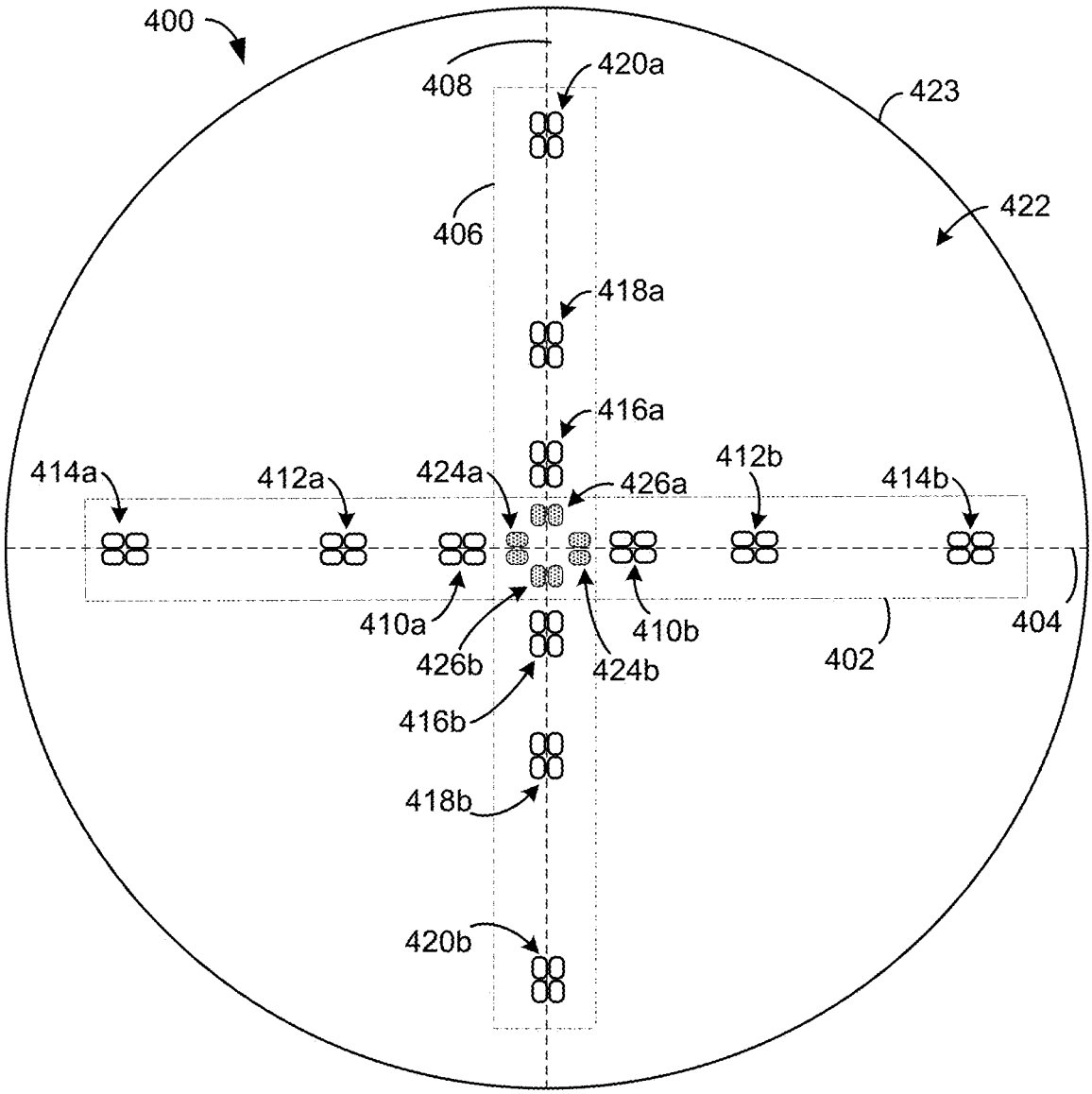
FIG. 4 is a schematic diagram illustrating still another exemplary microphone array in accordance with one or more embodiments.

Although FIG. 1 shows six microphone elements 102*a,b*, 104*a,b*, 106*a,b*, other numbers (e.g., larger or fewer) of microphone elements are possible and contemplated, for example, as shown in FIGS. 3 and 4. The polar patterns that can be formed by the microphone 100 may include omnidirectional, cardioid, subcardioid, supercardioid, hypercardioid, bidirectional, and/or toroidal. In some embodiments, each of the microphone elements 102*a,b*, 104*a,b*, 106*a,b* of the microphone 100 may be a MEMS (micro-electrical mechanical system) transducer with an inherent omnidirectional polar pattern. In other embodiments, the microphone elements 102*a,b*, 104*a,b*, 106*a,b* may have other polar patterns, may be any other type of omnidirectional microphone, and/or may be condenser microphones, dynamic microphones, piezoelectric microphones, etc. In still other embodiments, the arrangement and/or processing techniques described herein can be applied to other types of arrays comprised of omnidirectional transducers or sensors where directionality is desired (such as, e.g., sonar arrays, radio frequency applications, seismic devices, etc.).

Each of the microphone elements 102*a,b*, 104*a,b*, 106*a,b* in the microphone 100 can detect sound and convert the sound into an audio signal. In some cases, the audio signal can be a digital audio output. For other types of microphone elements, the audio signal may be an analog audio output, and components of the microphone 100, such as analog to digital converters, processors, and/or other components, may process the analog audio signals to ultimately generate one or more digital audio output signals. The digital audio output signals may conform to the Dante standard for transmitting audio over Ethernet, in some embodiments, or may conform to another standard. In certain embodiments, one or more pickup patterns may be formed by the processor of the microphone 100 from the audio signals of the microphone elements 102*a,b*, 104*a,b*, 106*a,b*, and the processor may generate a digital audio output signal corresponding to each of the pickup patterns. In other embodiments, the microphone elements 102*a,b*, 104*a,b*, 106*a,b* of the microphone 100 may output analog audio signals and other components and devices (e.g., processors, mixers, recorders, amplifiers, etc.) external to the microphone 100 may process the analog audio signals.

The microphone 100 may further include a support 112 (such as, e.g., a substrate, printed circuit board, frame, etc.) for supporting the microphone elements 102*a,b*, 104*a,b*, 106*a,b*. The support 112 may have any size or shape including, for example, a rectangle (e.g., FIG. 1), square (e.g., FIG. 3), circle (e.g., FIG. 4), hexagon, etc. In some cases, the support 112 may be sized and shaped to meet the constraints of a pre-existing device housing and/or to achieve desired performance characteristics (e.g., select operating bands, high SNR, etc.). For example, a maximum width and/or length of the microphone array may be determined by the overall width of a device housing.

In embodiments, each of the microphone elements 102*a,b*, 104*a,b*, 106*a,b* is mechanically and/or electrically coupled to the support 112. For example, in the case of a PCB, the microphone elements 102*a,b*, 104*a,b*, 106*a,b* may be electrically coupled to the support 112, and the PCB/support 112 may be electrically coupled to one or more processors or other electronic device for receiving and processing audio signals captured by the microphone elements 102*a,b*, 104*a,b*, 106*a,b*. In some embodiments, the microphone elements 102*a,b*, 104*a,b*, 106*a,b* are embedded into or physically located on the support 112. In other embodiments, the microphone elements 102*a,b*, 104*a,b*, 106*a,b* may be suspended from (e.g., dangling below) the support 112 using, for example, a plurality of wires respectively coupled between the microphone elements 102*a,b*, 104*a,b*, 106*a,b* and the support 112. In still other embodiments, each of the microphone elements 102*a,b*, 104*a,b*, 106*a,b* of the microphone 100 may not be physically connected to each other or a specific support, but may be wirelessly connected to a processor or audio receiver so as to form a distributed network of microphones. In such cases, the microphone elements 102*a,b*, 104*a,b*, 106*a,b* may be individually arranged on, or suspended from, one or more surfaces within the conferencing environment or table, for example.

In FIG. 1, the microphone elements 102*a,b*, 104*a,b*, 106*a,b* are arranged in the same plane and on the same surface or side of the support 112 (e.g., a front or top surface). In other embodiments, the microphone 100 also includes one or more microphones (not shown) arranged on an opposite side or surface (e.g., back or bottom surface) of the support 112 (see, e.g., FIG. 4), so as to increase the total number of microphone elements included in the microphone array and/or to enable the microphone 100 to cover more frequency bands.

In some embodiments, the microphone 100 comprises additional microphone elements (not shown) arranged along one or more other axes of the microphone 100 (see, e.g., FIG. 3). In such cases, the other axes, like the second axis 110, for example, may intersect with the first axis 108 at the center or midpoint of the microphone 100 and may be co-located in the same plane as the first axis 108 (see, e.g., FIGS. 3 and 4). The placement of additional microphone elements on such other axes having a shared center can, among other things, enable or enhance the ability to achieve planar directionality for the output of the microphone 100, as described herein.

Figure 2:
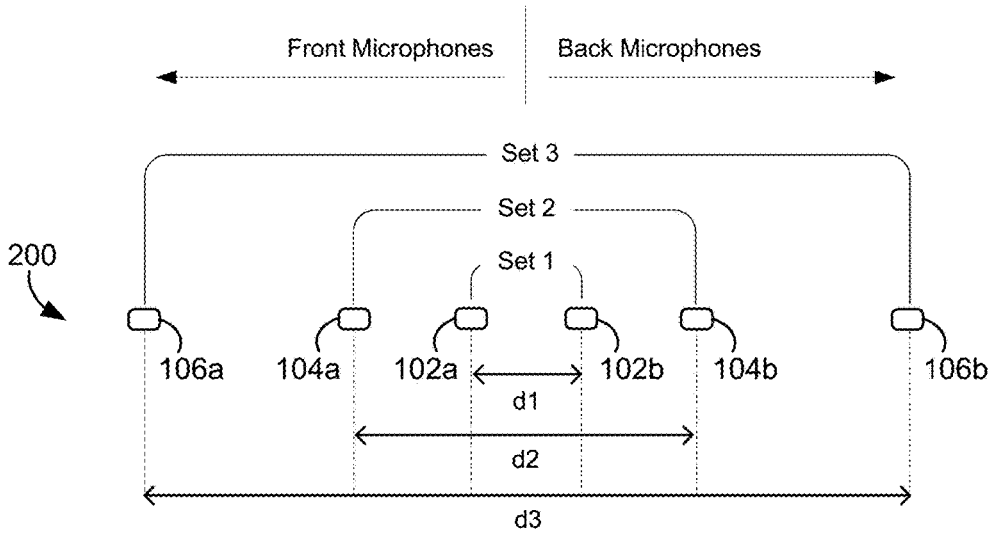
FIG. 2 is a schematic diagram illustrating design considerations for the microphone array of FIG. 1 in accordance with one or more embodiments.

According to embodiments, the microphone elements 102*a,b*, 104*a,b*, 106*a,b* of the microphone 100 can be arranged in a nested configuration made up of various sets or groups of microphone elements. This configuration is further illustrated in FIG. 2, which depicts a microphone array 200 comprised of the microphone elements 102*a,b*, 104*a,b*, 106*a,b* shown in FIG. 1. As shown in FIG. 2, a first set 102 ("Set 1") includes the microphone elements 102*a* and 102*b* spaced apart from each other by a first distance d1 that is the smallest or nearest distance of the three sets; a second set 104 ("Set 2") includes the microphone elements 104*a* and 104*b* spaced apart from each other by a second distance d2 that is greater than the first distance, or the middle or intermediate distance of the three sets; and a third set 106 ("Set 3") includes the microphone elements 106*a* and 106*b* spaced apart from each other by a third distance d3 that is greater than the second distance, or the largest or furthest distance of the three sets. The nested configuration can be achieved by placing the microphone elements 106*a,b* of Set 3 at the outer ends of the microphone array 200, placing or nesting the microphone elements 104*a,b* of Set 2 within the microphone elements 106*a,b* of Set 3, and placing or nesting the microphone elements 102*a,b* of Set 1 within the microphone elements 104*a,b* of Set 2. While three nested groups are shown in FIGS. 1 and 2, other numbers of nested groups (and microphone elements) are possible and contemplated (e.g., as shown in FIGS. 3 and 4). For example, the exact number of nested groups may depend on the desired number of operating bands for the microphone array 200 and/or the physical constraints of a device housing.

According to embodiments, the distance between the respective microphone elements within a given set 102, 104, or 106 can be selected to optimally cover a desired frequency band or range (also referred to herein as "operating band"). In particular, Set 1 (including microphone elements 102*a,b*) may be configured to cover a first or higher frequency band, Set 2 (including microphone elements 104*a,b*) may be configured to cover a second or middle frequency band (or range), and Set 3 (including microphone elements 106*a,b*) may be configured to cover a third or lower frequency band (or range). In some cases, the spacing between the elements in the middle Set 2, and therefore, the frequency band coverage provided thereby, may be selected to bridge the gap between the high frequency band covered by Set 1 and the low frequency band covered by Set 3 and/or to keep a noise level of the microphone array output low. In embodiments, appropriate beamforming techniques may be utilized to combine the outputs of the different sets 1, 2, and 3, so that the overall microphone 100 achieves a desired frequency response, including, for example, lower noise characteristics, higher microphone sensitivity, and coverage of discrete frequency bands, as described in more detail herein.

In the illustrated embodiment, each of the nested groups 102, 104, 106 includes at least one front microphone element 102*a*, 104*a*, or 106*a* and at least one back microphone element 102*b*, 104*b*, or 106*b*, respectively, arranged in a linear endfire array. That is, the microphone elements in each set are arranged in-line with the direction of on-axis sound propagation, such that sound reaches the front microphone elements 102*a*, 104*a*, or 106*a* before reaching the corresponding back microphone elements 102*b*, 104*b*, or 106*b*. Due to this linear configuration, the sound picked up by the different microphone elements in each of the Sets 1, 2, and 3 may differ only in terms of arrival time. In embodiments, appropriate beamforming techniques may be applied to the microphone elements 102*a,b*, 104*a,b*, 106*a,b* so that each of the nested Sets 1, 2, 3 effectively operates as independent microphone arrays having a desired directional pickup pattern and frequency response characteristics, as described in more detail herein (see, e.g., FIGS. 5-7). In some embodiments, the "front" and "back" designations may be programmatically assigned by the processor depending on the design considerations for the microphone 100. In one example embodiment, the processor can flip the "front" orientation of the elements 102*a*, 104*a*, 106*a* to "back" and the "back" orientation of the elements 102*b*, 104*b*, 106*b* to "front," and represent both configurations simultaneously, thus creating two cardioids on two output channels, one having an on-axis orientation that is 180 degrees rotated from the other.

In FIGS. 1 and 2, each of the nested groups 102, 104, 106 includes exactly two microphone elements. In other embodiments, for example, as shown in FIGS. 3 and 4, at least one of the nested groups includes two clusters of microphone spaced apart by the specified distance (e.g., d1, d2, or d3), instead of the individual microphone elements shown in FIGS. 1 and 2. In such cases, each cluster includes two or more microphone elements positioned adjacent, or in very close proximity, to each other. In embodiments, appropriate beamforming techniques may be used to sum together the audio signals captured by the microphone elements within each cluster, so that the cluster effectively operates as a single, higher sensitivity microphone with boosted SNR characteristics, as described in more detail herein.

Referring now to FIG. 3, shown is an exemplary microphone 300 comprising a plurality of microphone clusters 302*a,b*, 304*a,b*, 306*a,b* arranged in nested pairs 302, 304, 306, respectively, along a first axis 308 (e.g., x-axis) of the microphone 300, in accordance with embodiments. Each of the clusters 302*a,b*, 304*a,b*, 306*a,b* includes a plurality of microphone elements 310 arranged in close proximity to each other. The microphone elements 310 within each of the clusters 302*a,b*, 304*a,b*, 306*a,b* may also be arranged symmetrically about the first axis 308, as shown. The microphone elements 310 can be electrically and/or mechanically coupled to a support 311 (e.g., a frame, a PCB, a substrate, etc.) that generally defines an overall size and shape (shown here as a square) of the microphone 300. In embodiments, the microphone elements 310 can be MEMS transducers, other types of omnidirectional microphones, dynamic or condenser microphones, other types of omnidirectional transducers, etc.

While FIG. 3 shows clusters of two or four microphone elements, other numbers (including, e.g., odd numbers) of microphones elements for a given cluster are possible and contemplated. The exact number of microphone elements 310 placed in each of the clusters 302*a,b*, 304*a,b*, 306*a,b* may depend on, for example, space constraints, cost, performance tradeoffs, and/or the amount of signal boost desired for a given frequency band of the microphone array. As an example, clusters of four microphone elements may be preferred for lower frequency bands, which are placed on the outer edges of the microphone array where space is abundant, while clusters of two microphone elements may be preferred for higher frequency bands, which are placed towards the center of the microphone array where space is limited.

Each of the nested pairs 302, 304, 306 (also referred to herein as a "cluster-pair") includes a first or front cluster 302*a*, 304*a*, or 306*a* and a duplicate or back cluster 302*b*, 304*b*, or 306*b*, respectively, that is identical to the corresponding first cluster 302*a*, 304*a*, or 306*a* in terms of the number (e.g., 2, 4, etc.) and arrangement (e.g., spacing, symmetry, etc.) of the microphone elements 310 therein. Further, within each of the cluster-pairs 302, 304, 306, the duplicate cluster 302*b*, 304*b*, or 306*b* can be spaced apart from the corresponding first cluster 302*a*, 304*a*, or 306*a* by a specified distance in order to achieve optimal microphone operation within a selected frequency band, similar to Sets 1, 2, 3 of FIG. 2. For example, in one embodiment, the clusters 302*a,b*, 304*a,b*, and 306*a,b* are spaced apart by the distances d1, d2, and d3, respectively, so that the first cluster-pair 302 forms a microphone array configured to cover a higher frequency band, the second cluster-pair 304 forms a microphone array configured to cover a middle frequency band, and the third cluster-pair 306 forms a microphone array configured to cover a lower frequency band.

The cluster-pairs 302, 304, 306 can be arranged in a nested configuration, similar to the nested configuration shown in FIG. 2. In the illustrated embodiment, the microphone 300 includes a first cluster-pair 302 comprising microphone clusters 302*a* and 302*b* spaced apart by a first or smallest distance, a second cluster-pair 304 comprising microphone clusters 304*a* and 304*b* spaced apart by a second or intermediate distance, and a third cluster-pair 306 comprising microphone clusters 306*a* and 306*b* spaced apart by a third or largest distance. The nested configuration can be formed by placing the microphone clusters 306*a,b* of the third cluster-pair 306 on the outer edges of the first axis 308, placing or nesting the microphone clusters 304*a,b* of the second cluster-pair 304 between the clusters 306*a,b* of the third cluster-pair 306, and placing or nesting the microphone clusters 302*a,b* of the first cluster-pair 302 between the clusters 304*a,b* of the second cluster-pair 304. While three cluster-pairs are shown in FIG. 3 along the first axis 308, other numbers (e.g., fewer or greater) of cluster-pairs are possible and contemplated.

In some embodiments, the microphone 300 further includes a second plurality of microphone elements 312 arranged along a second axis 314 of the microphone 300 that is orthogonal to the first axis 308. The microphone elements 312 may be organized in first, second, and third cluster-pairs 316, 318, 320 that correspond to, or are duplicates of, the first, second, and third cluster-pairs 302, 304, 306 along the first axis 308, respectively. That is, clusters 316*a,b* on the second axis 314 are spaced apart by the same first distance, d1, and contain the same number and arrangement of microphone elements 312, as the clusters 302*a,b*, respectively, on the first axis 308. Likewise, clusters 318*a,b* on the second axis 314 are spaced apart by the same second distance, d2, and contain the same number and arrangement of microphone elements 312, as the clusters 304*a,b*, respectively, on the first axis 308. And clusters 320*a,b* on the second axis 314 are spaced apart by the same third distance, d3, and contain the same number and arrangement of microphone elements 312, as the clusters 306*a,b*, respectively, on the first axis 308. In this manner, the linear nested array formed along the first axis 308 can be superimposed onto the second axis 314.

In the illustrated embodiment, a center of the first axis 308 is aligned with a center of the second axis 314, and each of the cluster-pairs 302, 304, 306, 316, 318, 320 is symmetrically placed on, or centered about, the axis that is orthogonal to it (e.g., axis 314 or 308). This ensures that the linear microphone array formed by the microphone elements 310 on the first axis 308 shares a center or midpoint with the linear microphone array formed by the microphone elements 312 on the second axis 314. In embodiments, appropriate beamforming techniques can be applied to the orthogonal linear arrays of the microphone 300 to create a toroidal pickup pattern and/or to form a first order polar-pattern (such as, e.g., super cardioid, hypercardioid, etc.) and steer that polar pattern to a desired angle to obtain planar directionality. For example, while the microphone elements 310 along the first axis 308 can be used to create a linear array with a directional polar pattern, such as, e.g., a cardioid pickup pattern, the combination of two orthogonal linear arrays along the axes 308 and 314 may form a toroidal pickup pattern or a planar directional polar pattern. In some embodiments, appropriate beamforming techniques can form a unidirectional or cardioid polar pattern pointed toward the end of each axis, or a total of four polar patterns pointing in four different planar directions, to maximize pickup all around the microphone 300. In other embodiments, additional polar patterns may be created by combining the original four polar patterns and steering the combined pattern to any angle along the plane of, for example, the table on which the microphone 100 rests.

In some embodiments, the microphone 300 further includes additional microphone elements 322 placed along one or more optional axes of the microphone 300, such as, e.g., diagonal axes 324 and 326 shown in FIG. 3, to boost SNR or increase microphone sensitivity or directivity within a given frequency band. The additional microphone elements 322 may be arranged as single elements (not shown) or in clusters, as shown in FIG. 3.

Referring now to FIG. 4, shown is another exemplary microphone 400 comprising a first linear microphone array 402 arranged along a first axis 404 and a second linear microphone array 406 arranged along a second axis 408 that is orthogonal to the first axis 404, in accordance with embodiments. Like the microphone 300 shown in FIG. 3, the orthogonal linear arrays 402 and 406 can be used to create a planar directional polar pattern for the microphone 400. Also like the microphone 300, the linear microphone array 402 includes three nested cluster-pairs 410, 412, and 414 on the first axis 404, the linear microphone array 406 includes three corresponding nested cluster-pairs 416, 418, and 420 on the second axis 408, and all of the microphone elements included therein are positioned on a first side or surface 422 of a support 423 (e.g., a frame, a PCB, a substrate, etc.) included in the microphone 400. The microphone elements can be electrically and/or mechanically coupled to the support 423, which generally defines an overall size and shape (shown here as a circle) of the microphone 400. In FIG. 4, each of the cluster-pairs 410, 412, 414, 416, 418, 420 includes clusters of four microphone elements (or "quads"). Other numbers of microphone elements per cluster are possible and contemplated.

In embodiments, the microphone 400 can further include a plurality of microphone elements positioned on a second side or surface (not shown) of the support 423, opposite the first surface 422, to increase the number of distinct frequency bands covered by the microphone 400. In the illustrated embodiment, the linear microphone array 402 includes a fourth cluster-pair 424 positioned on the second surface of the support 423, opposite the cluster-pairs 410, 412, and 414. As an example, the second surface may be a top or front surface of the microphone 400, while the first surface 422 is the back or bottom surface of the microphone 400, or vice versa. As shown, the fourth cluster-pair 424 includes clusters 424*a* and 424*b*, each of which includes a pair of microphone elements, spaced apart by a fourth distance that is smaller than a first distance between clusters 410*a,b* of the first cluster-pair 410. For example, in one embodiment, the fourth distance between clusters 424*a,b* is 7 mm, while the first distance between clusters 410*a,b* is 15.9 mm, a second distance between clusters 412*a,b* is 40 mm, and a third distance between clusters 414*a,b* is 88.9 mm. As such, the fourth cluster-pair 424 is nested within the first cluster-pair 410, but along an opposite side of the first axis 404. Similarly, the linear microphone array 406 can further include a fourth cluster-pair 426 comprising clusters 426*a,b*, each of which includes a pair of microphone elements. The clusters 426*a,b* are also spaced apart from each other by the fourth distance and are nested within a first cluster-pair 416 but along the opposite side of the second axis 408. While two cluster-pairs comprising eight microphone elements in total are shown as being arranged on the second surface of the microphone 400, more or fewer cluster-pairs and/or microphone elements are possible and contemplated.

The fourth distance may be selected to provide coverage of a higher frequency band than, for example, the high frequency band covered by the first cluster-pairs 410 and 416. For example, in certain embodiments, it may not be possible to place the fourth cluster-pairs 424 and 426 on the same surface 422 as the other cluster-pairs 410, 412, 414 due to a lack of remaining space there between. Placement of microphone elements on the opposite surface of the support 423 increases the amount of usable surface area, which enables coverage of additional frequency bands, including higher bands. For example, the microphone 400 may have broader overall frequency band coverage than, for example, the microphone 300. While coverage of four frequency bands is described herein, additional frequency bands may be added, through placement of additional sets of microphone elements appropriately spaced apart along each axis, until all desired bandwidths and/or the entire audible spectrum are covered within the requisite SNR target.

Figure 5:
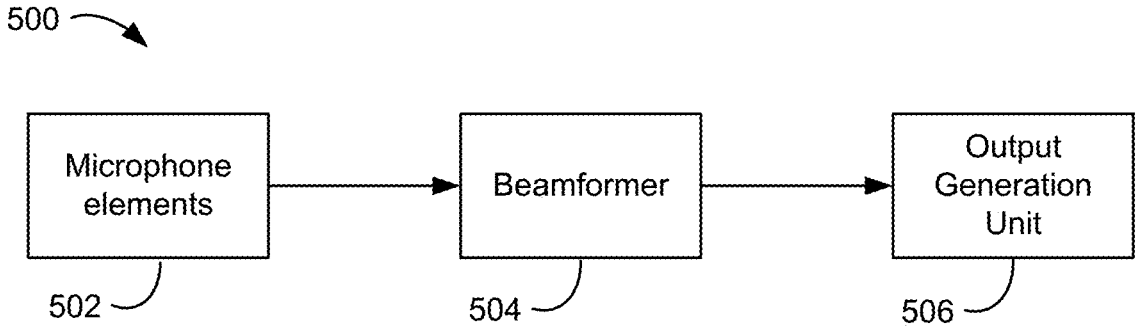
FIG. 5 is a block diagram of an exemplary microphone system in accordance with one or more embodiments.

FIG. 5 illustrates an exemplary microphone system 500 in accordance with embodiments. The microphone system 500 comprises a plurality of microphone elements 502, a beamformer 504, and an output generation unit 506. Various components of the microphone system 500 may be implemented using software executable by one or more computers, such as a computing device with a processor and memory, and/or by hardware (e.g., discrete logic circuits, application specific integrated circuits (ASIC), programmable gate arrays (PGA), field programmable gate arrays (FPGA), etc.). For example, some or all components of the beamformer 504 may be implemented using discrete circuitry devices and/or using one or more processors (e.g., audio processor and/or digital signal processor) (not shown) executing program code stored in a memory (not shown), the program code being configured to carry out one or more processes or operations described herein, such as, for example, method 800 shown in FIG. 8. Thus, in embodiments, the system 500 may include one or more processors, memory devices, computing devices, and/or other hardware components not shown in FIG. 5. In a preferred embodiment, the system 500 includes at least two separate processors, one for consolidating and formatting all of the microphone elements and another for implementing DSP functionality.

The microphone elements 502 may include the microphone elements included in any of the microphone 100 shown in FIG. 1, the microphone 300 shown in FIG. 3, the microphone 400 shown in FIG. 4, or other microphone designed in accordance with the techniques described herein. The beamformer 504 may be in communication with the microphone elements 502 and may be used to beamform audio signals captured by the microphone elements 502. The output generation unit 506 may be in communication with the beamformer 504 and may be used to process the output signals received from the beamformer 504 for output generation via, for example, loudspeaker, telecast, etc.

Figure 6:
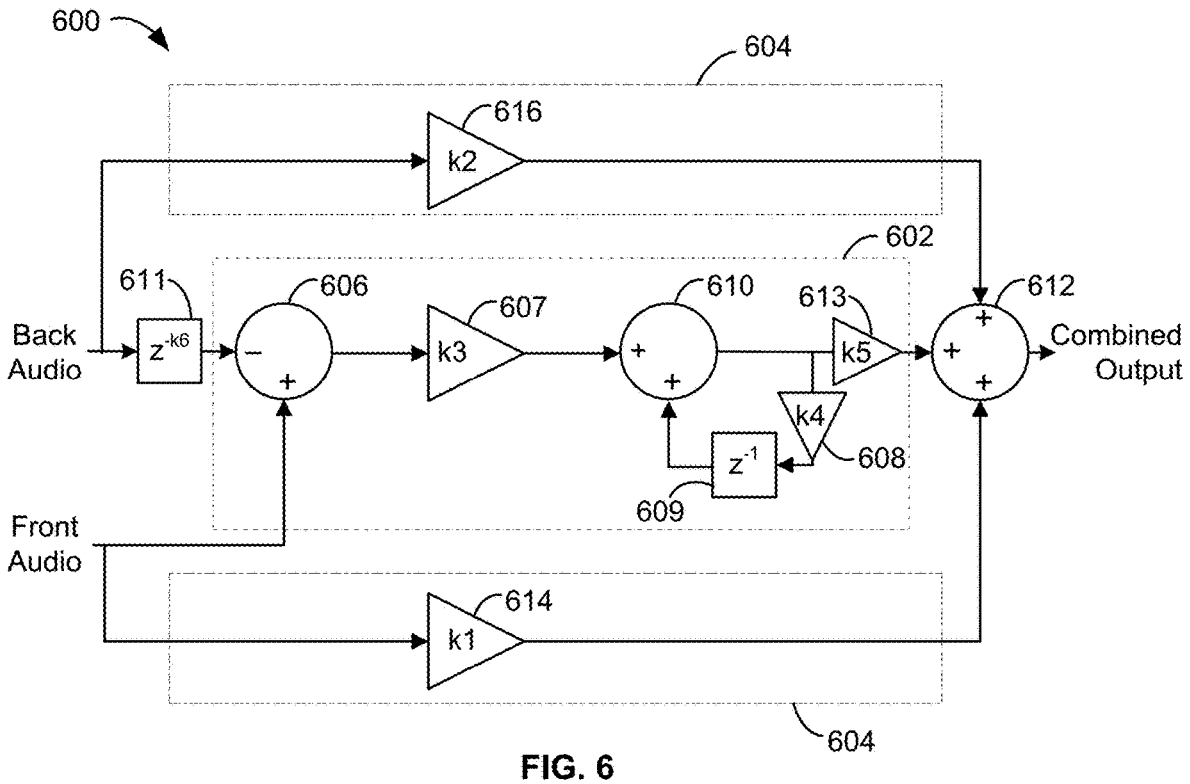
FIG. 6 is a block diagram illustrating an exemplary pattern-forming beamformer for combining audio signals captured by a given set of microphone elements, in accordance with one or more embodiments.
Figure 7:
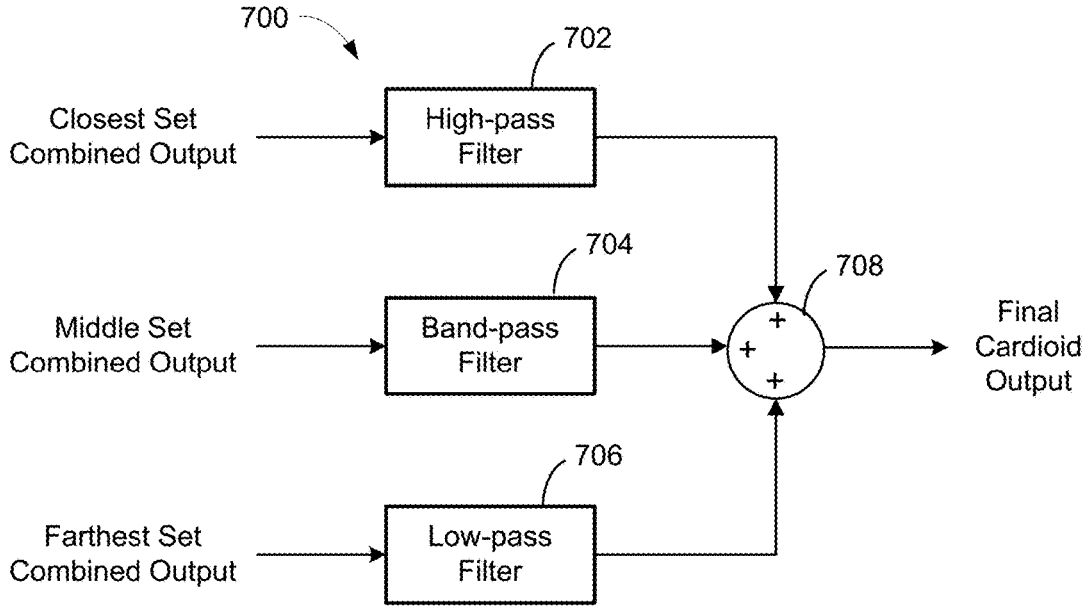
FIG. 7 is a block diagram illustrating an exemplary pattern-combining beamformer for combining audio outputs received from nested sets of microphone elements, in accordance with one or more embodiments.

In embodiments, the beamformer 504 may include one or more components to facilitate processing of the audio signals received from the microphone elements 502, such as, e.g., pattern-forming beamformer 600 of FIG. 6 and/or pattern-combining beamformer 700 of FIG. 7. As described in more detail below with reference to FIG. 8, pattern-forming beamformer 600 combines audio signals captured by a set of microphone elements arranged in a linear array to form a combined output signal having a directional polar pattern, in accordance with embodiments. And pattern-combining beamformer 700 combines the output signals received from multiple nested sets in a microphone array to form a final cardioid output for the overall array, in accordance with embodiments. Other beamforming techniques may also be performed by the beamformer 504 to obtain a desired output.

Figure 8:
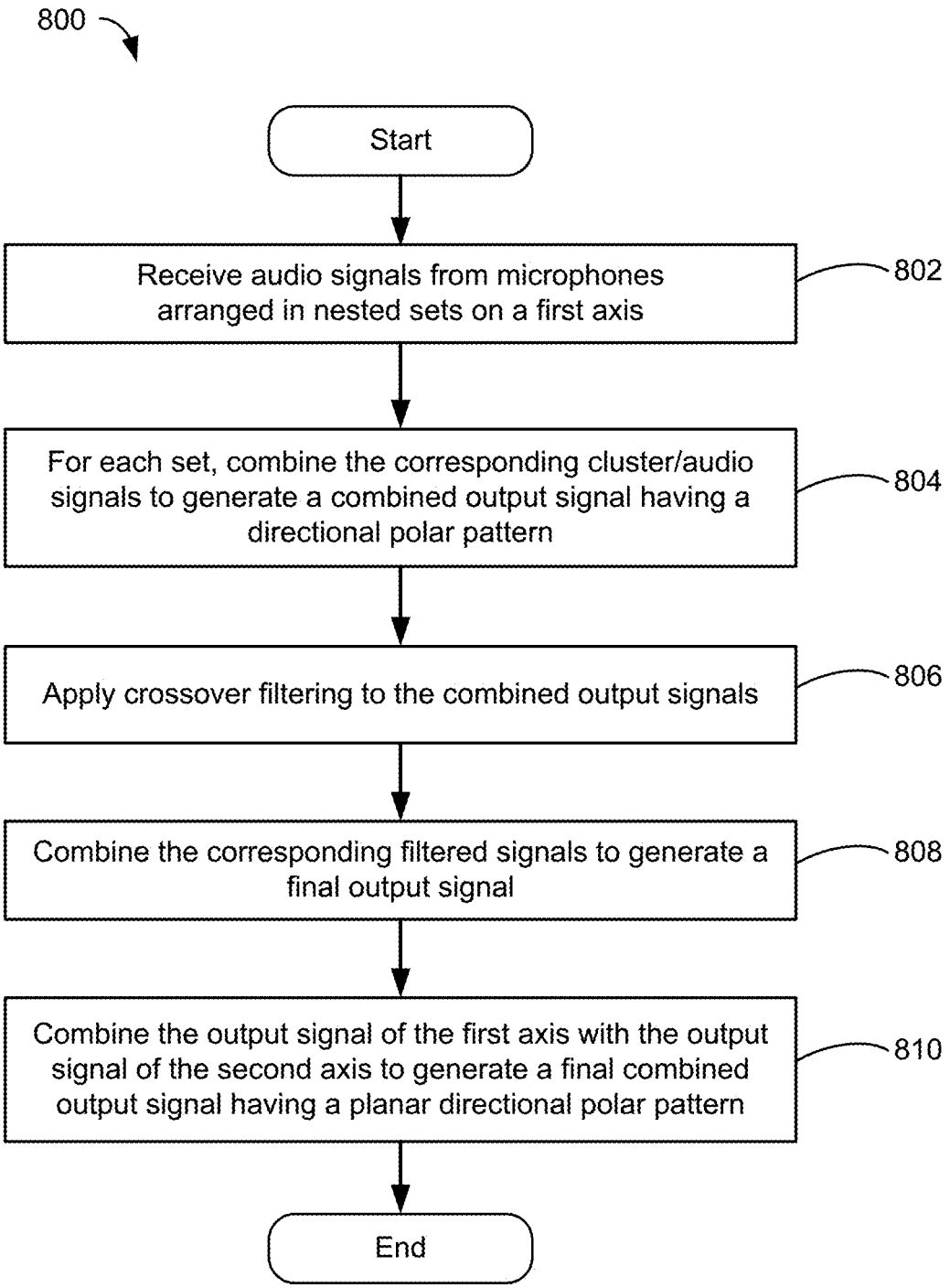
FIG. 8 is a flowchart illustrating an exemplary method performed by an audio processor to generate a beamformed output signal with a directional polar pattern for a microphone array comprising at least one linear nested array, in accordance with one or more embodiments.

FIG. 8 illustrates an exemplary method 800 of generating a beamformed output signal with a directional polar pattern for a microphone array comprising at least one linear nested array, in accordance with embodiments. All or portions of the method 800 may be performed by one or more processors (such as, e.g., an audio processor included in the microphone system 500 of FIG. 5) and/or other processing devices (e.g., analog to digital converters, encryption chips, etc.) within or external to the microphone. In addition, one or more other types of components (e.g., memory, input and/or output devices, transmitters, receivers, buffers, drivers, discrete components, logic circuits, etc.) may also be utilized in conjunction with the processors and/or other processing components to perform any, some, or all of the steps of the method 800. For example, program code stored in a memory of the system 500 may be executed by the audio processor in order to carry out one or more operations of the method 800.

In some embodiments, certain operations of the method 800 may be performed by the pattern-forming beamformer 600 of FIG. 6, and other operations of the method 800 may be performed by the pattern-combining beamformer 700 of FIG. 7. The microphone array may be any of the microphone arrays described herein, such as, e.g., the microphone array 200 of FIG. 2, one or more of the linear microphone arrays in the microphone 300 of FIG. 3, or one or more of the linear microphone arrays 402 and 406 shown in FIG. 4. In some embodiments, the microphone array includes a plurality of microphone elements coupled to a support, such as, e.g., the support 112 of FIG. 1, the support 311 of FIG. 3, or the support 423 of FIG. 4. The microphone elements may be, for example, MEMS transducers which are inherently omnidirectional, other types of omnidirectional microphones, electret or condenser microphones, or other types of omnidirectional transducers or sensors.

Referring back to FIG. 8, the method 800 begins, at block 802, with a beamformer or processor, receiving audio signals from a plurality of microphone elements (e.g., microphone elements 502 of FIG. 5) arranged in a nested configuration along one or more axes of a microphone support. The nested configuration may take different forms, for example, as shown by the different microphone arrays of FIGS. 1-4. As an example, the plurality of microphone elements can include a first set of microphone elements arranged along the first axis (e.g., axis 308 of FIG. 3) and nested within a second set of microphone elements also on the same axis. The first set (e.g., Set 1 of FIG. 2) may include at least two microphone elements (e.g., microphone elements 102*a,b* of FIG. 2) spaced apart from each other by a first distance (e.g., d1 of FIG. 2) selected for optimal microphone operation in a first frequency band. The second set (e.g., Set 2 of FIG. 2) may include at least two microphone elements (e.g., microphone elements 104*a,b* of FIG. 2) spaced apart from each other by a second distance (e.g., d2 of FIG. 2) that is greater than the first distance and is selected for optimal microphone operation in a second frequency band lower than the first frequency band. The microphone elements of each set may be symmetrically positioned on the first axis, for example, relative to a second, orthogonal axis (e.g., as shown in FIG. 1).

In some embodiments, the plurality of microphone elements may further include a third set (e.g., Set 3 of FIG. 2) of elements comprising at least two microphone elements (e.g., microphone elements 106*a,b* of FIG. 2) spaced apart from each other by a third distance (e.g., d3 of FIG. 2) along the first axis. The third distance may be larger than the second distance, so that the second set can be nested within the third set. The third distance may be selected to configure the third set of microphone elements for optimal microphone operation in a third frequency band that is lower than the second frequency band.

In some embodiments, at least one of the nested sets is comprised of two clusters of microphone elements spaced apart by the specified distance along the first axis (e.g., as shown in FIG. 3), instead of two individual microphone elements. For such sets, the at least two microphone elements may include a first cluster of two or more microphone elements (e.g., cluster 302*a*, 304*a*, or 306*a* of FIG. 3) and a second cluster of two or more microphone elements (e.g., cluster 302*b*, 304*b*, or 306*b* of FIG. 3) located a specified distance (e.g., d1, d2, or d3) from the first cluster. The second cluster for each set may correspond with, or be a duplicate of, the first cluster of that set in terms of number (e.g., 2, 4, etc.) and arrangement (e.g., placement, spacing, symmetry, etc.) of microphone elements.

At block 804, for each set of microphone elements along a given axis, the audio signals received from the microphone elements of that set are combined to generate an output signal having a directional polar pattern, such as, e.g., a cardioid polar pattern. In certain embodiments, combining the audio signals for a given set of microphone elements at block 804 includes subtracting the audio signals received from the microphone elements therein to generate a first signal having a bidirectional polar pattern, summing the received audio signals to generate a second signal having an omnidirectional polar pattern, and summing the first and second signals to generate a combined output signal having a cardioid polar pattern. As will be appreciated, the operations associated with block 804 may be repeated until all sets within the microphone array have corresponding output signals representing the combined outputs of the microphone elements therein.

If the microphone elements are arranged in clusters, the signal combining process at block 804 may include, prior to generating the first signal, creating a cluster signal for each cluster in the set (e.g., front cluster and back cluster) based on the audio signals captured by the microphone elements in that cluster. The cluster signal may be created by, for example, summing the audio signals received from each of the closely-located microphone elements included in that cluster and normalizing the summed result. Each cluster of microphone elements may effectively operate as a single, higher sensitivity microphone that provides a boost in SNR (as compared to the individual microphone elements). Once front and back cluster signals are created for each cluster within the set (or cluster-pair), the front and back cluster signals for each set may be combined in accordance with block 804 to generate the combined output signal for that set. Other techniques for combining the audio signals for each microphone cluster are also possible and contemplated.

In embodiments, all or portions of the signal combining process in block 804 may be performed by the exemplary pattern-forming beamformer 600 of FIG. 6. As shown, the beamformer 600 receives audio signals produced or output by one or more front microphone elements (e.g., a single element or a front cluster of elements) and one or more back microphone elements (e.g., a single element or a back cluster of elements) included in a set (or cluster-pair) of a microphone array. The front and back elements may be spaced apart from each other by a specified distance along a first axis. In a preferred embodiment, the microphone elements are MEMS transducers that inherently have an omnidirectional polar pattern. If the microphone array includes spaced apart clusters of microphone elements, the received audio signals may be the corresponding front and back cluster signals for the given cluster-pair.

As shown in FIG. 6, the front and back audio signals are provided to two different segments of the beamformer 600. A first segment 602 generates a first output signal having a bidirectional, or other first order polar pattern by, among other things, taking a differential of the audio signals received from the omnidirectional microphone elements of the given cluster-pair. A second segment 604 generates a second output signal having an omnidirectional polar pattern, at least within the frequencies of interest, by, among other things, summing the audio signals received from the omnidirectional microphone elements. The outputs of the first segment 602 and the second segment 604 are summed together to generate a combined output signal with a cardioid pickup pattern, or other directional polar pattern.

In embodiments, the first segment 602 can perform subtraction, integration, and delay operations on the received audio signals to create the bidirectional or other first order polar pattern. As shown in FIG. 6, the first segment 602 includes a subtraction (or invert-and-sum) element 606 that is in communication with the front and back microphone elements. The subtraction element 606 generates a differential signal by subtracting the back audio signal from the front audio signal.

The first segment 602 also includes an integration subsystem for performing an integration operation on the differential signal received from the subtraction element 606. In some embodiments, the integration subsystem can operate as a correction filter that corrects for the sloped frequency response of the differential signal output by the subtraction element 606. For example, the correction filter may have a sloped frequency response that is the inverse of the differential signal's sloped response. Additionally, the correction filter may add a 90 degree phase shift to the output of the first segment 602, so that the front of the pattern is phase-aligned and the back of the pattern is anti-aligned, thus enabling creation of the cardioid pattern. In some embodiments, the integration subsystem may be implemented using appropriately configured low-pass filters.

In the illustrated embodiment, the integration subsystem includes an integration gain element 607 configured to apply a gain factor k3 (also known as an integration constant) to the differential signal. The integration constant k3 may be tuned to the known separation or distance (e.g., d1, d2, or d3) between the microphone clusters (or elements). For example, the integration constant k3 may be equal to (speed of sound)/(sample rate)/(distance between clusters). The integration subsystem also includes a feedback loop formed by a feedback gain element 608, a delay element 609, and a summation element 610, as shown. The feedback gain element 608 has a gain factor k4 that may be selected to configure the feedback gain element 608 as a "leaky" integrator, so as to make the first segment 602 more robust against feedback instabilities, as needed. As an example, in some embodiments, the gain factor k4 may be equal to or less than one (1). The delay element 609 adds an appropriate amount of delay (e.g., $z^{-1}$) to the output of the feedback gain element 608. In the illustrated embodiment, the delay amount is set to one (i.e. a single sample delay).

In some embodiments, the first segment 602 also includes a second delay element 611 at the beginning of the first segment 602, as shown in FIG. 6, in order to add a delay (e.g., $z^{-k6}$) to the back audio signal before subtraction by element 606. The "k6" parameter of the second delay element 611 may be selected based on a desired first order polar pattern for the path 602. For example, when k6 is set to zero (0), the first segment 602 creates a bidirectional polar pattern, However, when k6 is set to an integer greater than zero, other first order polar patterns may be created.

As shown in FIG. 6, the output of the summation element 610 (or the output of the integration subsystem) may be provided to a final summation element 612 that also receives the outputs of the second segment 604. In some embodiments, the first segment 602 further includes a gain element 613, with gain factor k5, coupled between the output of the integration subsystem and an input for the final summation element 612. The gain element 613 may be configured to apply an appropriate amount of gain to the corrected output of the integration subsystem, before reaching the summation element 612. The exact amount of gain k5 may be selected based on gain amounts applied in the second segment 604, as described below.

The second segment 604 can perform summation and gain operations on the audio signals received from the given set of microphone elements to create the omnidirectional response. As shown in FIG. 6, the second segment 604 includes a first gain element 614, with gain factor k1, in communication with the front microphone element(s) and a second gain element 616, with gain factor k2, in communication with the back microphone element(s). In some embodiments, the gain elements 614 and 616 can be configured to normalize the output of the front and back microphone elements. For example, the gain factors k1 and k2 for the gain elements 614 and 616 may be set to 0.5 (or ½), so that the output of the second segment 604 matches the output of a single omnidirectional microphone in terms of magnitude. Other gain amounts are possible and contemplated.

In some embodiments, the gain component 613 may be included on the first segment 602 as an alternative to the first and second gain elements 614, 616 of the second segment 604. In other embodiments, all three gain components 613, 614, 616 may be included, and the gain factors k1, k2, k5 may be configured in order to add an appropriate amount of gain to the corrected output of the integration subsystem and/or the output of the second segment 604, before they reach the summation element 612. For example, the amount of gain k5 may be selected in order to obtain a specific first order polar pattern. In a preferred embodiment, to create a cardioid pattern, the gain factor k5 may be set to one (1), so that the output of the first segment 602 (e.g., the bidirectional component) matches the output of the second segment 604 (e.g., the omnidirectional component) in terms of magnitude. Other values for the gain factor k5 may be selected depending on the desired polar pattern for the first segment path 602, the value selected for the k6 parameter of the initial delay element 611, and/or the desired polar pattern for the overall set of microphone elements.

As shown in FIG. 6, the outputs of the gain elements 614 and 616 can be provided to the final summation element 612, which sums the outputs to generate the omnidirectional output of the second segment 604. The final summation element 612 also sums the output of the second segment 604 with the bidirectional (or other first order pattern) output of the first segment 602, thus generating the cardioid (or other first order pattern) output of the beamformer 600.

Referring back to FIG. 8, once a final output signal having a directional polar pattern is obtained at block 804, the method 800 continues to block 806, where crossover filtering is applied to the combined output signal generated for each set of microphone elements arranged along a given axis, so that each set can optimally cover the frequency band associated therewith. At block 808, the filtered outputs for each set of microphone elements may be combined to generate a final output signal for the microphone elements on that axis.

In embodiments, the crossover filtering includes applying an appropriate filter to the output of each set (or cluster-pair) in order to isolate the combined output signals into different or discrete frequency bands. As will be appreciated, there is an inverse relationship between the amount of separation between elements (or clusters) in a given set (or cluster-pair) and the frequency band(s) that can be optimally covered by that set. For example, larger microphone spacings may have a smaller low frequency response loss, thus resulting in a better low frequency SNR. At the same time, larger spacings can have a lower frequency null, and smaller spacings can have a higher frequency null. In embodiments, crossover filtering can be applied to avoid these nulls and stitch together an ideal frequency response for the microphone array, while maintaining an SNR that is better than a single, closely-spaced pair of microphones.

According to embodiments, all or portions of blocks 806 and 808 may be performed by exemplary pattern-combining beamformer 700 of FIG. 7. In the illustrated embodiment, the beamformer 700 receives combined output signals for a nearest, or most closely-spaced, set of microphone elements (e.g., clusters 302*a,b* of FIG. 3), an intermediate, or medium-spaced, set of microphone elements (e.g., clusters 304*a,b* of FIG. 3), and a furthest, or farthest-spaced, set of microphone elements (e.g., clusters 306*a,b* of FIG. 3), all along a first axis. In embodiments, the beamformer 700 may be in communication with a plurality of beamformers 600 in order to receive the combined output signals. For example, a separate beamformer 600 may be coupled to each cluster-pair (or set) included in the microphone array, so that the respective beamformer 600 can be tailored to, for example, the separation distance of that cluster-pair and/or other factors.

As shown, the beamformer 700 includes a plurality of filters 702, 704, 706 to implement the crossover filtering process. In the illustrated example, the combined output signal for the closest set is provided to high-pass filter 702, the combined output signal for the middle set is provided to bandpass filter 704, and the combined output signal for the farthest set is provided to low-pass filter 706. The cutoff frequencies for filters 702, 704, and 706 may be selected based on the specific frequency response characteristics of the corresponding set or cluster-pair, including, for example, location of frequency nulls, a desired frequency response for the microphone array, etc. According to one embodiment, for the bandpass filter 704, the high frequency cutoff may be determined by the natural −1 decibel (dB) point of the cardioid frequency response for the corresponding combined output signal, and the low frequency cutoff may be determined by the cutoff of the lower band, but no lower than 20 hertz (Hz). The filters 702, 704, 706 may be analog or digital filters. In a preferred embodiment, the filters 702, 704, 706 are implemented using digital finite impulse response (FIR) filters on a digital signal processor (DSP) or the like.

In other embodiments, the beamformer 700 may include more or fewer filters. For example, the beamformer 700 could be configured to include four filters or two filters, instead of the illustrated three band solution. In still other embodiments, the beamformer 700 may include a different combination of filters. For example, the beamformer 700 may be configured to include multiple bandpass filters, instead of high-pass or low-pass filters, or any other combination of bandpass, low-pass, and/or high-pass filters.

As shown in FIG. 7, the filtered outputs are provided to a summation element 708 of the beamformer 700. The summation element 708 combines or sums the filtered outputs to generate an output signal, which may represent a final cardioid output for the microphone elements included on the first axis of the microphone array, or other first order polar pattern.

In some embodiments, the plurality of microphone elements for a given microphone array further includes additional sets of elements arranged along a second axis (e.g., axis 314 of FIG. 3) that is orthogonal to the first axis. The additional sets on the second axis may be duplicates or copies of the sets arranged on the first axis in terms of arrangement (e.g., nesting, spacing, clustering, etc.) and number of microphone elements (e.g., 1, 2, 4, etc.) For example, the additional sets of microphone elements may include a first set (e.g., cluster-pair 316 of FIG. 3) nested within a second set (e.g., cluster-pair 318 of FIG. 3) along the second axis. Like the first set arranged along the first axis, the first set on the second axis may include at least two microphone elements (e.g., clusters 316*a,b* of FIG. 3) spaced apart from each other by the first distance (e.g., d1 of FIG. 2), so as to optimally cover the first frequency band. Likewise, the second set may include at least two microphone elements (e.g., clusters 318*a,b* of FIG. 3) spaced apart from each other by the second distance (e.g., d2 of FIG. 2), so as to optimally cover the second frequency band, similar to the second set on the first axis.

Referring back to FIG. 8, in cases where the microphone array includes microphone elements on two orthogonal axes, the method 800 may further include, at block 810, combining the final output signal generated for the first axis with a final output signal generated for the second axis in order to create a final combined output signal having a planar and/or steerable directional polar pattern. In such cases, blocks 802 to 808 may be applied to the microphone elements arranged on the second axis to generate the final output signal for that axis.

For example, at block 802, audio signals may also be received from each microphone element on the second axis, in addition to the first axis. At block 804, a combined output signal may be generated for each set (or cluster-pair) of microphone elements arranged on the second axis, in addition to the first axis. That is, the combining process in block 804 (and as shown in FIG. 6) may be repeated for each set of elements on each axis of the array. The filter and combine processes in blocks 806 and 808 (and as shown in FIG. 7) may be performed in an axis-by-axis manner. That is, the combined output signals for the sets included on the second axis may be filtered and combined together in one beamforming process, while the combined output signals for the sets included on the second axis may be filtered and combined together in another beamforming process, either simultaneously or consecutively. The final output signals generated for each axis at block 808 can then be provided to block 810.

At block 810, the final output signal for the first axis is combined with the final output signal for the second axis to obtain a final combined output signal with a planar directional response (e.g., toroidal, unidirectional, etc.). The signals for the two axes can be combined using weighting and summing techniques, if a steered first order polar pattern is desired, or using filtering and summing techniques, if a toroidal polar pattern is desired. For example, appropriate weighting values can be applied to the output signals for each axis to create different polar patterns and/or steer the lobes of the pickup pattern to a desired direction.

In accordance with certain embodiments, a method of assembling a microphone array can comprise forming a first set of microphone elements along a first axis, the first set including at least two microphone elements spaced apart from each other by a first distance; forming a second set of microphone elements along the first axis, the second set including at least two microphone elements spaced apart from each other by a second distance greater than the first distance, such that the first set is nested within the second set; and electrically coupling each microphone element to at least one processor for processing audio signals captured by the microphone elements, wherein the first distance is selected for optimal microphone operation in a first frequency band, and the second distance is selected for optimal microphone operation in a second frequency band that is lower than the first frequency band. According to aspects, the method can further comprise forming a third set of elements positioned along a second axis orthogonal to the first axis, the third set comprising at least two microphone elements spaced apart from each other by the second distance; and forming a fourth set of elements nested within the third set along the second axis, the fourth set comprising at least two microphone elements spaced apart from each other by the first distance. According to further aspects, the method can also comprise forming a fifth set of elements comprising at least two microphone elements spaced apart from each other by a third distance along the first axis, the third distance being greater than the second distance, so that the second set is nested within the fifth set, wherein the third distance is selected for optimal microphone operation in a third frequency band that is lower than the second frequency band. According to other aspects, the method can further comprise placing a select one of the first and second sets on a first surface of the microphone array, and placing the remaining set on a second surface opposite the first surface.

Figure 9:
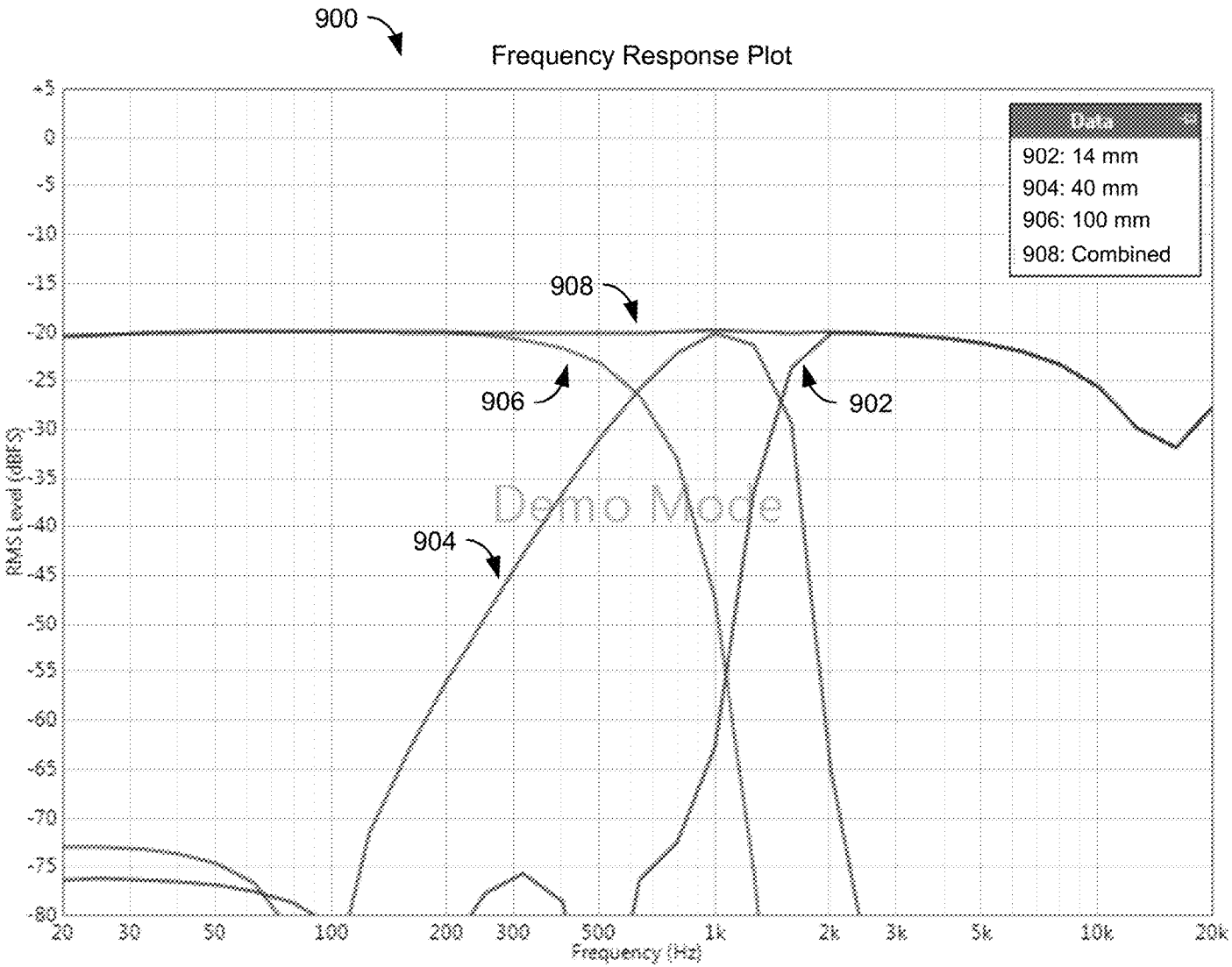
FIG. 9 is a frequency response plot of an exemplary microphone array in accordance with one or more embodiments.

FIG. 9 is a frequency response plot 900 for an exemplary microphone array with three sets of microphone elements arranged in a linear nested array, for example, similar to the cluster-pairs 302, 304, 306 arranged along the first axis 308 in FIG. 3, in accordance with embodiments. In particular, the plot 900 shows filtered frequency responses for a closest set (902) including microphone clusters spaced 14 millimeters (mm) apart, a middle set (904) including microphone clusters spaced 40 mm apart, and a farthest set (906) including microphone clusters spaced 100 mm apart. In addition, plot 900 shows a combined frequency response 908 for all three sets of the linear nested array. In embodiments, the frequency responses 902, 904, 906 represent the filtered outputs of respective crossover filters 702, 704, 706 included in the pattern-combining beamformer 700 of FIG. 7, and the frequency response 908 is the combined output, or summation, of the filtered signals.

As shown, the frequency response 902 of the closest set flattens out after about 2 kilohertz (kHz), while the frequency response 906 of the farthest set is generally flat until about 200 Hz. The frequency response 904 of the middle set peaks at about 1 kHz, with a −6 dB/octave rise crossing the farthest set response 906 at about 650 Hz and a −6 dB/octave drop crossing the closest set response 902 at about 1.5 kHz. The filtered and combined frequency response 908 stitches the three responses together to provide a generally flat frequency response across almost the entire audio bandwidth (e.g., 20 Hz to 20 kHz), with attenuation only occurring at higher frequencies (e.g., above 5 kHz).

Figure 10:
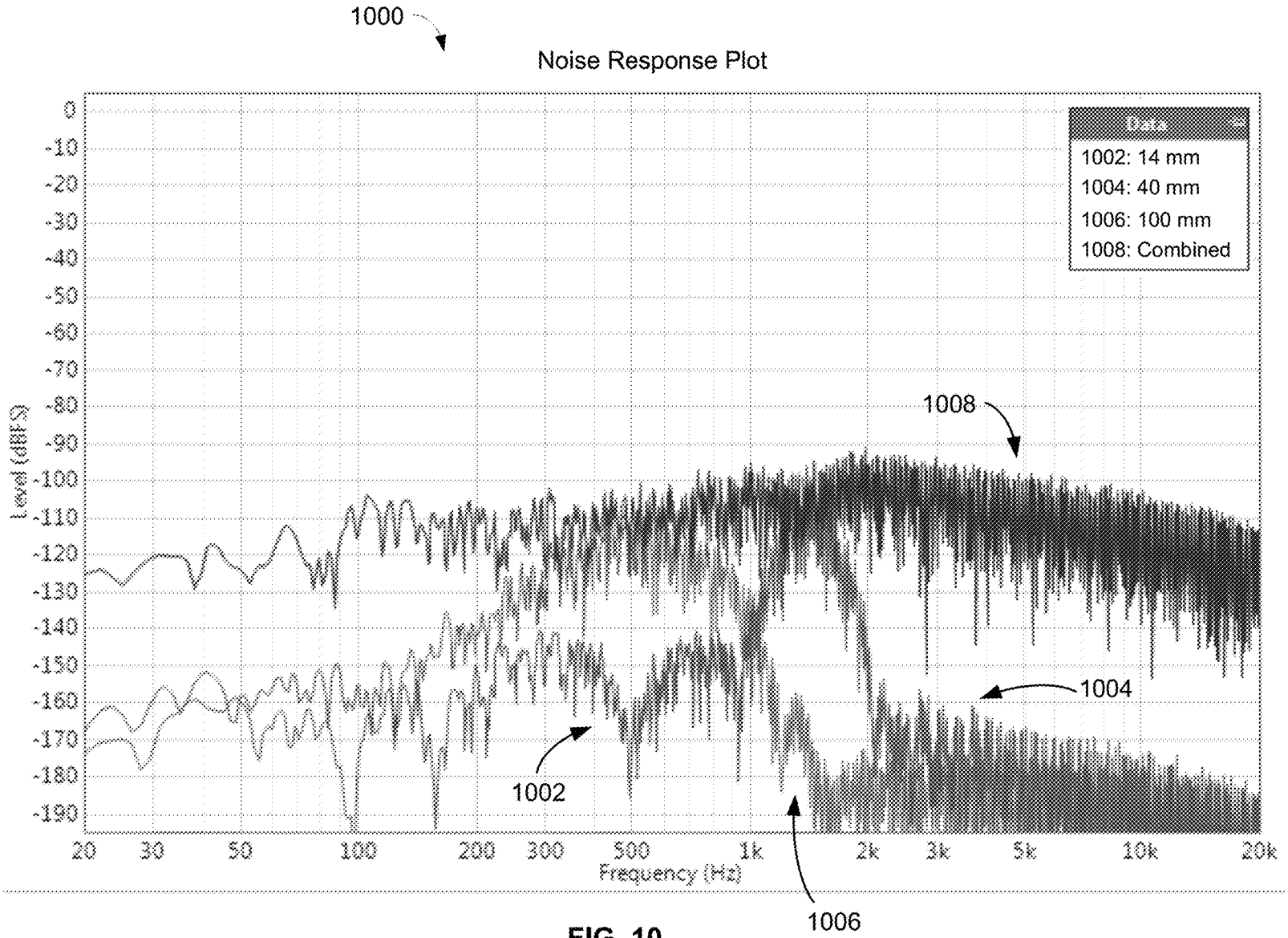
FIG. 10 is a noise response plot of an exemplary microphone array in accordance with one or more embodiments.

FIG. 10 illustrates a noise response plot 1000 for an exemplary microphone array with three sets of microphone elements arranged in a linear nested array, for example, similar to the cluster-pairs 302, 304, 306 arranged along the first axis 308 in FIG. 3, in accordance with embodiments. The noise response plot 1000 corresponds to the filtered and combined frequency response plot 900 shown in FIG. 9. In particular, the noise response plot 1000 shows noise responses that represent the filtered outputs of the closest set (1002), the middle set (1004), and the farthest set (1006), as well as the combined output of all three (1008).

Thus, the techniques described herein provide a high performance microphone capable of having a highly directional polar pattern, improved signal-to-noise ratio (SNR), and wideband audio application (e.g., 20 hertz (Hz)≤f≤20 kilohertz (kHz). The microphone includes at least one linear nested array comprising one or more sets of microphone elements separated by a distance selected to optimally cover a desired operating band. In some cases, the microphone elements are clustered and crossover filtered to further improve SNR characteristics and optimize the frequency response. One or more beamformers can be used to generate a combined output signal for each linear array having a desired directional polar pattern (e.g., cardioid, hypercardioid, etc.). In some cases, at least two linear arrays are symmetrically arranged on orthogonal axes to achieve a planar directional polar pattern (e.g., toroidal, etc.), thus making the microphone optimal for conferencing applications.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

What is claimed is:

1. A microphone system, comprising:

a planar microphone array comprising:

a first linear array arranged along a first axis; and a second linear array arranged along a second axis orthogonal to the first axis, a center of the second linear array aligned with a center of the first linear array, wherein each linear array comprises a corresponding first set of microphone elements nested within a corresponding second set of microphone elements, and each set of microphone elements is arranged symmetrically about the center of the corresponding linear array, the microphone elements in each of the first linear array and the second linear array being configured to capture audio signals;

one or more processors; and a memory storing instructions that, when executed, cause the one or more processors to:

for each of the first linear array and the second linear array, combine the audio signals received from the corresponding first set of microphone elements to generate a first combined output signal with a first directional polar pattern, and combine the audio signals received from the corresponding second set of microphone elements to generate a second combined output signal with a second directional polar pattern; and combine a first output signal that is generated by combining the first and second combined output signals from the first linear array, with a second output signal that is generated by combining the first and second combined output signals from the second linear array, to produce a final output signal having a steerable directional polar pattern, wherein for each set of microphone elements in each of the first linear array and the second linear array, combining the audio signals received from a given set of microphone elements comprises:

summing a first signal, produced by subtracting the audio signals received from the microphone elements in the given set, with a second signal, produced by adding the audio signals received from the microphone elements in the same set, to generate the corresponding combined output signal.

2. The microphone system of claim 1, wherein the memory stores further instructions that, when executed, cause the one or more processors to:

for each of the first linear array and the second linear array, apply crossover filtering to the first and second combined output signals generated for the corresponding linear array, so that each set of microphones elements in the corresponding linear array optimally covers the frequency band associated with that set.

3. The microphone system of claim 1, wherein the memory stores further instructions that, when executed, cause the one or more processors to:

steer the directional polar pattern to a select angle by applying a first weighting value to the first output signal and a second weighting value to the second output signal, the first and second weighting values being selected based on the select angle.

4. The microphone system of claim 1, wherein for each of the first linear array and the second linear array, the corresponding first set of microphone elements comprises at least two microphone elements spaced apart by a first distance, and the corresponding second set of microphone elements comprises at least two microphone elements spaced apart by a second distance greater than the first distance, the first distance being selected for optimal microphone operation in a first frequency band, and the second distance being selected for optimal microphone operation in a second frequency band that is lower than the first frequency band.

5. The microphone system of claim 1, wherein each microphone element is a micro-electrical mechanical system (MEMS) microphone.

6. A method performed by one or more processors to generate an output signal for a planar microphone array comprising a first linear array and a second linear array, the method comprising:

receiving audio signals from each of the first linear array and the second linear array, the first linear array arranged along a first axis and the second linear array arranged along a second axis orthogonal to the first axis, a center of the second linear array aligned with a center of the first linear array, wherein each of the first linear array and the second linear array comprises a corresponding first set of microphone elements nested within a corresponding second set of microphone elements, and each set of microphone elements is arranged symmetrically about the center of the corresponding linear array;

for each of the first linear array and the second linear array, combining the audio signals received from the corresponding first set of microphone elements to generate a first combined output signal with a first directional polar pattern, and combining the audio signals received from the corresponding second set of microphone elements to generate a second combined output signal with a second directional polar pattern; and combining a first output signal, generated by combining the first and second combined output signals from the first linear array, with a second output signal, generated by combining the first and second combined output signals from the second linear array, to produce a final output signal with a steerable directional polar pattern, wherein for each set of microphone elements in each of the first linear array and the second linear array, combining the audio signals receive from a given set of microphone elements comprises:

summing a first signal, produced by subtracting the audio signals received from the microphone elements in the given set, with a second signal, produced by adding the audio signals received from the microphone elements in the same set, to generate the corresponding combined output signal.

7. The method of claim 6, further comprising:

for each of the first linear array and the second linear array, apply crossover filtering to the first and second combined output signals generated for the corresponding linear array, so that each set of microphones elements in the corresponding linear array optimally covers the frequency band associated with that set.

8. The method of claim 6, further comprising steering the directional polar pattern to a select angle by applying a first weighting value to the first output signal and a second weighting value to the second output signal, the first and second weighting values being selected based on the select angle.

9. The method of claim 6, wherein for each of the first linear array and the second linear array, the corresponding first set of microphone elements comprises at least two microphone elements spaced apart by a first distance selected to configure the first set for optimal microphone operation in a first frequency band, and the corresponding second set of microphone elements comprises at least two microphone elements spaced apart by a second distance that is greater than the first distance, the second distance selected to configure the second set for optimal microphone operation in a second frequency band that is lower than the first frequency band.

10. The method of claim 6, wherein each microphone element is a micro-electrical mechanical system (MEMS) microphone.

11. A planar microphone array, comprising:

a first linear array arranged along a first axis; and a second linear array arranged along a second axis orthogonal to the first axis, a center of the second linear array aligned with a center of the first linear array, wherein each of the first linear array and the second linear array comprises a corresponding first set of microphone elements nested within a corresponding second set of microphone elements, and each set of microphone elements is arranged symmetrically about the center of the corresponding linear array, such that the first linear array and the second linear array are configured to generate a steerable directional polar pattern, the microphone elements of each of the first linear array and the second linear array being configured to capture audio signals, and wherein at least one of the sets of microphone elements is placed on a first surface of the microphone array, and the remaining sets of microphone elements are placed on a second surface opposite the first surface, and wherein for each of the first linear array and the second linear array, the corresponding first set of microphone elements comprises at least two microphone elements spaced apart by a first distance, and the corresponding second set of microphone elements comprises at least two microphone elements spaced apart by a second distance greater than the first distance, the first distance being selected for optimal microphone operation in a first frequency band, and the second distance being selected for optimal microphone operation in a second frequency band that is lower than the first frequency band, and wherein each of the first linear array and the second linear array further comprises a corresponding third set of microphone elements comprising at least two microphone elements spaced apart from each other by a third distance greater than the second distance, such that the second set is nested within the third set, wherein the third distance is selected for optimal microphone operation in a third frequency band that is lower than the second frequency band.

12. The planar microphone array of claim 11, wherein each microphone element is a micro-electrical mechanical system (MEMS) microphone.

* * * * *